US007531298B2

(12) United States Patent
Matsunaga et al.

(10) Patent No.: US 7,531,298 B2
(45) Date of Patent: May 12, 2009

(54) SILVER HALIDE COLOR PHOTOSENSITIVE MATERIAL

(75) Inventors: Atsushi Matsunaga, Minami-Ashigara (JP); Makoto Kikuchi, Minami-Ashigara (JP); Kiyoshi Morimoto, Minami-Ashigara (JP); Masahiko Taniguchi, Minami-Ashigara (JP); Naoyuki Hanaki, Minami-Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 531 days.

(21) Appl. No.: 10/980,851

(22) Filed: Nov. 4, 2004

(65) Prior Publication Data

US 2005/0106513 A1 May 19, 2005

(30) Foreign Application Priority Data

| | | |
|---|---|---|
| Nov. 5, 2003 | (JP) | 2003-376147 |
| Nov. 7, 2003 | (JP) | 2003-378945 |
| Jan. 9, 2004 | (JP) | 2004-003673 |
| Jan. 30, 2004 | (JP) | 2004-022642 |

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |
| ***G03C 1/494*** | (2006.01) |

(52) U.S. Cl. ..... 430/502; 430/503; 430/506; 430/546; 430/553; 430/555; 430/631; 430/583; 430/599; 430/600; 430/603; 430/607; 430/613; 430/955

(58) Field of Classification Search ..... 430/502, 430/503, 506, 546, 553, 555, 631, 583, 599, 430/600, 603, 607, 613, 955

See application file for complete search history.

(56) References Cited

U.S. PATENT DOCUMENTS

| | | | | |
|---|---|---|---|---|
| 6,686,140 | B2 * | 2/2004 | Asanuma et al. | 430/955 |
| 2005/0069824 | A1 * | 3/2005 | Ninomiya et al. | 430/502 |
| 2005/0069825 | A1 * | 3/2005 | Miki | 430/502 |

* cited by examiner

*Primary Examiner*—Geraldina Visconti
(74) *Attorney, Agent, or Firm*—Sughrue Mion, PLLC

(57) ABSTRACT

A silver halide color photosensitive material, wherein the total coating amount of silver of the photosensitive silver halide is 6.0 g/m$^2$ or less in terms of metal silver, and the photosensitivity is the ISO speed of 400 or more, the silver halide color photosensitive material further comprising at least one compound selected from a group consisting of the following type 1 and type 2:

(Type 1) Compound which undergoes a one-electron oxidation so as to form a one-electron oxidation product capable of, through subsequent bond cleavage reaction, releasing one or more electrons, (Type 2) Compound which undergoes a one-electron oxidation so as to form a one-electron oxidation product capable of, after subsequent bond formation reaction, releasing one or more electrons.

16 Claims, No Drawings

SILVER HALIDE COLOR PHOTOSENSITIVE MATERIAL

CROSS-REFERENCE TO RELATED APPLICATIONS

This application is based upon and claims the benefit of priority from prior Japanese Patent Applications No. 2003-376147, filed Nov. 5, 2003, No. 2003-378945, filed Nov. 7, 2003, No. 2004-003673, filed Jan. 9, 2004; and No. 2004-022642, filed Jan. 30, 2004, the entire contents of all of which are incorporated herein by reference.

BACKGROUND OF THE PRESENT INVENTION

1. Field of the Invention

The present invention relates to a silver halide color photosensitive material with high sensitivity and excellent in preservation stability in the lapse of time, pressure property, grain size and radial rays resistance.

2. Description of the Related Art

As one of the high sensitization technologies of a silver halide photograph photosensitive material, the use of compounds called as "a one photon and two electrons type sensitizer" has been known, and such compounds are disclosed in, for example, the patent literatures 1 to 6. Further, as a technology by which higher sensitization than the use of "a one photon and two electrons type sensitizer" is obtained, compounds called as "a sensitizer capable of discharging one photon and three electrons or more" have been known, and such compounds are disclosed in, for example, the patent literatures 7 to 10 and 15.

On the other hand, it is disclosed in the patent literatures 11 and 12 that a silver halide color photosensitive material with high sensitivity and having little fog fluctuation is obtained by containing "a sensitizer capable of discharging one photon and two electrons or more" and a specific magenta coloring coupler, or a specific surfactant or the like.

However, although the inventors have tried to obtain the high sensitization of a silver halide color photosensitive material by prior arts described in the above patent literatures, they found that the following problems occur. Namely, there is a problem that although a photosensitive material using the compounds of "a one photon and two electrons type sensitizer" or the compounds of "a sensitizer capable of discharging one photon and three electrons or more" obtains the high sensitization just after coating, the high sensitization is greatly reduced in the lapse of time when the photosensitive material is preserved under a high temperature and high humidity for a short period or a long period. Further, pressure property which can be satisfied as photograph performance has also been not obtained.

A technical content prescribing "one photon and two electrons type sensitization by an electron donating compound (FED) which can be fragmented" and a sensitizing dye species is described in the patent literature 13. The technical content in the patent literature is that the lowering of blue sensitivity caused by combination with a blue dye with a longer wavelength is prevented by use in combination with the FED compound for faithful color reproducibility. However, the effect of the pressure property at using the sensitizing dye species in combination with FED is not disclosed, and satisfactory performance has been not obtained with respect to the pressure property by use of FED in combination with the blue dye which was disclosed.

By the way, an "earth-friendly" product has been strongly required in the industrial world from the viewpoint of environmental problem recently. Consequently, the industrial world is concentrated in preparation of the "earth-friendly" product day and night from the viewpoints of resource saving and energy saving. A photosensitive material having the coating amount of silver as little as possible is desired from the viewpoint of resource saving also in the business world of the silver halide photograph photosensitive material.

The development of the silver halide photograph photosensitive material having the coating amount of silver as little as possible has been already carried out by many approaches, and their technical contents are described in, for example, the patent literatures 14 and 15. In particular, it is disclosed in the patent literature 14 that radial rays resistance is improved by using a high sensitive silver halide emulsion having ISO speed of 800 or more at the coating amount of silver of 9.0 $g/m^2$ or less and 3.0 $g/m^2$ or more. However, the disclosure of lowering the content of silver and an effect of improving the radial rays resistance at that time using the high sensitization by "a compound capable of discharging one photon and two electrons to three electrons or more" as the original material are not described in these literatures.

On the other hand, a problem has been cleared that the higher the sensitivity is improved, the greater the deterioration of photograph performance due to long-term storage is. In particular, it has been a great problem in a negative color photosensitive material having the ISO speed of 400 or more. The cause of the deterioration of photograph performance due to long-term storage is a cause by natural radial rays (environmental radial rays and cosmetic rays) in addition to heat and humidity which have been well known, and a photosensitive material exposed to natural radial rays causes the increase of fog density and the deterioration of grain property in accordance with the increase. As a measure for deterioration of photograph performance by natural radial rays, a method of reducing the coating amount of silver (the above patent literature 14), a method of reducing the content of potassium in a photosensitive material (the patent literature 16) and the like have been known. As the method of reducing the radial rays fog, a method of adding a methylocyan dye (the patent literature 17), and a method using a compound other than gold chloride as a gold sensitizer (the patent literature 18), and a method of forming development initiation points on the same plane (the patent literature 19) are disclosed in addition to those literatures. However, these refer to only technologies for improving the sensitivity lowering and fog enhancement by radial rays, but do not clearly refer to a method of improving the grain size that deteriorates by radial rays. The disclosure of lowering the content of silver and an effect of improving the radial rays resistance at that time using the high sensitization by "a compound capable of discharging one photon and two electrons to three electrons or more" as the original material are not described in these literatures.

At all events, since the total coating amount of silver of the photosensitive silver halide is 6.0 $g/m^2$ or less in terms of metal silver in the negative color photosensitive material having ISO speed of 400 or more, it has been difficult to realize a silver halide photosensitive material excellent in grain size and radial rays resistance.

Patent literature 1: U.S. Pat. No. 5,747,235

Patent literature 2: U.S. Pat. No. 5,747,236

Patent literature 3: EP 786692A1 (Compounds INV 1-35)

Patent literature 4: EP 893732A1

Patent literature 5: U.S. Pat. No. 6,054,260

Patent literature 6: U.S. Pat. No. 5,994,051

Patent literature 7: Jpn. Pat. Appln. KOKAI Publication No. (hereinafter referred to as JP-A-) 2003-114487

Patent literature 8: JP-A-2003-114488

Patent literature 9: JP-A-2003-114486

Patent literature 10: JP-A-2003-140287

Patent literature 11: JP-A-2003-149776

Patent literature 12: JP-A-2003-149774

Patent literature 13: JP-A-2000-221628

Patent literature 14: Jpn. Pat. Appln. KOKOKU Publication No. (hereinafter referred to as JP-B-) 6-70710

Patent literature 15: U.S. Pat. No. 6,689,554

Patent literature 16: JP-A-2-836

Patent literature 17: JP-A-2-190851

Patent literature 18: JP-A-4-67032

Patent literature 19: JP-A-5-216246

BRIEF SUMMARY OF THE INVENTION

An object of the present invention is to provide a silver halide color photosensitive material with high sensitivity and excellent in preservation stability for a long period (the lowering of sensitivity is little when it is preserved for a long period under a high humidity).

Further, another object of the present invention is to provide a silver halide color photosensitive material with high sensitivity and excellent in preservation stability for a short period (the lowering of sensitivity is little when it is preserved for a short period under a high temperature and high humidity).

Furthermore, another object of the present invention is to provide a silver halide color photosensitive material with high sensitivity and excellent in pressure property.

Moreover, another object of the present invention is to provide a silver halide color photosensitive material with high sensitivity of ISO speed of 400 or more and excellent in grain size and radial rays resistance even with the low content of silver.

The present inventors have studied intensively for achieving the objects of the present invention, and as a result, it has been found that the objects can be attained by the following procedures.

(1) A silver halide color photosensitive material comprising a coupler represented by the following general formula (A) and at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons; General formula (A):

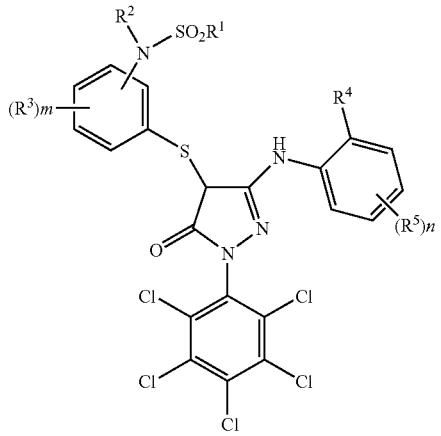

wherein $R^1$ represents an alkyl group, an aryl group, or a hetero cyclic group; $R^2$ represents a hydrogen atom or a substituent; $R^3$ represents a substituent; $R^4$ represents a halogen atom or an alkoxy group, $R^5$ represents an acylamino group, a sulfoneamido group, an imido group, a carbamoyl group, a sulfamoyl group, an alkoxycarbonyl group, an alkoxycarbonylamino group, or an alkoxy group; and each of m and n represents independently an integer of 0 to 4.

(2) A silver halide color photosensitive material comprising a coupler represented by the following general formula (B) and at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

General Formula (B):

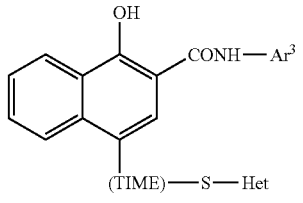

wherein $Ar^3$ represents an aryl group; Het represents an aromatic heterocyclic group having not more than 3 nitrogen atoms in a ring; and TIME is a timing group which does not comprise a nitrogen-containing aromatic hetero ring as a compositional element.

(3) A silver halide color photosensitive material comprising at least one high-boiling organic solvent represented by the following structural formula (S) or (P) and at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

Formula (S):

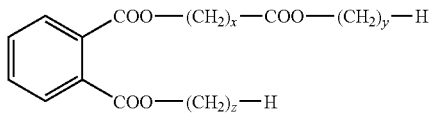

wherein each of x, y and z represents independently an integer of 1 to 6;

Formula (P):

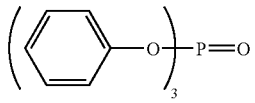

(4) A silver halide color photosensitive material comprising at least one surfactant represented by the following general formula (Q) and at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

General Formula (Q):

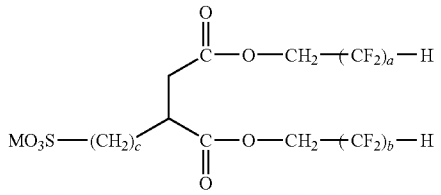

wherein M represents an alkali metal; each of a and b represents independently an integer of 4 to 8; and c represents 0 or 1.

(5) The silver halide color photosensitive material according to item (4) above, wherein the surfactant represented by the above general formula (Q) is the following compound (FT-0):

(FT-0)

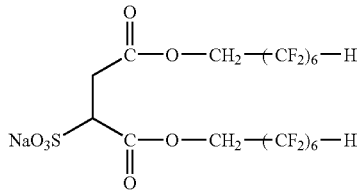

(6) A silver halide color photosensitive material comprising on a support at least one layer of silver S halide photographic emulsion layers containing a silver halide emulsion containing a methine compound represented by the general formula (I) on the surface of silver halide particles, the silver halide color photosensitive material comprising at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

General Formula (I):

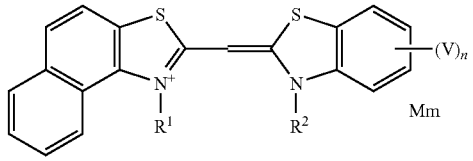

wherein V represents a monovalent substituent in which the σp value of Hammett substituent constant is −0.05 or less; n represents 1, 2, 3 and 4; M represents a charge balancing counter ion; m represents a number required for balancing charge; $R^1$ and $R^2$ represent a substituted or unsubstituted alkyl group, but at least either of $R^1$ and $R^2$ is a substituted alkyl group represented by the following formula:

-(Q)u-X wherein Q represents a methylene group which may optionally have a substituent; X represents $SO_3^-$, $CO_2^-$ or $PO_3^{2-}$; and u represents an integer of 1 or more.

(7) The silver halide color photosensitive material according to item (6) above, wherein the substituent defined by V of the methine compound represented by the general formula (I) is a methoxy group.

(8) A silver halide color photosensitive material having on a support at least one blue-sensitive silver halide emulsion layer, at least one green-sensitive silver halide emulsion layer and at least one red-sensitive silver halide emulsion layer, wherein the total coating amount of silver of the photosensitive silver halide is 6.0 g/m$^2$ or less in terms of metal silver, and the photosensitivity is the ISO speed of 400 or more, the silver halide color photosensitive material further comprising at least one compound selected from a group consisting of the following type 1 and type 2.

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons.

(9) The silver halide color photosensitive material according to item (8) above, wherein the is blue-sensitive silver halide emulsion layer, the green-sensitive silver halide emulsion layer and the red-sensitive silver halide emulsion layer have respectively 2 layers or more of emulsion layers having different sensitivities, and the coating amount in total of silver of the photosensitive silver halide in the highest-speed blue-sensitive layer, the highest-speed green-sensitive layer and the highest-speed red-sensitive layer is 4.0 g/$m^2$ or less in terms of metal silver.

(10) The silver halide color photosensitive material according to item (8) or (9), wherein the total coating amount of silver of the photosensitive silver halide of the silver halide color photosensitive material is 4.5 g/$m^2$ or less in terms of metal silver.

(11) The silver halide color photosensitive material according to any one of items (1) to (10), wherein the compound selected from the group consisting of the type 1 and type 2 is a compound having at least one of an adsorptive group to silver halide or a partial structure of spectral sensitizing dye in the molecule.

DETAILED DESCRIPTION OF THE PRESENT INVENTION

The present invention will be described in detail below.

First, the compounds of type 1 and type 2 contained in the silver halide color photosensitive material of the present invention will be described.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769 (examples: compounds PMT-1 to S-37 listed in Tables E and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in Japanese Patent Application 2003-25886) and the general formula (9) (identical with the general formula (3) described in JP-A-2003-33446) among the compounds of inducing the reaction represented by the chemical reaction formula (1) (identical with the chemical reaction formula (1) described in Japanese Patent Application 2003-33446). Preferred ranges of these compounds are the same as described in the cited patent specifications.

General formula (1)

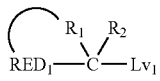

General formula (2)

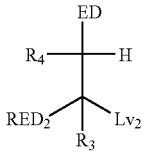

In the general formulae (1) and (2), each of $RED_1$ and $RED_2$ represents a reducing group. $R_1$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_2$, $R_3$ and $R_4$ represents a hydrogen atom or a substituent. Each of $L_{v1}$ and $L_{v2}$ represents a split off group. ED represents an electron donating group.

General formula (3)

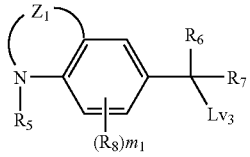

-continued

General formula (4)

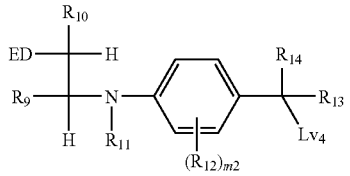

General formula (5)

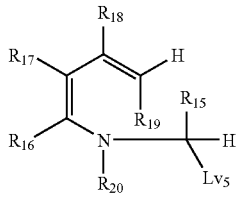

In the general formulae (3), (4) and (5), $Z_1$ represents an atomic group capable of forming a 6-membered ring in cooperation with a nitrogen atom and two carbon atoms of benzene ring. Each of $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ represents a hydrogen atom or a substituent. $R_{20}$ represents a hydrogen atom or a substituent, provided that when $R_{20}$ represents a non-aryl group, $R_{16}$ and $R_{17}$ are bonded to each other to thereby form an aromatic ring or aromatic heterocycle. Each of $R_8$ and $R_{12}$ represents a substituent capable of substitution on benzene ring. $m_1$ is an integer of 0 to 3. $m_2$ is an integer of 0 to 4. Each of $L_{v3}$, $L_{v4}$ and $L_{v5}$ represents a split off group.

General formula (6)

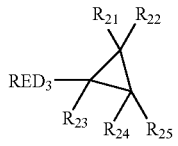

General formula (7)

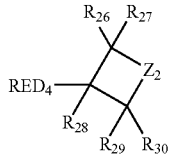

In the general formulae (6) and (7), each of $RED_3$ and $RED_4$ represents a reducing group. Each of $R_{21}$ to $R_{30}$ represents a hydrogen atom or a substituent. $Z_2$ represents —$CR_{111}R_{112}$—, —$NR_{113}$— or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

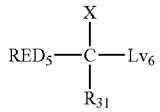

In the general formula (8), $RED_5$ is a reducing group, representing an arylamino group or a heterocyclic amino group. $R_{31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

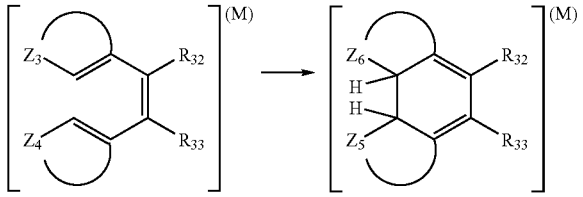

General formula (9)

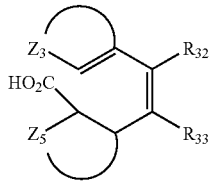

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. M represents a radical, a radical cation or a cation. In the general formula (9), $R_{32}$, $R_{33}$ and $Z_3$ have the same meaning as in the chemical reaction formula (1). Each of $Z_5$ and $Z_6$ represents a group capable of forming a 5- or 6-membered cycloaliphatic hydrocarbon group or heterocyclic ring in cooperation with C—C.

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in Japanese Patent Application 2003-33446) capable of inducing the reaction represented by the chemical reaction formula (1) (identical with the chemical reaction formula (1) described in Japanese Patent Application 2003-33446). Preferred ranges of these compounds are the same as described in the cited patent specifications.

$RED_6$-Q-Y General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

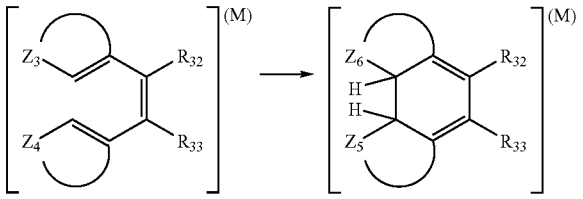

General formula (11)

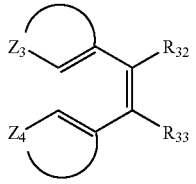

The compound represented by the general formula (11) is one oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (11), $R_{32}$, $R_{33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl)ammonio) or a group containing a nitrogenous heterocyclic group containing a quaternarized nitrogen atom. As the quaternary salt structure of phosphorus, there can be mentioned, a phosphonio group (such as trialkylphosphonio, dialkylaryl(heteroaryl)phosphonio, alkyldiaryl(heteroaryl)phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, aperchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, preferred structures can be represented by the general formula (X).

$$(P\text{-}Q_1\text{-})_i\text{—}R(\text{-}Q_2\text{-}S)_j \qquad \text{General formula (X)}$$

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(═O)—, —$SO_2$—, —SO— and —P(═O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of 10 to 100, more preferably 10 to 70, still more preferably 11 to 60, and most preferably 12 to 50.

Specific examples of the compounds of type 1 and type 2 will be shown below, which however naturally in no way limit the scope of the invention.

1
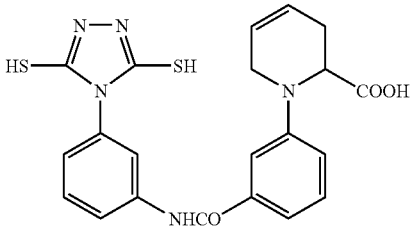
2
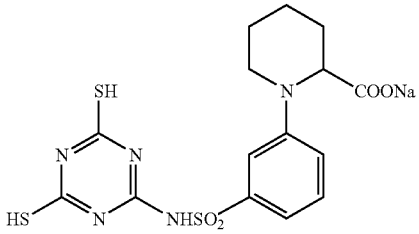
3
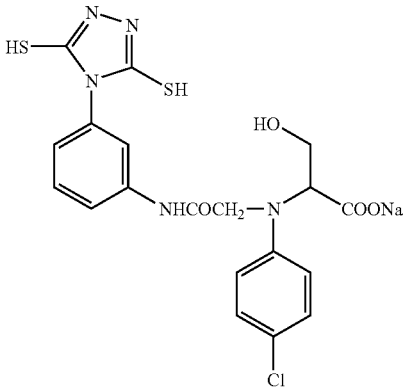
4
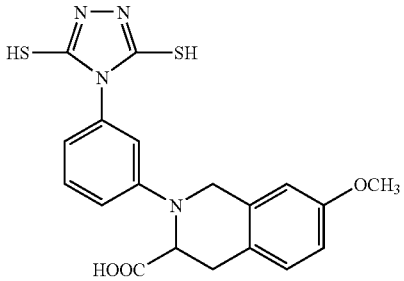
5
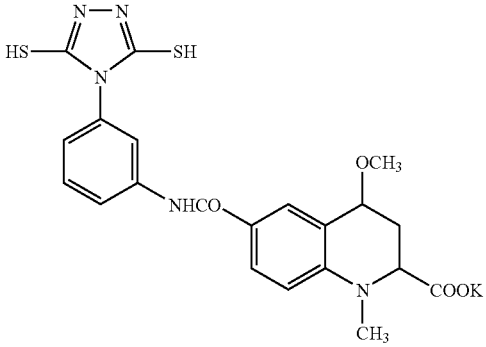
6
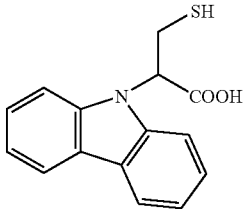
7
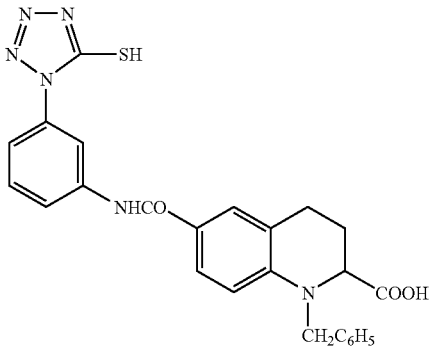
8
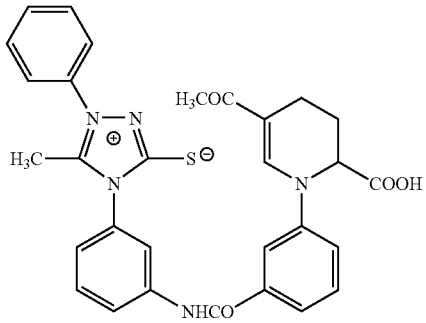

-continued
9
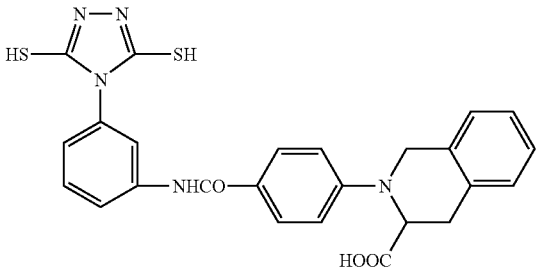
10
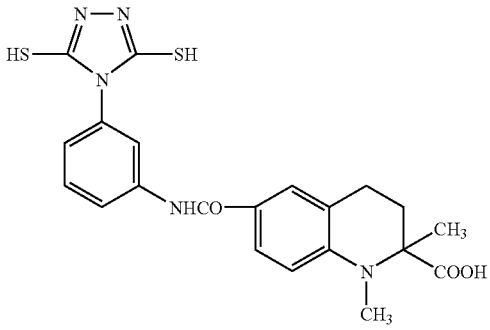
11
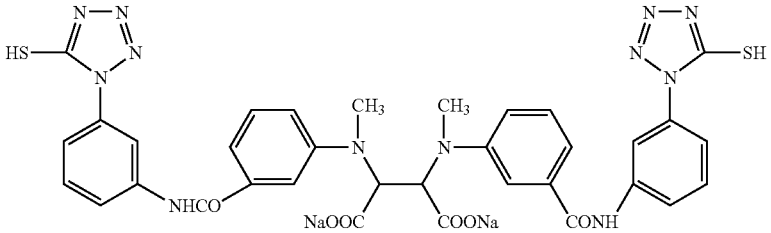
12
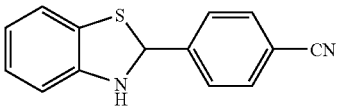
13
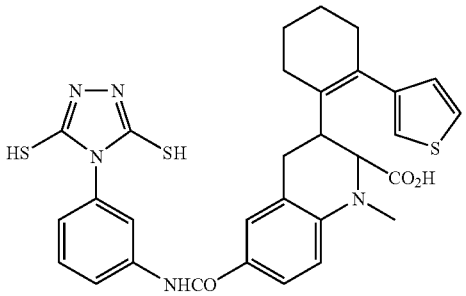
14
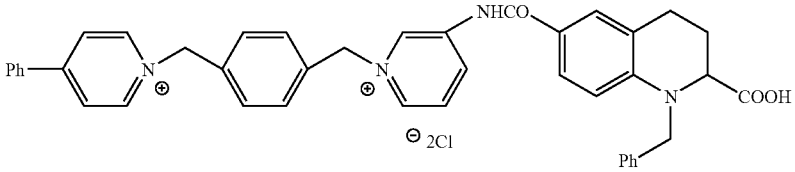
15
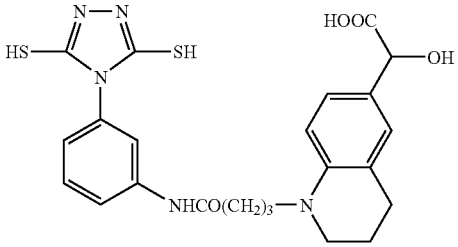
16
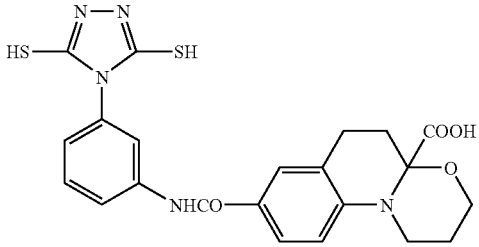

-continued
17
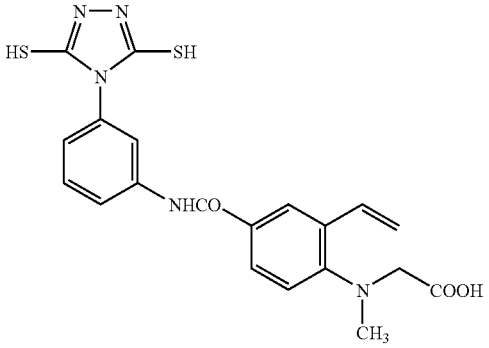
18
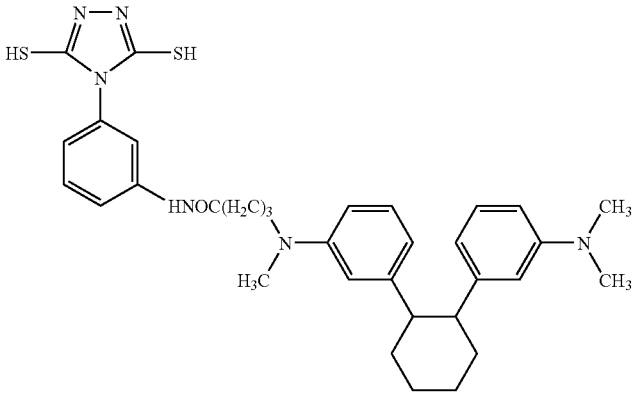
19
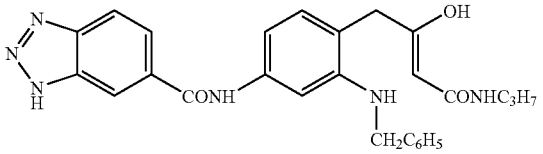
20
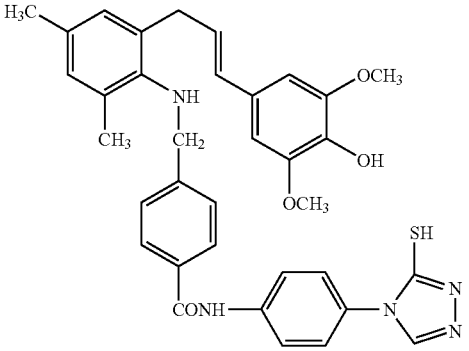
21
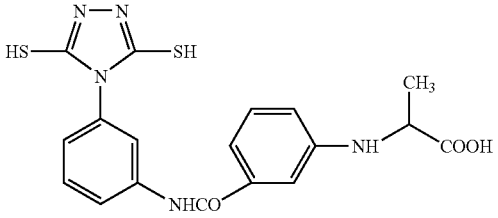
22
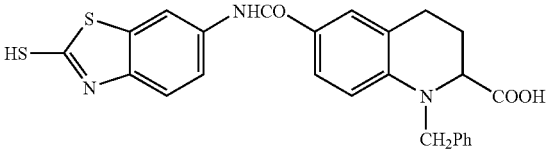

-continued
23
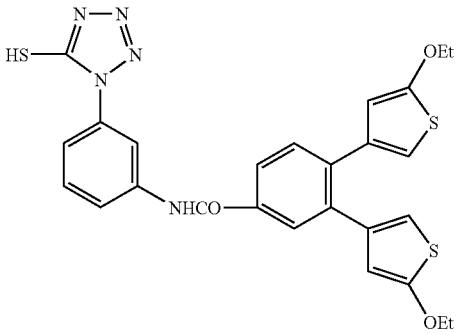
24
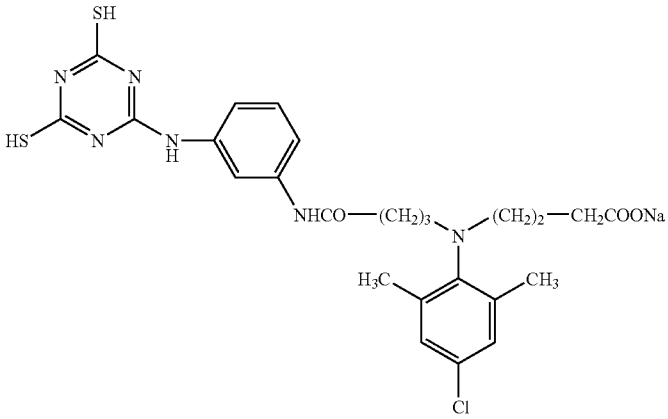
25
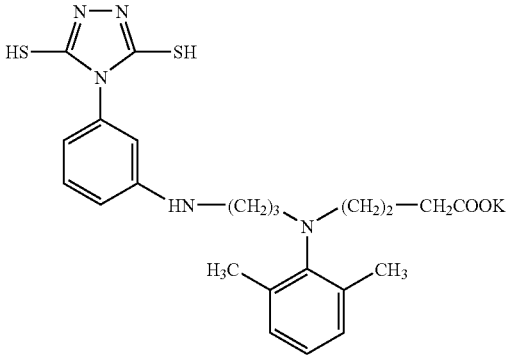
26
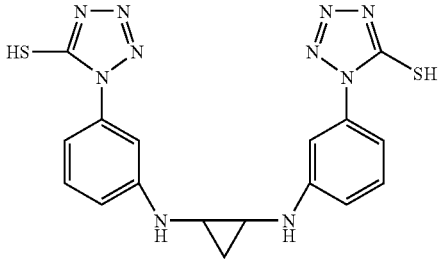
27
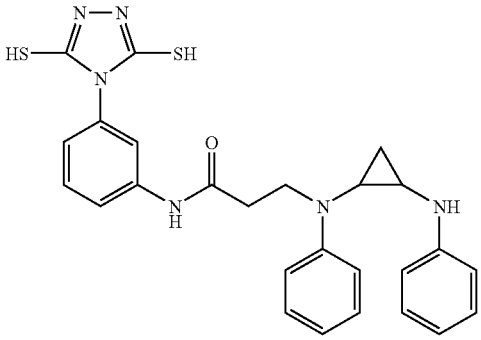
28
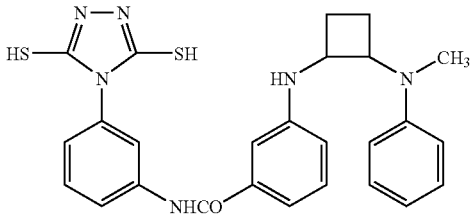

-continued
29
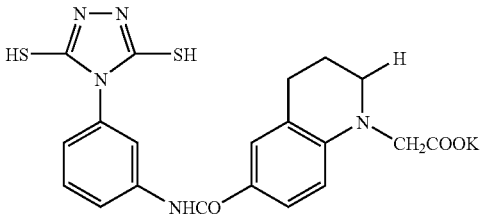
30
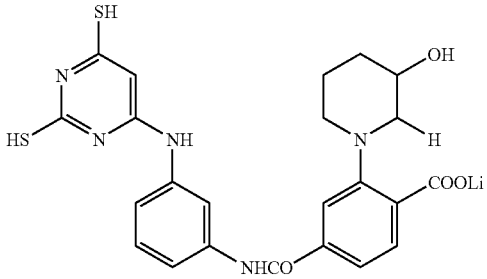
31
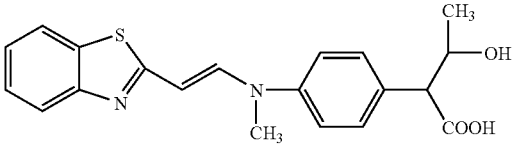
32
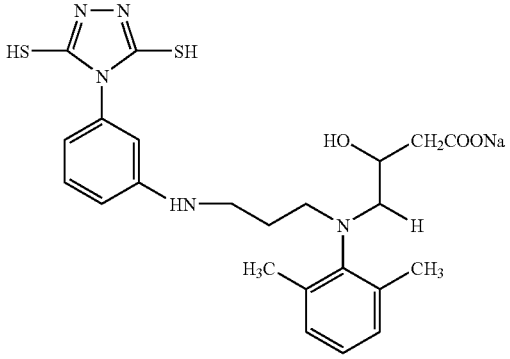
33
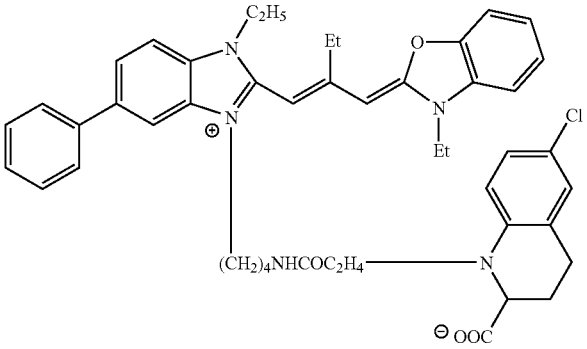
34
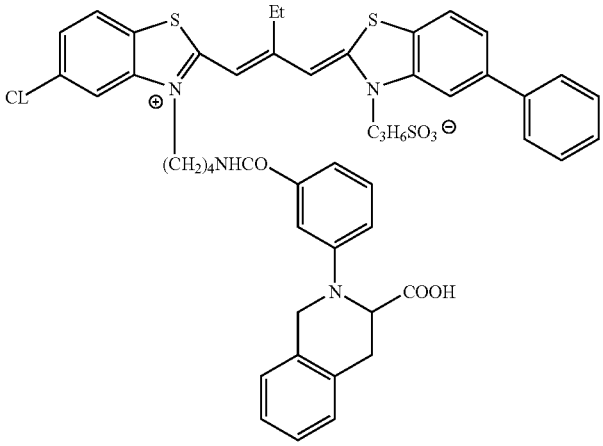
35
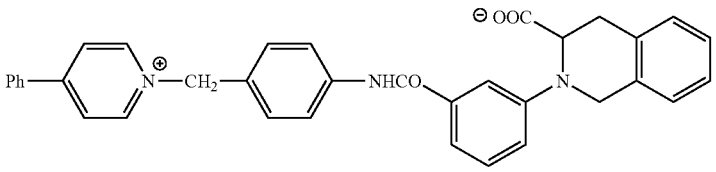

-continued
36
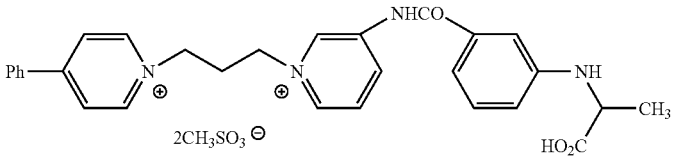
37
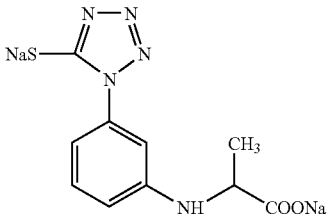
38
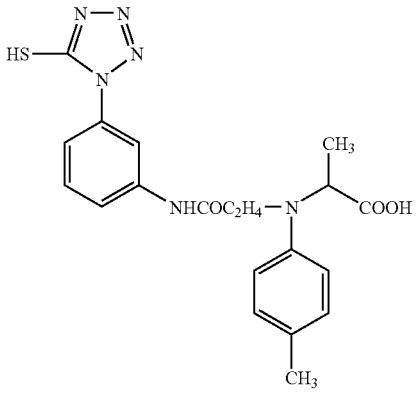
39
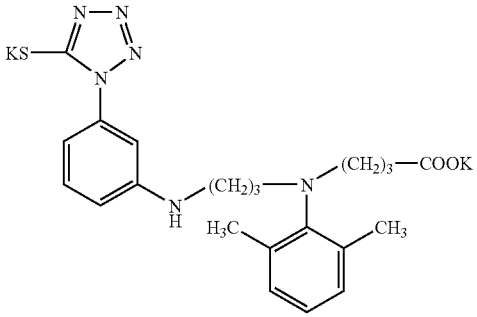
40
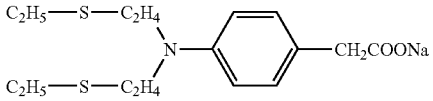
41
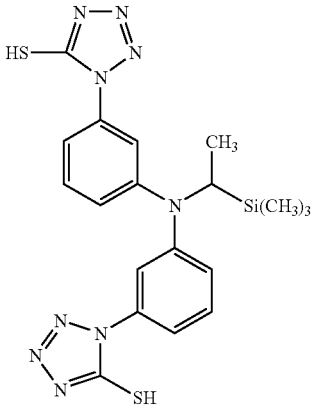
42
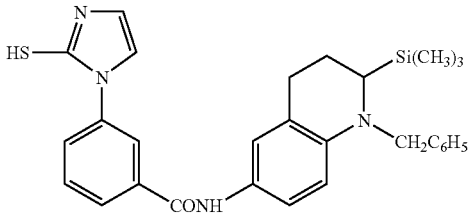

-continued
43
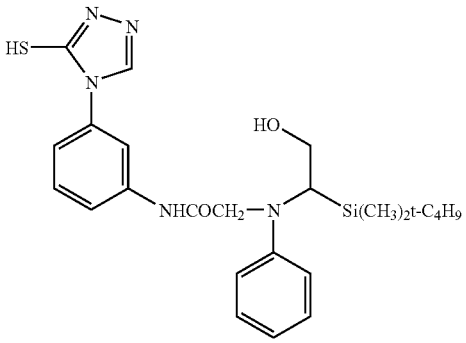
44
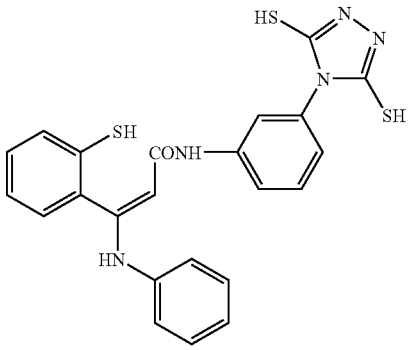
45
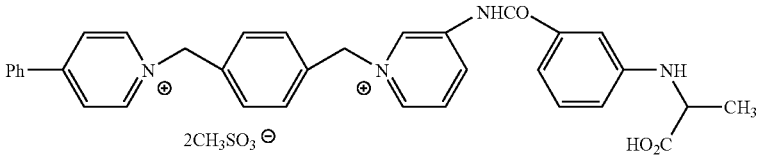
46
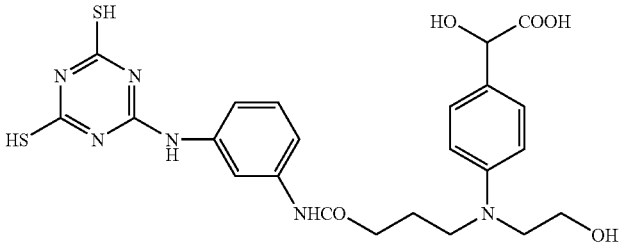
47
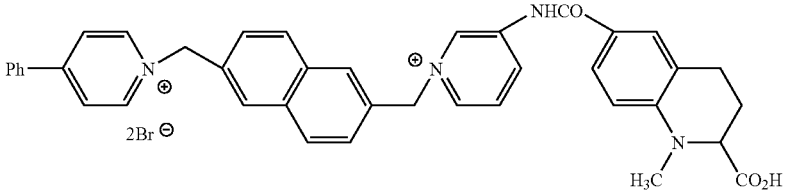
T-1
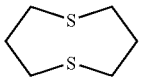
T-2
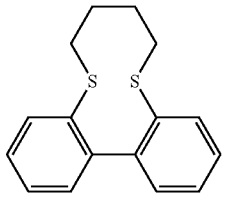
T-3
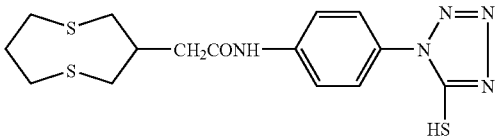
T-4
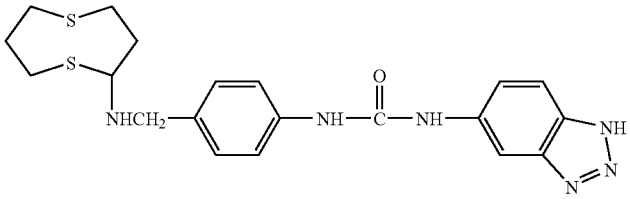

-continued
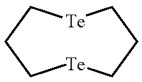
T-5
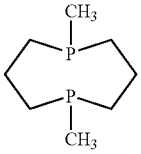
T-6
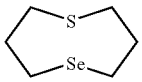
T-7
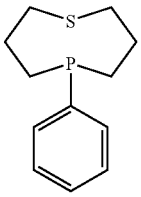
T-8
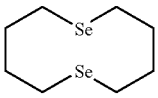
T-9
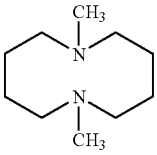
T-10
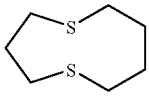
T-11
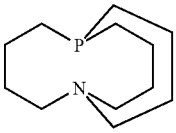
T-12
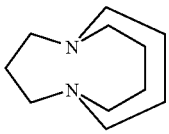
T-13
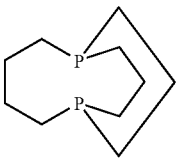
T-14
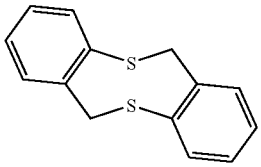
T-15
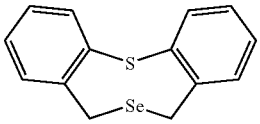
T-16
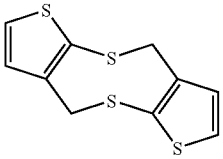
T-17
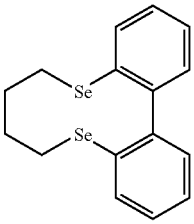
T-18
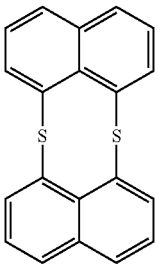
T-19
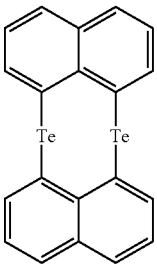
T-20

-continued
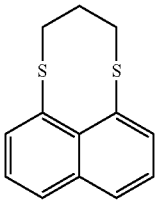
T-21
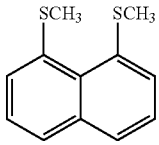
T-22
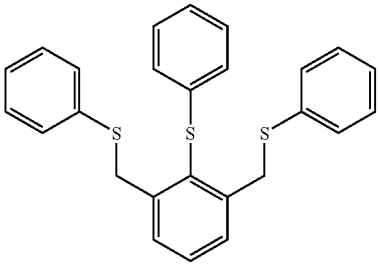
T-23
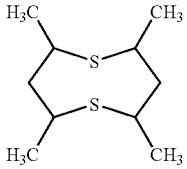
T-24
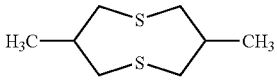
T-25
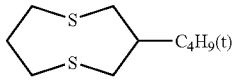
T-26
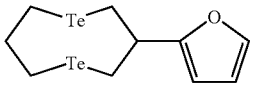
T-27
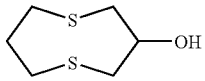
T-28
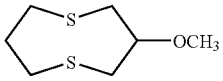
T-29
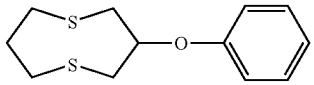
T-30
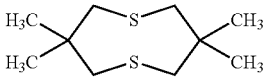
T-31
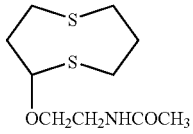
T-32
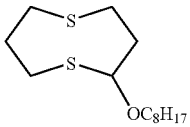
T-33
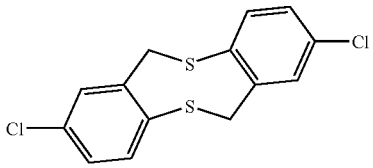
T-34
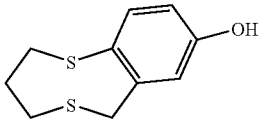
T-35
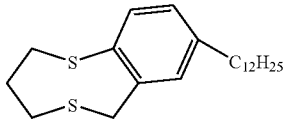
T-36
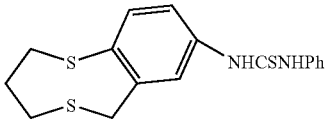
T-37
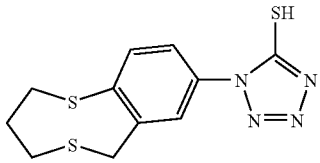
T-38
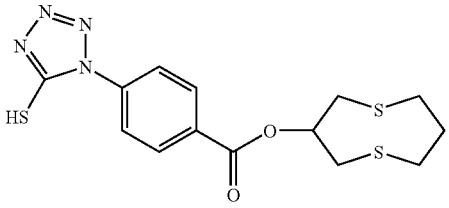
T-39
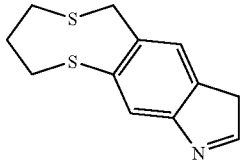
T-40

-continued

T-41

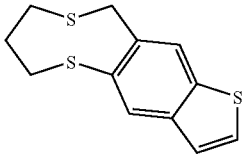

T-42

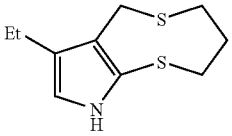

T-43

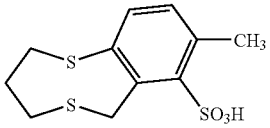

T-44

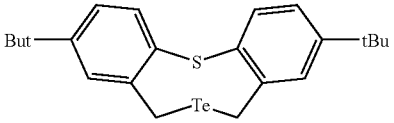

T-45

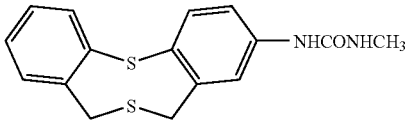

T-46

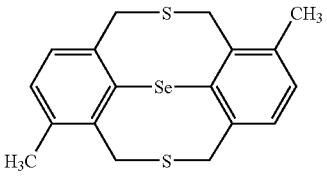

T-47

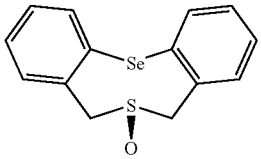

T-48

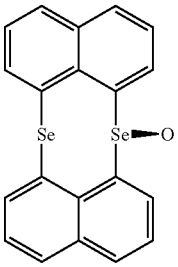

T-49

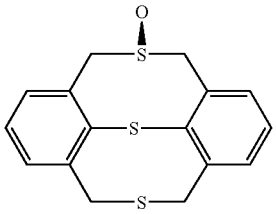

T-50

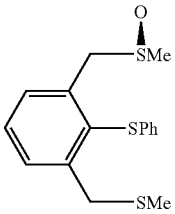

T-51

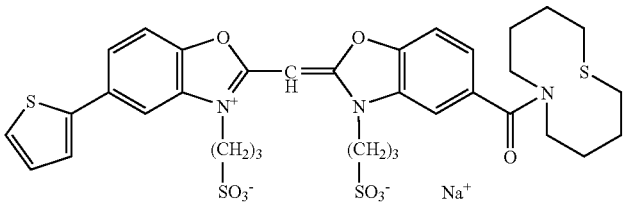

T-52

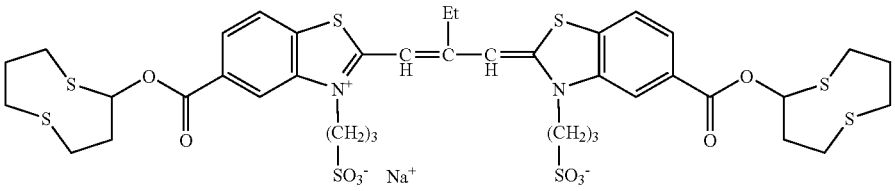

The compounds of type 1 and type 2 according to the present invention may be added at any stage during the emulsion preparation or photosensitive material production. For example, the addition may be effected at grain formation, desalting, chemical sensitization or coating. The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

One of preferable aspects of the present invention is a silver halide color photosensitive material having on a support at least one layer of silver halide emulsion layers simultaneously containing a compound selected from the above (type 1) and (type 2) and a coupler represented by the following general formula (A) and/or (B).

General Formula (A):

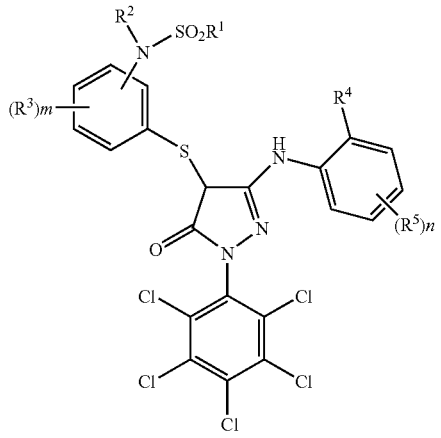

In the general formula (A), $R^1$ represents an alkyl group, an aryl group, or a hetero cyclic group; $R^2$ represents a hydrogen atom or a substituent; $R^3$ represents a substituent; $R^4$ represents a halogen atom or an alkoxy group; $R^5$ represents an acylamino group, a sulfonamide group, an imido group, a carbamoyl group, a sulfamoyl group, an alkoxycarbonyl group, an alkoxycarbonylamino group, or an alkoxy group; and each of m and n represents independently an integer of 0 to 4.

General Formula (B):

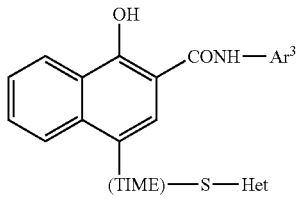

In the general formula (B), $Ar^3$ represents an aryl group; Het represents an aromatic heterocyclic group having not more than 3 nitrogen atoms in a ring; and TIME is a timing group which does not comprise a nitrogen-containing aromatic hetero ring as a compositional element.

The compound represented by the general formula (A) will be illustrated.

$R^1$ represents an alkyl group, an aryl group or a hetero cyclic group. These groups may optionally have a substituent. Examples of the substituent include a halogen atom, an alkyl group (an aralkyl group, a cycloalkyl group, an active methine group and the like are included), an alkenyl group, an alkynyl group, an aryl group, a heterocyclic group (a position substituted is not mentioned), a heterocyclic group containing a quaternary nitrogen atom (for example, a pyrimidinio group, an imidazolio group, a quinolinio group and an isoquinolinio group), an acyl group, an alkoxycarbonyl group, an aryloxycarbonyl group, a carbamoyl group, a carboxyl group or a salt thereof, a sulfonylcarbamoyl group, an acylcarbamoyl group, a sufamoylcarbamoyl group, a carbazoyl group, an oxalyl group, an oxamoyl group, a cyano group, a carbonimidoyl group, a thiocarbamoyl group, a hydroxy group, an alkoxy group (a group repeatedly containing an ethyleneoxy group or a propyleneoxy group unit is included), an aryloxy group, a heterocyclic oxy group, an acyloxy group (an (alkoxy or aryloxy)carbonyloxy group, a carbamoyloxy group, a sulfonyloxy group, an amino group, an (alkyl, aryl or heterocyclic) amino group, an acylamino group, a sulfonamido group, an ureido group, a thioureido group, an imido group, an (alkoxy or aryloxy)carbonylamino group, a sulfamoylamino group, a semicarbazido group, a thiosemicarbazido group, a hydrazino group, an ammonio group, an oxamoylamino group, an (alkyl or aryl)sufonylureido group, an acylureido group, an acylsulfamoylamino group, a nitro group, a mercapto group, an (alkyl, aryl or heterocyclic)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a group containing a phosphoric amide or phosphoric acid ester structure, and the like. These substituents may be further substituted with these substituents.

As $R^1$, an aryl group is preferably used. Examples thereof include a phenyl group, a naphthyl group and an anthryl group. As $R^1$, a phenyl group having a substituent is more preferable. As the preferable substituent, a halogen atom, an alkyl group, an aryl group, an alkenyl group, a heterocyclic group, an alkoxy group, an acylamino group, an acyl group, an alkoxycarbonyl group, a carbamoyl group, a sulfamoyl group and a cyano group are used. As the more preferable substituent, a halogen atom, an alkyl group, an aryl group, an alkoxy group, an aryloxy group, an alkylthio group, an arylthio group, an acylamino group, an alkoxycarbonyl group, a carbamoyl group and a sulfamoyl group are used. A halogen atom, an alkyl group, an aryl group, an acylamino group, a carbamoyl group and a sulfamoyl group are further preferably used. As the substituent of $R^1$, a halogen atom and an alkyl group are preferable in particular. When the substituent of $R^1$ is an alkyl group, a group having preferably 1 to 30 carbon atoms, more preferably 1 to 20 carbon atoms, and particularly preferably 1 to 10 carbon atoms is used.

$R^2$ represents a hydrogen atom or a substituent. As the substituent, a group selected from a group which is adopted as the substituent when $R^1$ of the general formula (A) is an alkyl group, an aryl group or a hetero cyclic group having a substituent is used. When $R^2$ is a substituent, an alkyl group, an aryl group, an alkenyl group, a heterocyclic group, an acylamino group, an acyl group, an alkoxycarbonyl group and a carbamoyl group are preferably used. An alkyl group, an aryl group and an alkenyl group are more preferably used. An alkyl group is preferably used in particular. When $R^2$ is a substituent, its total carbon number is 1 to 40, preferably 1 to 30, and particularly preferably 1 to 15. As $R^2$, an alkyl group having 1 to 15 carbon atoms is most preferably used.

$R^3$ represents a substituent. As the substituent, there is used a group selected from a group which is adopted as the substituent when $R^1$ of the general formula (A) is an alkyl group, an aryl group or a hetero cyclic group having a substituent. As $R^3$, a halogen atom, an alkyl group, an aryl group, an alkenyl group, a heterocyclic group, an acylamino group, an acyl group, an alkoxycarbonyl group, a carbamoyl group and a cyano group are preferably used. A halogen atom, an alkyl group, an aryl group, a carbamoyl group and a cyano group are more preferably used. A halogen atom and an alkyl group are particularly preferably used. When $R^3$ is a substituent containing a carbon atom, its total carbon number is 1 to 40, preferably 1 to 30, and particularly preferably 1 to 15. m represents an integer of 0 to 4. When m is an integer of 2 or more, $R^3$'s which exist in a plurality may be the same or different. m is preferably an integer of 0 to 2, more preferably 0 or 1, and particularly preferably 0.

The substitution position of $R^1SO_2N(—R^2)—$ on a benzene ring may be any place, but is preferably an ortho-position or a para-position of a sulfur atom, and an ortho-position is preferable in particular.

Examples of the halogen atom represented by $R^4$ include a chlorine atom, a bromine atom and a fluorine atom. Further, examples of the alkoxy group include a methoxy group and a dodecyl group. As $R^4$, a chlorine atom is preferable.

Examples of the acylamino group represented by $R^5$ include a benzoylamino group, a (mono or di)chlorobenzoylamino group, a 2,4-di-tert-pentylphenoxyacetoamido group, and a 4-(2,4-di-tert-pentylphenoxy)butaneamido group. As the sulfonamide group, for example, a 4-dodecyloxyphenylsulfoneamido group is mentioned. As the imido group, for example, an octadecenylsuccinimido group is mentioned. As the carbamoyl group, for example, a 4-(2,4-di-tert-pentylphenoxy)butylaminocarbonyl group is mentioned. As the sulfamoyl group, for example, a tetradecanesulfamoyl group is mentioned. As the alkoxycarbonyl group, for example, a tetradecaneoxycarbonyl group is mentioned. As the alkoxycarbonylamino group, for example, a dodecyloxycarbonylamino group is mentioned. As the alkoxy group, for example, a methoxy group, an ethoxy group and an octyloxy group are mentioned. $R^5$ is preferably an acylamino group, and particularly preferably a (mono or di)chlorobenzoylamino group. $R^5$ is preferably substituted at a para-position against $R^4$. Further, n is preferably 1.

Then, the compound represented by the general formula (B) will be illustrated.

$Ar^3$ represents an aryl group, and examples thereof include a phenyl group, a naphthyl group and an anthryl group. These groups may optionally have a substituent, and as the substituent, a group selected from a group which is adopted as the substituent when $R^1$ of the general formula (A) is an alkyl group, an aryl group or a hetero cyclic group having a substituent is used. When the substituent of $Ar^3$ is a group containing a carbon atom, its total carbon number is 1 to 50, preferably 1 to 40, more preferably 6 to 30, and particularly preferably 10 to 20. As $Ar^3$, a phenyl group having a substituent is preferably used. As the preferable substituent, a halogen atom, an alkyl group, an aryl group, an alkenyl group, a heterocyclic group, an alkoxy group, an aryloxy group, an alkylthio group, an arylthio group, an acylamino group, an acyl group, an alkoxycarbonyl group, a carbamoyl group, a sulfamoyl group, a cyano group and a carboxyl group are used. More preferably, a halogen atom, an alkyl group, an aryl group, an alkoxy group, an acylamino group, an alkoxycarbonyl group, a carbamoyl group and a sulfamoyl group are used. Further preferably, a halogen atom, an alkyl group and an alkoxy group are used. As the substituent of $Ar^3$, an alkoxy group is particularly preferably used.

Het represents an aromatic heterocyclic group having not more than 3 (including zero) nitrogen atoms in a ring, and may be a mono ring and a condensed ring structure. Examples thereof include a triazolyl group, a pyrazolyl group, an imidazolyl group, a pyrolyl group, an oxazolyl group, an isooxazolyl group, an oxadiazolyl group, a thiazolyl group, an isothiazolyl group, a thiadiazolyl group, a furyl group, a thienyl group, a pyridyl group, a pyrimidyl group, a pyrazyl group, a triazyl group, an indolyl group, an indazolyl group, a phthaladinyl group, a quinoxalinyl group, and a quinazolinyl group. Preferably, a 5-membered ring heterocyclic group is used, more preferably, a nitrogen-containing 5-membered aromatic hetero ring is used, further preferably, an oxadiazolyl group and a thiadiazolyl group are used, and particularly preferably, an oxadiazolyl group is used.

Het may optionally have a substituent, and as the substituent, a group selected from a group which is adopted as the substituent when $R^1$ of the general formula (A) is an alkyl group, an aryl group or a hetero cyclic group having a substituent is used. When the substituent of Het is a group containing a carbon atom, its total carbon number is 1 to 50, preferably 1 to 40, more preferably 1 to 20, and particularly preferably 1 to 10. As the preferable substituent, a-halogen atom, an alkyl group, an aryl group, an alkoxy group, an aryloxy group, an alkylthio group, an arylthio group, an alkoxycarbonyl group, a carbamoyl group, and a sulfamoyl group are used. More preferably, an alkyl group, an alkoxy group and an alkylthio group are used. Further preferably, an alkyl group is used. As the substituent, an alkyl group substituted with an alkoxycarbonyl group is particularly preferably used.

TIME represents a timing group which does not comprise a nitrogen-containing aromatic hetero ring as a compositional element, is discharged in a shape of $^-$(TIME)-S-Het at development processing, and is a group discharging $^-$S-Het thereafter. With respect to the timing group, there are descriptions in U.S. Pat. Nos. 4,146,396, 4,652,516, 4,698,297, 4,248,962, 4,847,485, 4,858,440, 4,409,323, 4,421,845, and 4,546,073, West German Patent Publication 3636317 and the like, but among groups described in them, a group which does not comprise a nitrogen containing aromatic hetero ring as a compositional element is effective in the present invention. TIME is bound with the naphthol skeleton of a compound represented by the general formula (B) in a hetero atom contained therein, preferably an oxygen atom, a sulfur atom or a nitrogen atom.

The preferable group as TIME is mentioned below. Hereat, * is a position bonded with a naphthol skeleton and ** is a position bonded with S-Het.

TIME-1

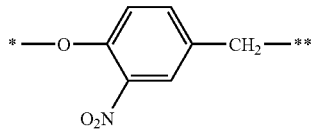

TIME-2

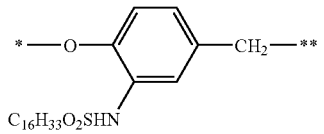

-continued
TIME-3
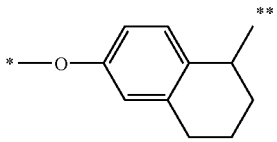
TIME-4
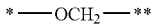
TIME-5
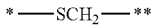
TIME-6
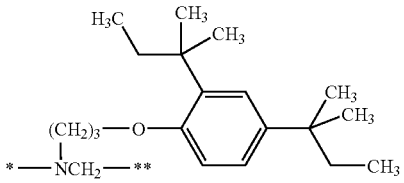
TIME-7
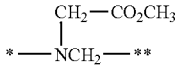
TIME-8
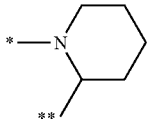
TIME-9
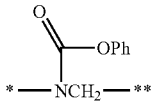
TIME-10
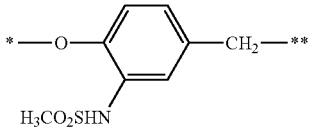
TIME-11
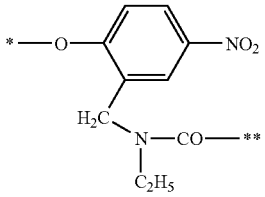
TIME-12
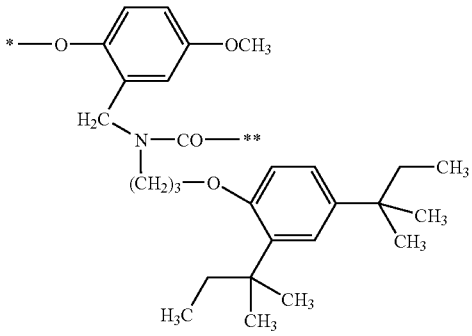
-continued
TIME-13
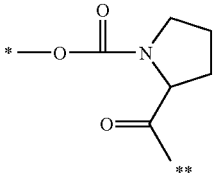
TIME-14
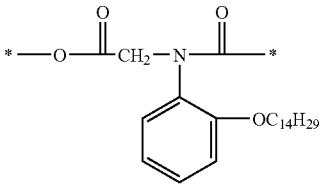
TIME-15
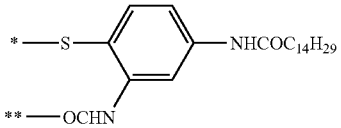
TIME-16
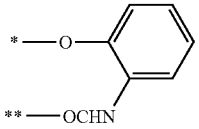
TIME-17
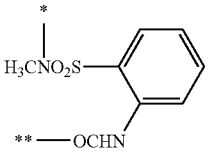
TIME-18
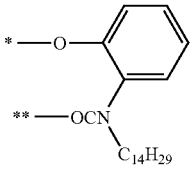
TIME-19
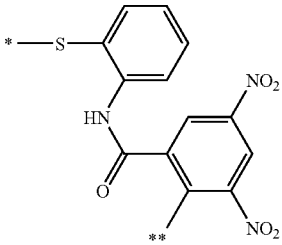
TIME-20
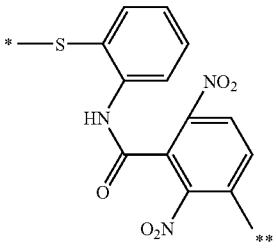

-continued

TIME-21

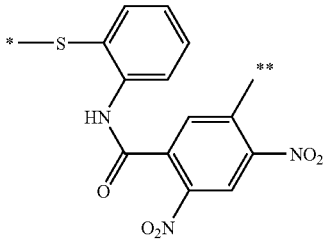

TIME-22

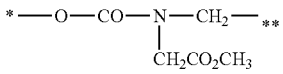

TIME-23

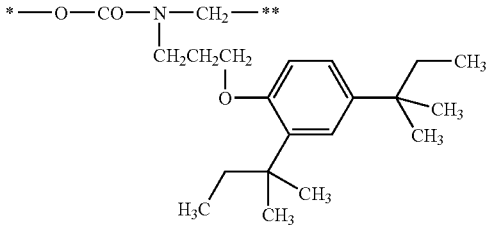

TIME-24

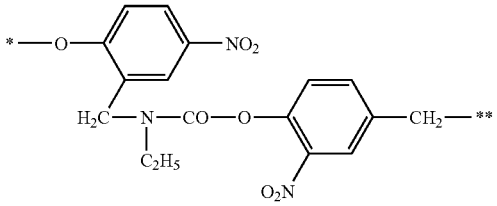

TIME-25

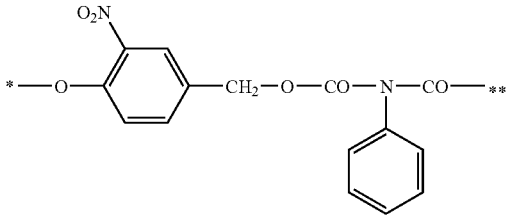

TIME-26

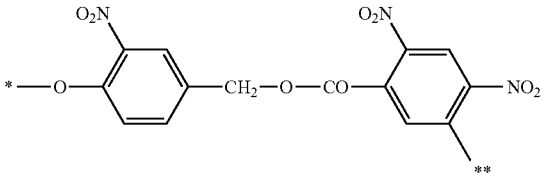

TIME-27

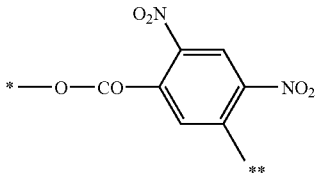

-continued

TIME-28

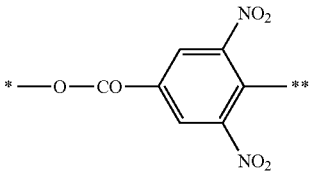

TIME-29

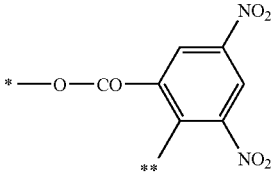

TIME-30

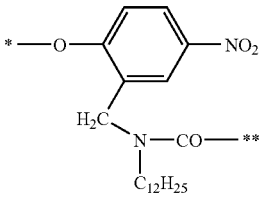

TIME-31

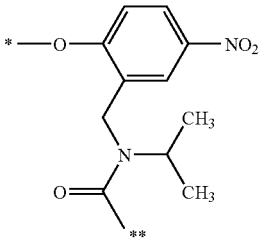

TIME-30

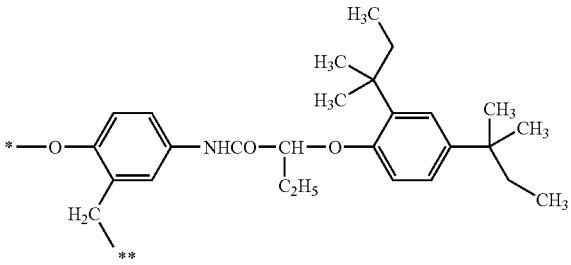

A group having a benzene ring as a composition element is preferably used as TIME. More preferably, a group having a nitro benzene skeleton as a composition element is used. Further preferably, the above-mentioned TIME-1, TIME-11, TIME-19, TIME-24, TIME-25, TIME-26, TIME-28 and TIME-30 are used, and particularly preferably, TIME-1 is used.

Specific examples of the compounds represented by the general formulae (A) and (B) are shown below, but not limited thereto.

A-1
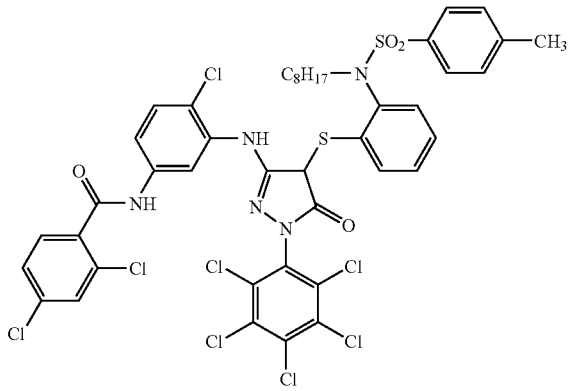
A-2
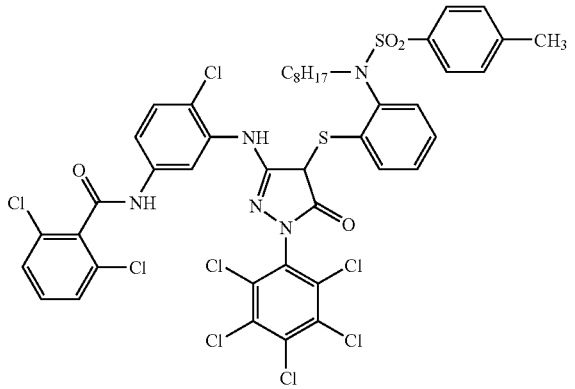
A-3
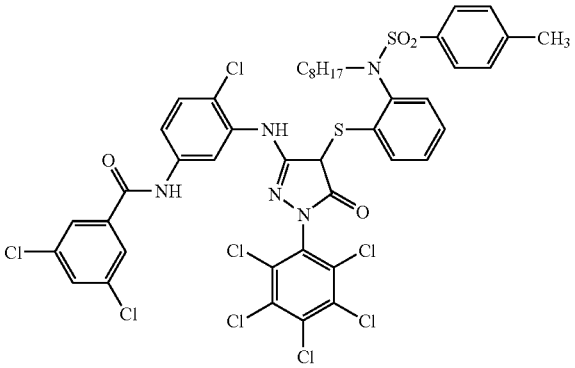
A-4
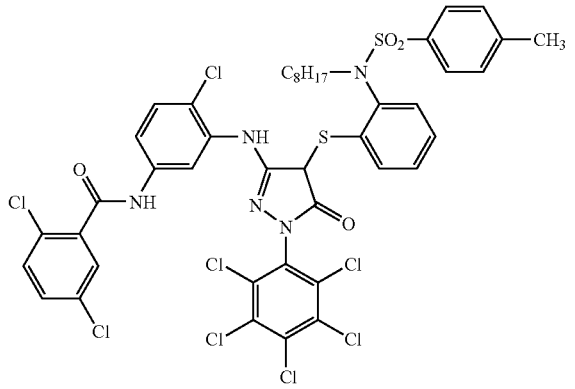
-continued
A-5
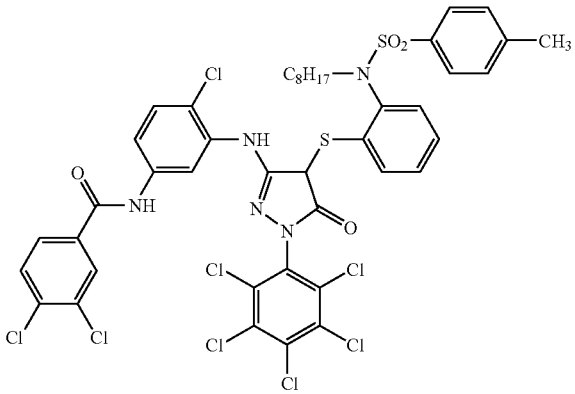
A-6
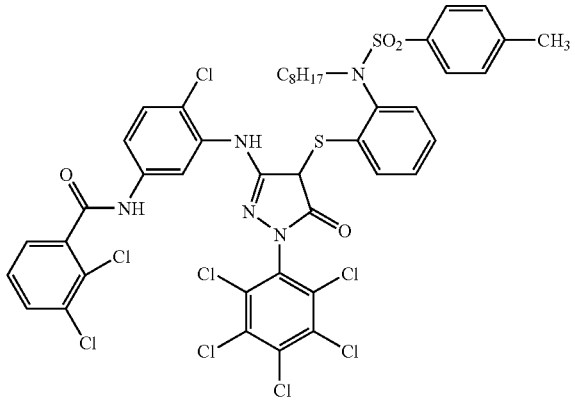
A-7
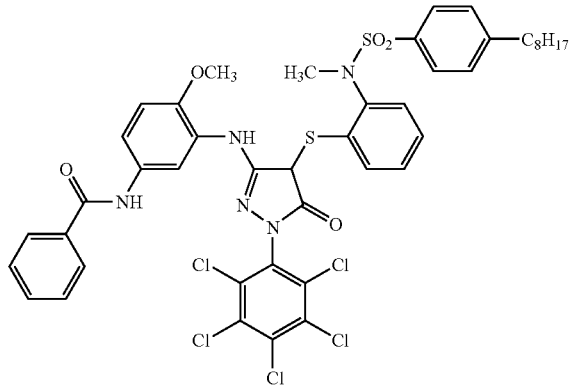

-continued
A-8
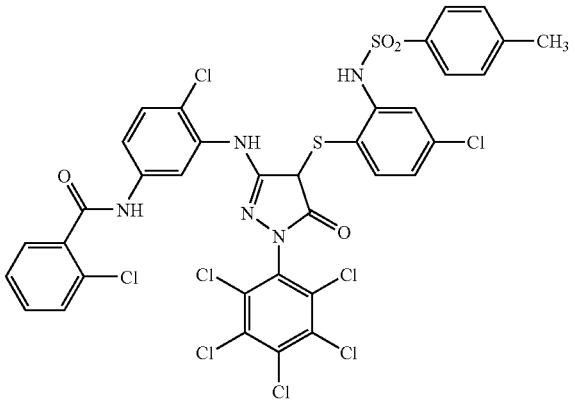
A-9
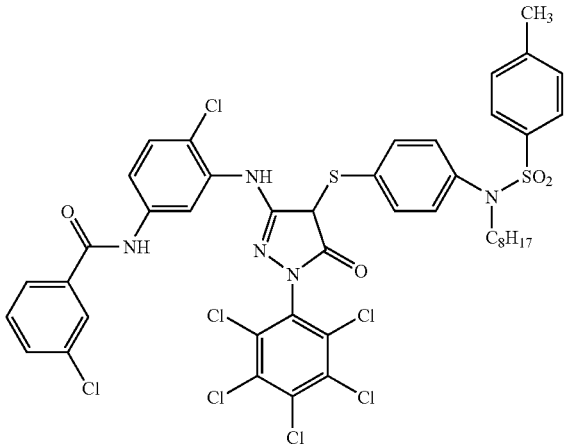
A-10
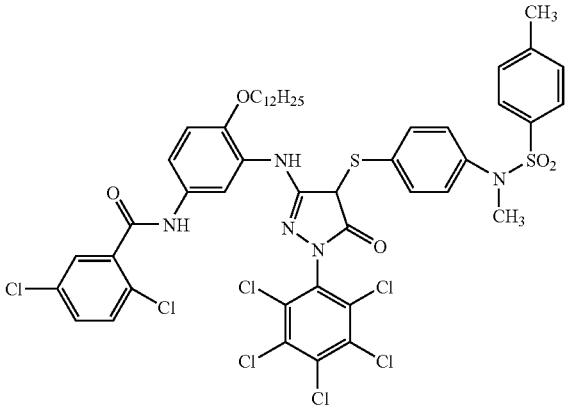
-continued
A-11
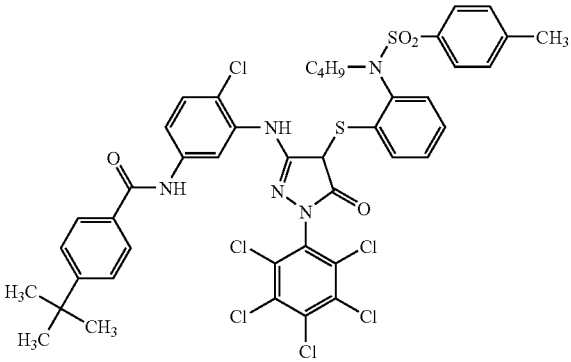
A-12
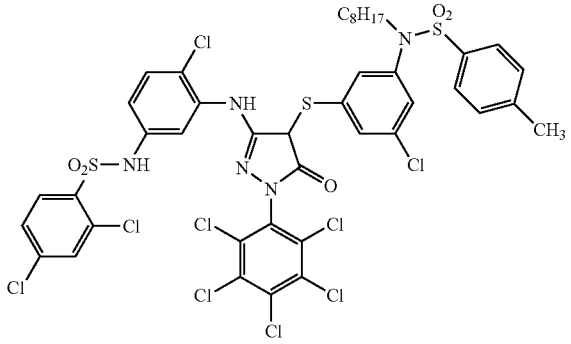
B-1
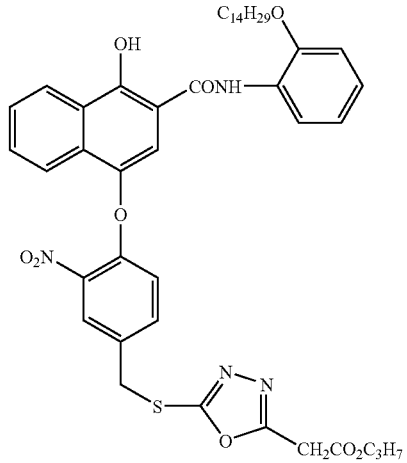
B-2
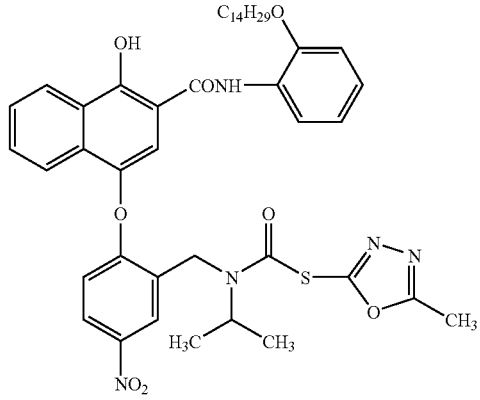

-continued
B-3
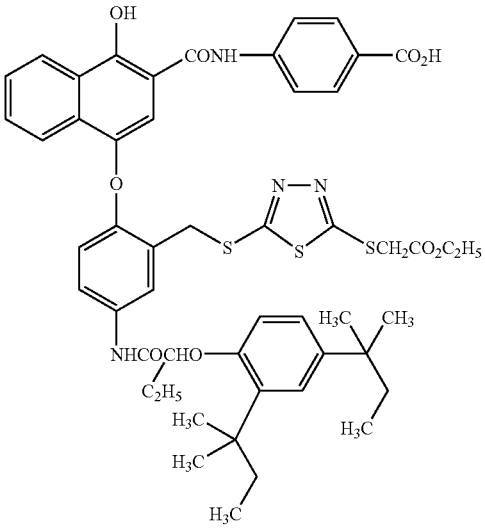
B-4
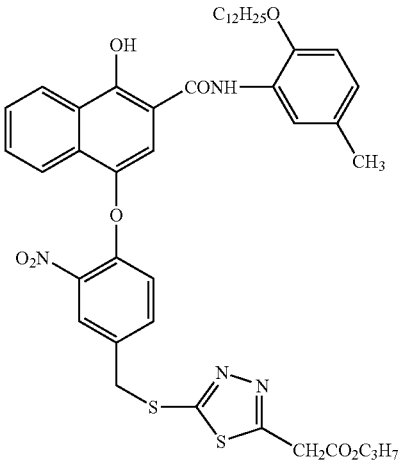
B-5
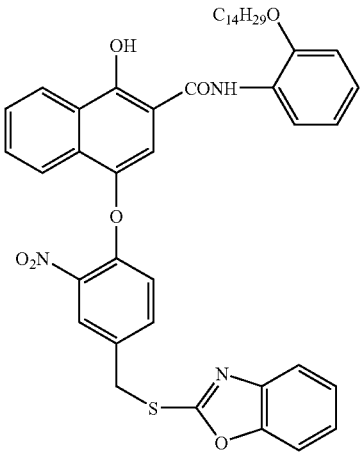
-continued
B-6
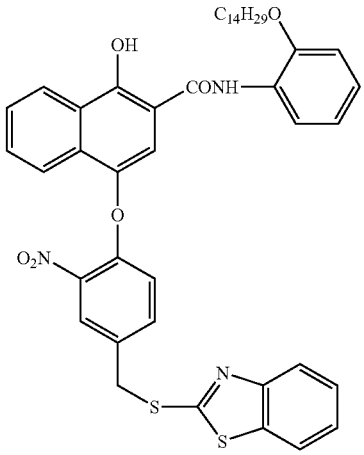
B-7
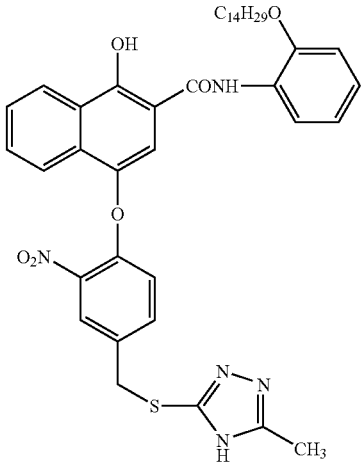
B-8
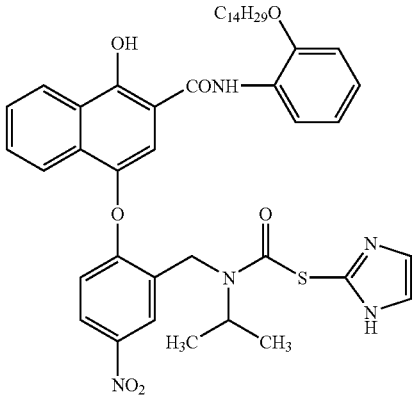

-continued

B-9

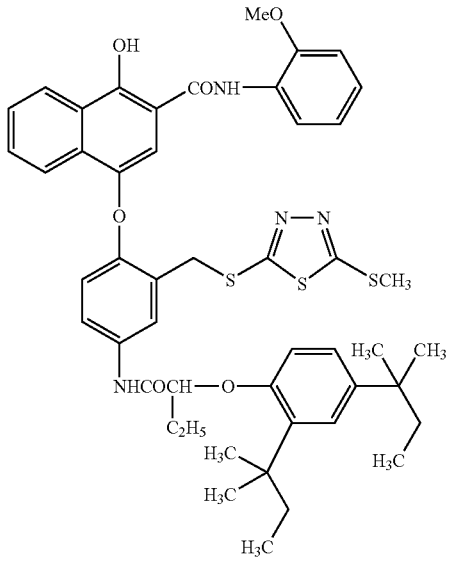

B-10

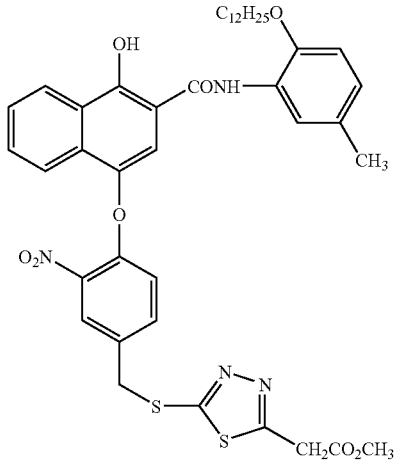

B-11

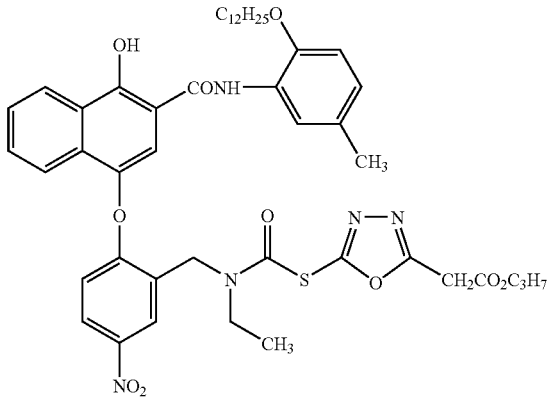

-continued

B-12

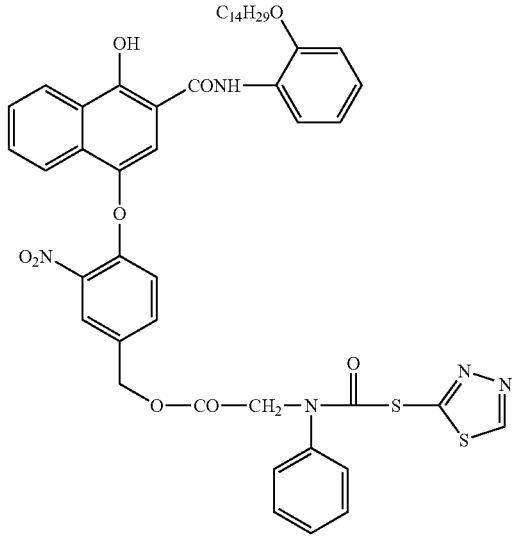

The synthesis of the compounds represented by the general formulae (A) and (B) can be carried out referring to JP-A-5-150428, JP-A-62-34158, JP-A-63-37346, U.S. Pat. No. 4,782,012, JP-A-60-191241, EP 252376, the patent specification described in the illustration of the item of TIME, Research Disclosure Nos. 308119 and 17643, and the like.

The coupler represented by the general formula (A) or (B) of the invention is preferably used by being added in a silver halide emulsion layer, and preferably used by being added in a green-sensitive layer.

The addition amount of the coupler represented by the general formula (A) is preferably $1\times10^{-3}$ mol to 1 mol, and further preferably $1\times10^{-2}$ mol to 1 mol per 1 mole of silver halide in the silver halide emulsion layer.

The addition amount of the coupler represented by the general formula (B) is preferably $1\times10^{-4}$ mol to 0.1 mol per 1 mole of silver halide in the silver halide emulsion layer.

The coupler represented by the general formula (A) and the coupler represented by the general formula (B) of the invention can be used in combination. At this time, the addition layer may be the same layer or different layer.

Another aspect of the present invention is a silver halide color photosensitive material comprising on a support at least one layer of silver halide emulsion layers containing at least one compound selected from a group consisting of the above type 1 and type 2 and at least one high-boiling organic solvent selected from a high-boiling organic solvent represented by the following formula (S) and a high-boiling organic solvent represented by the following formula (P).

Another aspect of the present invention is a silver halide color photosensitive material comprising on a support at least one layer of silver halide emulsion layers containing at least one compound selected from a group consising of the above (type 1) and (type 2) and at least one surfactant represented by the following formula (Q).

Further, one of the preferable aspects is a silver halide color photosensitive material simultaneously containing at least one high-boiling organic solvent selected from a high-boiling organic solvent represented by the formula (S) and a high-boiling organic solvent represented by the formula (P) and at least one surfactant represented by the formula (Q).

The high-boiling organic solvent contained in the silver halide color photosensitive material of the present invention will be illustrated below.

The silver halide color photosensitive material of the present invention preferably contains at least one high-boiling organic solvent represented by the following formula (S) or formula (P), on a support.

Formula (S)

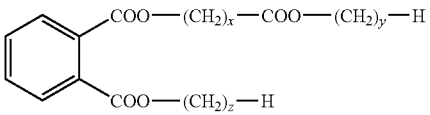

Formula (P)

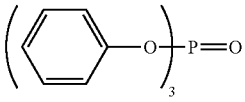

In the formula (S), each of x, y and z represents independently an integer of 1 to 6. Preferably, X is 1 or 2, y is 1 to 3, and z is 1 to 3, respectively. More preferably, X is 1, y is 2, and z is 2. Specific examples of the compound of the formula (S) are exemplified below.

S-1

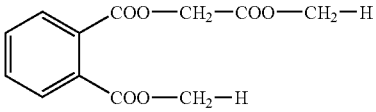

S-2

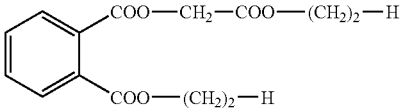

S-3

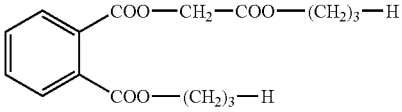

S-4

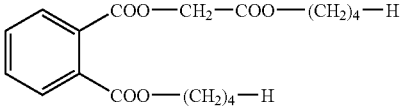

S-5

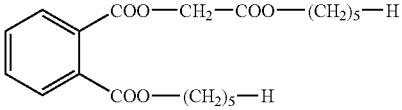

S-6

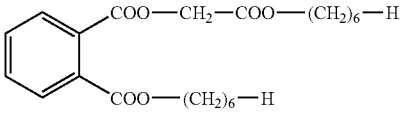

S-7

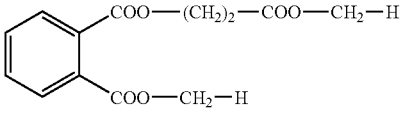

-continued

S-8

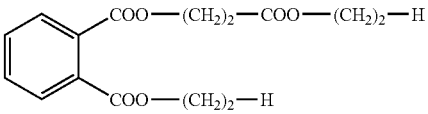

S-9

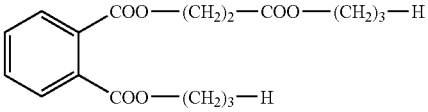

S-10

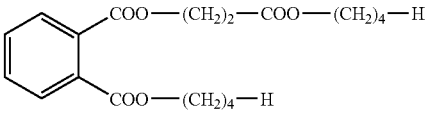

S-11

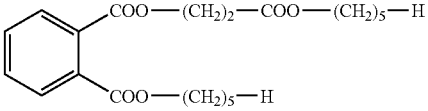

S-12

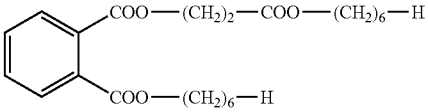

S-13

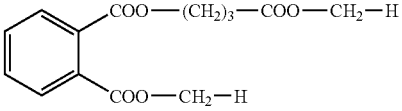

S-14

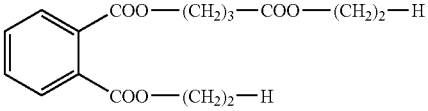

S-15

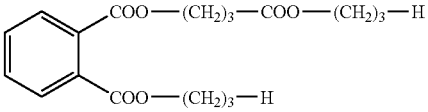

S-16

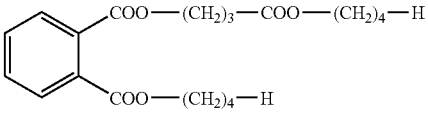

S-17

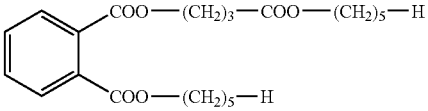

S-18

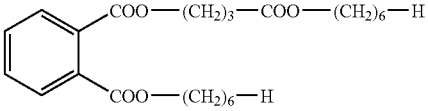

S-19

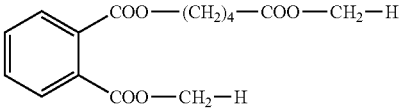

S-20

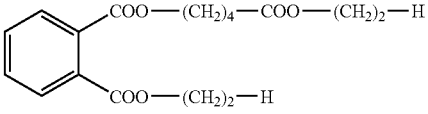

-continued

S-21

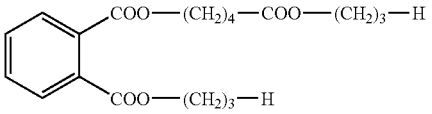

S-22

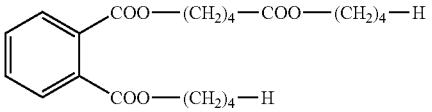

S-23

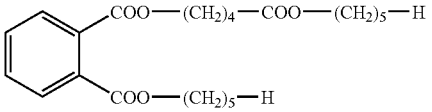

S-24

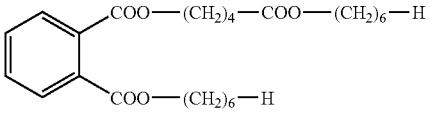

S-25

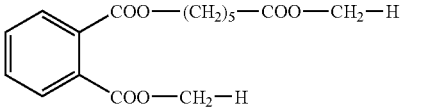

S-26

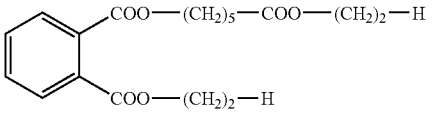

S-27

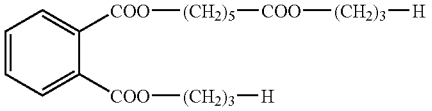

S-28

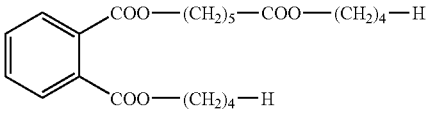

S-29

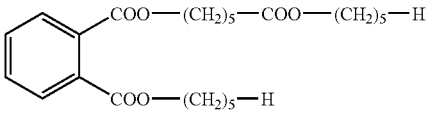

S-30

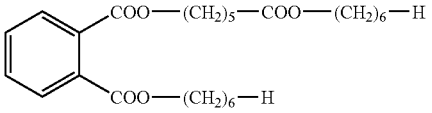

S-31

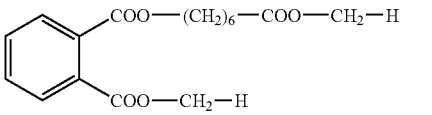

S-32

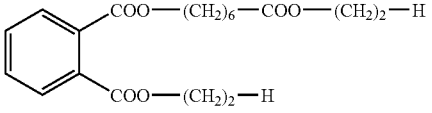

S-33

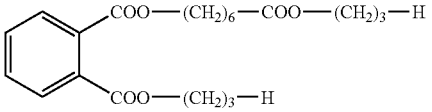

-continued

S-34

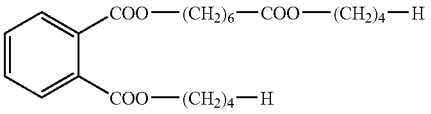

S-35

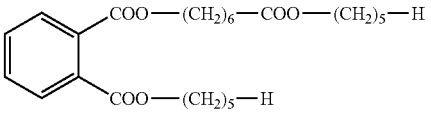

S-36

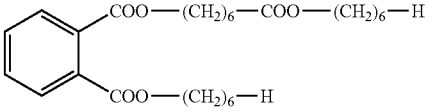

The high-boiling organic solvent represented by the above formula (S) is preferably used in combination with the high-boiling organic solvent represented by the above formula (P). The mixing ratio at being used in combination is not specifically limited, but preferably, 9:1 to 1:9 (mass ratio).

Further, these high-boiling organic solvents are preferably used in the same emulsion layer together with the above compounds of type 1 and type 2, but they may be used in a protective layer or an intermediate layer together with the emulsion layer.

In the present invention, the high-boiling organic solvent is preferably contained as an emulsified product (a finely dispersion). The average grain diameter of the emulsified product is preferably 50 μm or less, further preferably 10 μm or less, particularly preferably 2 μm or less, and most preferably 0.5 μm or less. When the emulsified product is prepared, it can be dispersed only by mechanical stirring but a surfactant is preferably used. Further, it is preferable to prepare the emulsified product by adding high molecular weight gelatin and the like to the product.

The amount of the high-boiling organic solvent contained in the emulsified product is preferably 0.05 to 10% by mass (the amount of the organic solvent contained in 100 g of the emulsified product), more preferably 0.1 to 10%, and further preferably 0.2 to 10%.

Then, the surfactant contained in the silver halide color photosensitive material of the present invention will be illustrated.

The silver halide color photosensitive material of the present invention contains preferably a surfactant for electrostatic preventive represented by the following general formula (Q) in any one of the layers on a support.

General Formula (Q)

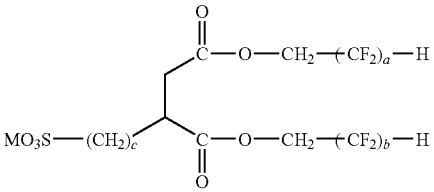

In the general formula (Q), M represents an alkali metal, a and b represent independently an integer of 4 to 8, and c represents 0 or 1. Na, K and Li are included in the alkali metal represented by M. The sum of a and b is preferably 10 to 14, more preferably 11 to 13, and c is particularly preferably 0.

In the above general formula (Q), the following compound (FT-0) is preferably used in the present invention in particular.
(FT-0)
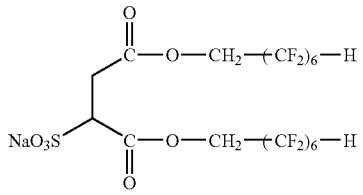
The specific examples of the surfactant represented by the above general formula (Q) other than the above compound (FT-0) are exemplified below.
FT-1
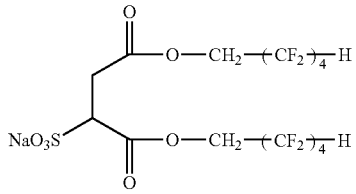
FT-2
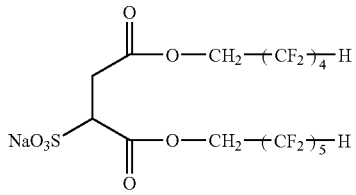
FT-3
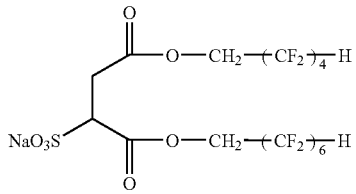
FT-4
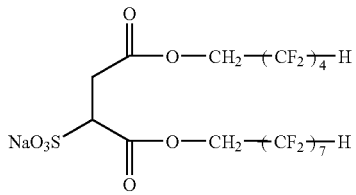
FT-5
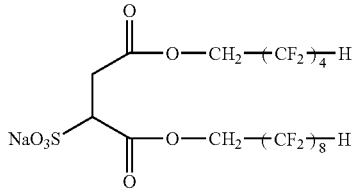
-continued
FT-6
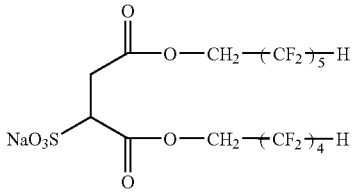
FT-7
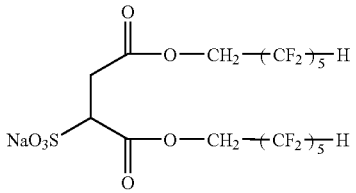
FT-8
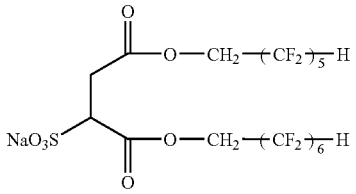
FT-9
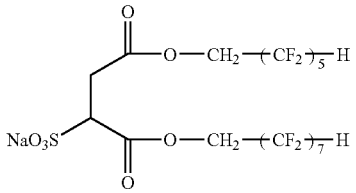
FT-10
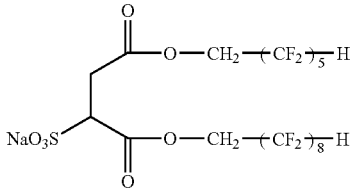
FT-11
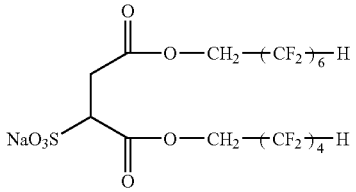
FT-12
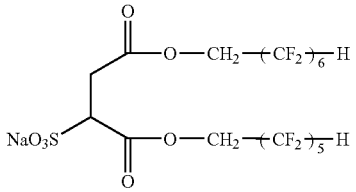
FT-13
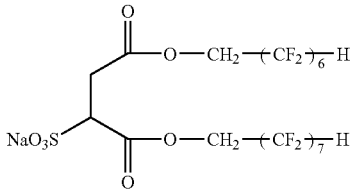

-continued

FT-14

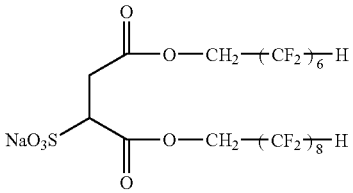

FT-15

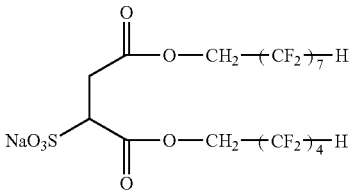

FT-16

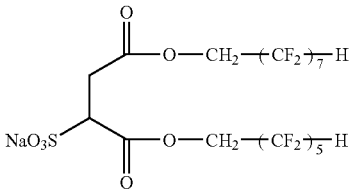

FT-17

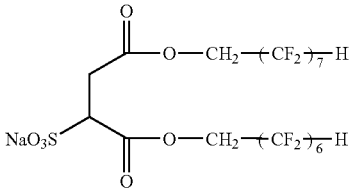

FT-18

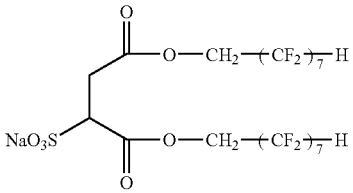

FT-19

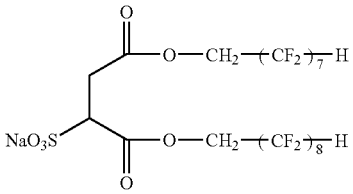

FT-20

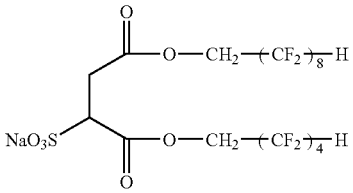

FT-21

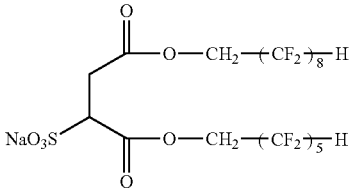

-continued

FT-22

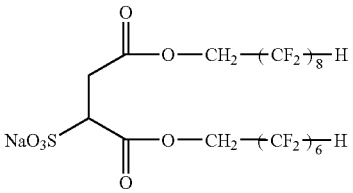

FT-23

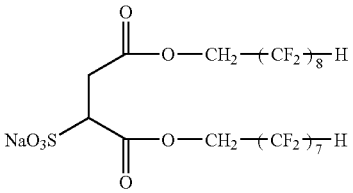

FT-24

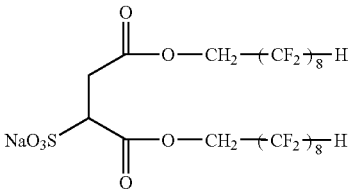

FT-25

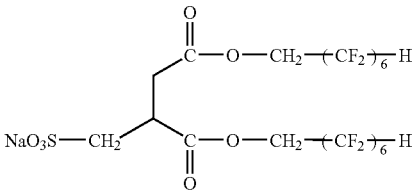

The surfactant represented by the above general formula (Q) of the invention can be synthesized by known methods. For example, the surfactant can be synthesized by using a fumaric acid derivative, a maleic acid derivative, an itaconic acid derivative, a glutamic acid derivative, an asparagic acid derivative and the like as a raw material. For example, when a fumaric acid derivative, a maleic acid derivative and an itaconic acid derivative are used as a raw material, it can be synthesized by carrying out cationic ionization by an alkylation agent after carrying out a Michael addition reaction with a nucleophilic species.

The amount used of the surfactant represented by the above general formula (Q) of the invention is preferably $10^{-6}$ to $10^{-1}$ mol/$m^2$.

The surfactant represented by the above general formula (Q) of the invention may be used in combination with another surfactant. As the usable surfactant, various surfactants such as an anionic base, a cationic base and a nonionic base can be mentioned. Further, the surfactant used in combination may be a polymer surfactant, and may be a fluorine base surfactant other than the compound of the present invention. Examples of the surfactant which can be used in combination include surfactants described in JP-A-62-215272 (pages 647 to 706), Research Disclosure (RD) Nos. 17643, pages 26 to 27 (December, 1978), 18716, page 650 (November, 1979), 307105, pages 875 to 876 (November, 1989) and the like.

Further, examples of other components which can be used in combination include a polymer compound. The above polymer compound may be a polymer soluble in an aqueous medium (hereinafter, called as the "soluble polymer"), and may be an aqueous dispersion (a so-called polymer latex). The soluble polymer is not specifically limited, but examples thereof include gelatin, poly(vinyl alcohol), casein, agar, gum Arabic, hydroxyethylcellulose, methylcellulose, and carboxymethylcellulose. The polymer latex includes the dispersion of a homopolymer or a copolymer of various vinyl monomer [for example, an acrylate derivative, a methacrylate derivative, an acrylamide derivative, a methacrylamide derivative, a styrene derivative, a conjugated diene derivative, an N-vinyl compound, an O-vinyl compound, vinyl nitrile, and other vinyl compounds (for example, ethylene, and vinylidene chloride)], and a condensation base polymer (for example, polyester, polyurethane, polycarbonate and polyamide). Specific examples of the polymer include polymer compounds described in, for example, JP-A-62-215272 (pages 707 to 763), Research Disclosure (RD) Nos. 17643, page 651 (December, 1978), 18716, page 650 (November, 1979), 307105 pages 873 to 874 (November, 1989) and the like.

The surfactant represented by the above general formula (Q) of the invention is preferably used for a coating composition for forming the layer (in particular, a protective layer, an under coating layer, a back layer or the like) composing the silver halide color photosensitive material. Among these, it is preferable in particular because when it is used for forming a hydrophilic colloidal layer on the uppermost layer of a photographic photosensitive material, effective electrostatic preventive capability and coating uniformity can be obtained in addition to exhibiting the effect of the present invention. However, in addition to the above, the surfactant may be added to a layer having spectral sensitivity and an intermediate layer. Further, the surfactant may be added to a plural number of layers and any one layer.

When the surfactant is added to the coating composition, it may be added by being dissolved in a medium and may be added by the dispersed product. For example, water or an organic solvent (for example, methanol, ethanol, isopropanol, n-butanol, methylcellosolve, dimethyl formamide, acetone, phenoxy ethanol or the like) is used alone or in combination, and if necessary, a method of adjusting pH to be solved and adding it may be well. Further, the dispersion may be added alone or by a dispersion which coexists with various compounds such as a coupler, a matting agent and a color mixing preventive and a silver halide.

A fixed amount or more of the surfactant represented by the above general formula (Q) of the invention is preferably contained in the surface of the photosensitive material. The amount existing in the surface of the photosensitive material can be detected by analyzing the surface with an XPS (X-ray Photoelectron Spectroscopy) and determining it with the fluorescent X-ray intensity ratio (F/C) of fluorine to carbon. F/C is preferably 0.5 or more, further preferably 0.8 or more, particularly preferably 1.0 or more, and most preferably 1.5 or more. F/C is preferably 10 or less.

The aqueous coating composition containing the surfactant represented by the above general formula (Q) of the invention may contain other various compounds in accordance with the layers used in the photosensitive material, and may be dissolved in a medium or may be dispersed. Examples thereof include various couplers, an ultraviolet absorbent, a color mixing preventive, an antistatic agent, a scavenger, an antifoggant, a film hardening agent, a dye, and an antibiotic. Further, as described above, the aqueous coating composition containing the surfactant represented by the above general formula (Q) of the invention is preferably used for forming a hydrophilic colloidal layer on the uppermost layer of the photographic photosensitive material. In this case, another surfactant, a matting agent, a sliding agent, colloidal silica, a gelatin plasticizer and the like can be also contained in the coating composition in addition to the hydrophilic colloid (for example, gelatin) and the compound of the invention.

Another aspect of the present invention is a silver halide color photosensitive material comprising on a support at least one layer of silver halide photograph emulsion layers containing a silver halide emulsion containing a methine compound represented by the above general formula (I) on the surface of silver halide grains, the silver halide color photosensitive material comprising at least one compound selected from a group consisting of the above type 1 and type 2.

A specific methine compound represented by the general formula (I) will be illustrated below.

General Formula (I)

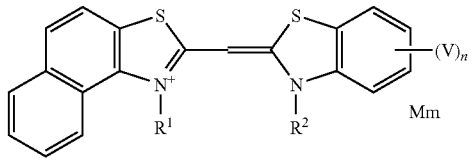

In the formula, V represents a monovalent substituent in which the σp value of Hammett substituent constant is −0.05 or less.

Hereat, the op value of Hammett substituent constant used in the specification is illustrated. The Hammett's rule is an empirical rule proposed in 1935 by L. P. Hammett for quantitatively discussing the influence of a substituent affecting the reaction or equilibrium of a benzene derivative, and this reasonability is widely confirmed nowadays. There are the σp value and σm value in the substituent constant determined for the Hammett's rule, and these values can be found in general documents. For example, details are described in "Lange's Handbook of Chemistry" the 12$^{th}$, 1979 (Mc Grow-Hill) edition edited by J. A. Dean, "Region of Chemistry" extra number, Vol. 122, pages 96 to 103, 1979 (Nankou-dou), and "Chemical Review" Vol. 91 (1991), pages 165 to 195.

Further, in the present invention, a substituent is limited by the σp value of Hammett substituent constant and illustrated, but this does not mean that values known in the literatures which can be found in the above-mentioned books are limited only to a certain substituent. It is needless to say that even if the value is unknown in the literatures, it includes a substituent which will be included within the range when it is measured based on the Hammett's rule.

In the present invention, the σp value is used as a measure for indicating the electronic effect of a substituent irrespective of its substituted position.

The present inventors have found that when a methine compound having a specific structure represented by the general formula (I), i.e., a methine compound having a substituent whose σp value of Hammett substituent constant is a value within a prefetermined range as a nuclear substituent is used as a sensitizing dye, more superior effect can be obtained.

The σp value of a substituent represented by V is −0.05 or less, preferably −0.10 or less, and more preferably −0.20 or less. The lower limit value of the σp value is not specifically limited, but the σp value is preferably −1.00 or more, and more preferably −0.80 or more.

As the example of the substituent having the σp value of −0.05 or less, for example, the following substituents are mentioned. The σp value described in "Chemical Review" Vol. 91 (1991), pages 165 to 195 is described in the parenthesis.

A substituted or unsubstituted alkyl group {for example, a methyl group (−0.17), an ethyl group (−0.15), a cyclopropyl group (−0.21), an allyl group (−0.14), a benzyl group (−0.09), and an aminomethyl group (−0.11)}, a substituted aryl group {for example, a 4-methoxyphenyl group (−0.08), and a 4-fluorophenyl group (−0.10)}, a substituted or unsubstituted alkoxy group {for example, a methoxy group (−0.27), an ethoxy group (−0.24), a butoxy group (−0.32), a vinyloxy group (−0.09), and an allyloxy group (−0.25)}, a trimethylsilyl group (−0.07), a trimethylsilyloxy group (−0.27), a substituted or unsubstituted amino group {for example, an amino group (−0.66), an N-phenylamino group (−0.56), an N-methylamino (−0.70), an N,N-dimethylamino group (−0.83), and a benzylideneamino group (−0.55)}.

V is preferably a substituted or unsubstituted alkyl group or alkoxy group having the σp value of −0.10 or less, more preferably a substituted or unsubstituted alkoxy group having the σp value of −0.10 or less, further preferably a methoxy group or an ethoxy group, and particularly preferably a methoxy group.

n represents 1, 2, 3 and 4, preferably 1 and 2, more preferably 1 and 2, and particularly preferably 1.

When n is 2 or more, V's which exist in a plural number may be the same or different respectively. Further, V's which are substituted at adjacent positions may be bound to form a ring. The ring formed may further have a substituent.

When n is 1, the substitution position of V is preferable 5 or 6. A 5-position is preferable in particular. The positional number is described below.

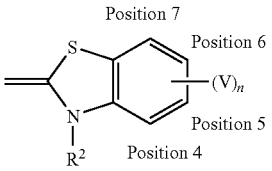

The substituent represented by V, the number of the substituents and the substitution position are preferably a case that one or two alkoxy groups or alkyl groups are substituted at 5-position or 6-position, more preferably a case that one alkoxy group is substituted at 5-position, and particularly preferably one methoxy group is substituted at 5-position.

$R^1$ and $R^2$ each represent a substituted or unsubstituted alkyl group, and examples thereof include a methyl group, an ethyl group, a benzyl group, a sulfoalkyl group, and a carboxyalkyl group. Provided that at least one of $R^1$ and $R^2$ is a substituted alkyl group represented by the following formula.

-(Q)u-X

Q represents a methylene group which may optionally have a substituent. X represents $SO_3^-$, $CO_2^-$ and $PO_3^{2-}$. u represents an integer of 1 or more. When u is 2 or more, a plural number of Q's may be the same or different. The upper limit of u is not specifically limited, but it is preferably 10 or less and further preferably 6 or less.

Q is preferably an unsubstituted methylene group and a methylene group substituted with a methylene group. An unsubstituted methylene group is particularly preferable. X is preferably $SO_3^-$ and $CO_2^-$, and more preferably $SO_3^-$. u is preferably 2 or more and 4 or less, and more preferably 3. -(Q)u-X preferably represents a sulfoalkyl group, further preferably a 3-sulfopropyl group and a 3-sulfobutyl group, and particularly preferably a sulfopropyl group.

$R^1$ and $R^2$ are preferably a methyl group, an ethyl group, a benzyl group, a sulfoalkyl group and a carboxyalkyl group, more preferably an ethyl group and a sulfoalkyl group, further preferably an ethyl group and a 3-sulfopropyl group, and particularly preferably a 3-sulfopropyl group.

$R^1$ and $R^2$ may be the same or different. When they are different, at least one of them is at least a 3-sulfopropyl group. When they are the same, they are preferably a sulfopropyl group. Particularly preferably, both of $R^1$ and $R^2$ are a sulfopropyl group.

M is included in the formula for indicating the existence of a cationic ion or an ionic ion when it is required for neutralizing charge. The typical cation includes inorganic cation such as hydrogen ion ($H^+$), alkali metal ion (for example, sodium ion, potassium ion and lithium ion) and alkali earth metal ion (for example, calcium ion), and organic ion such as ammonium ion (for example, ammonium ion, tetraalkylammonium ion, pyridinium ion and ethylpyridinium ion). Anionic ion may be either of inorganic anion or organic ion, and examples thereof include halogen ion (for example, fluorine ion, chlorine ion and iodine ion), substituted arylsulfonic acid ion (for example, p-toluenesulfonic acid ion and p-chlorobenezenesulfonic acid ion), aryldisulfonic acid ion (for example, 1,3-benzenedisulfonic acid ion, 1,5-naphthalenedisulfonic acid ion and 2,6-naphthalenedisulfonic acid ion), alkylsulfuric acid ion (for example, methylsulfuric acid ion), sulfuric acid ion, thiocyanic acid ion, perchloric acid ion, tetrafluoroboric acid ion, picric acid ion, acetic acid ion, and trifluoromethanesulfonic acid ion. Further, an ionic polymer or another dye which has reverse charge against a dye may be used. Further, when $SO_3^-$, $CO_2^-$ and $PO_3^{2-}$ have hydrogen ion as counter ion, they can be represented as $SO_3H$, $CO_2H$ and $PO_3H_2$.

m represents a number required for balancing charge, and is preferably a number of 0 to 4 and more preferably a number of 0 to 1. When a salt is formed in the molecule, m is 0.

Specific examples of the methine compounds represented by the formula (I) of the present invention will be shown below, which however naturally in no way limit the scope of the invention.

B-1

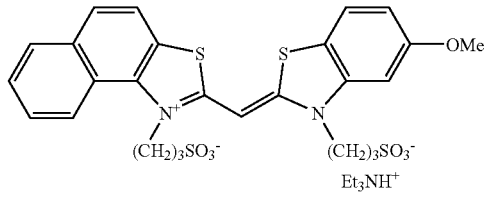

B-2

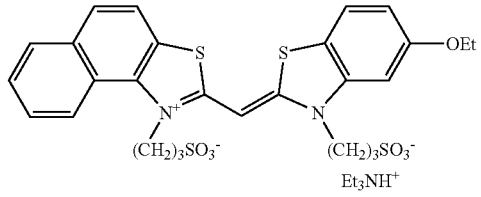

B-3

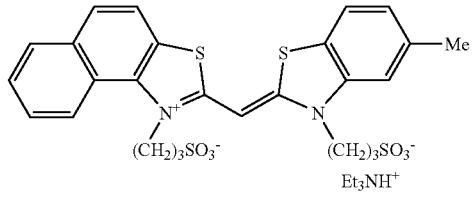

-continued
B-4
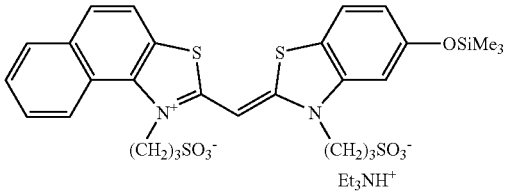
B-5
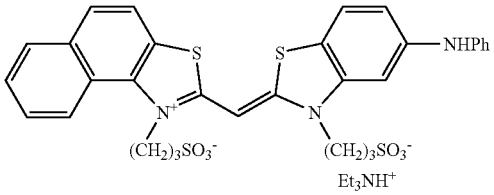
B-6
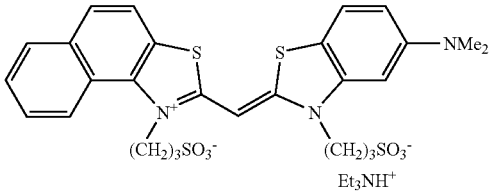
B-7
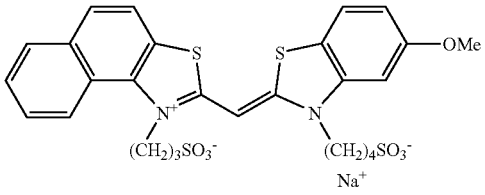
B-8
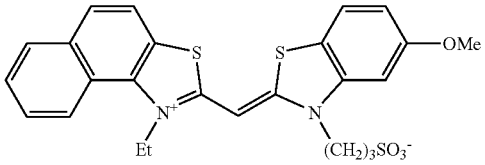
B-9
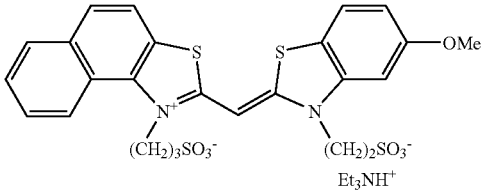
B-10
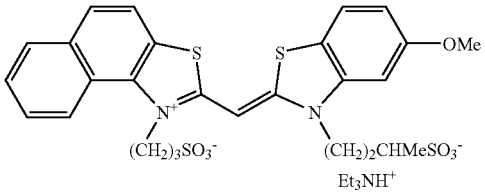
-continued
B-11
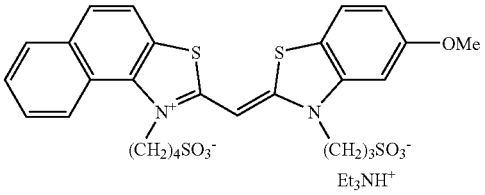
B-12
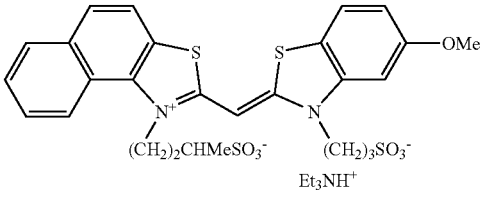
B-13
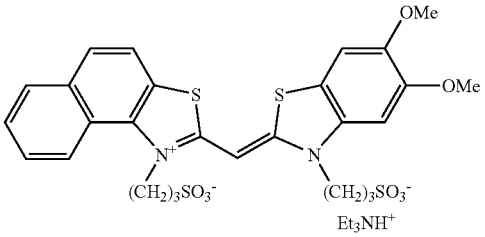
B-14
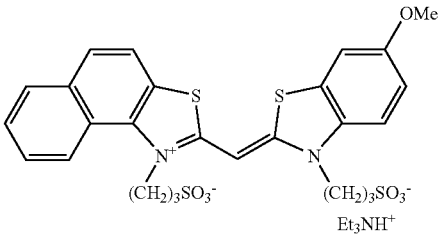
B-15
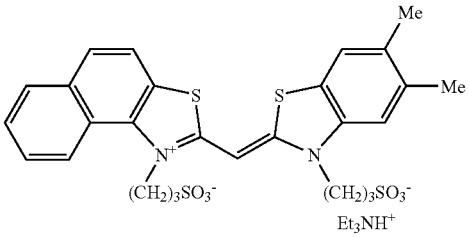
B-16
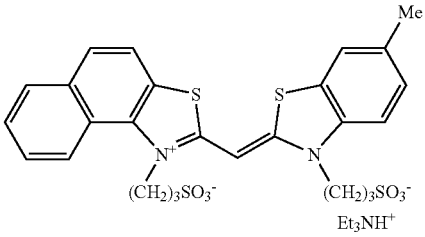

-continued

B-17

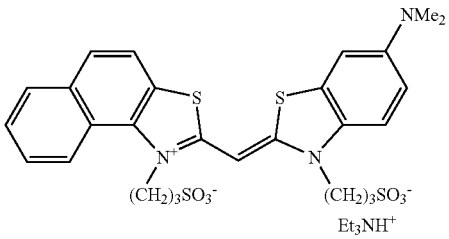

B-18

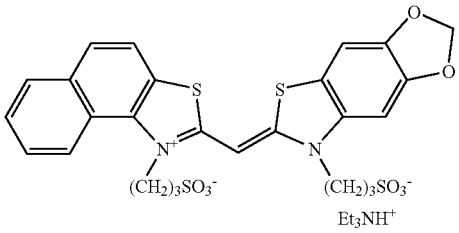

B-19

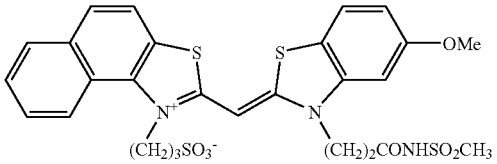

B-20

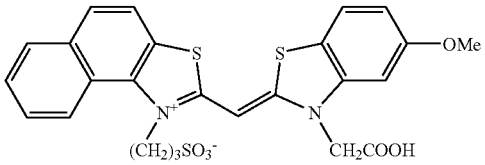

The compounds represented by the formula (I) can be synthesized by the processes described in, for example, "Heterocyclic Compounds—Cyanine Dyes and Related Compounds", written by F. M. Harmer and published by John Wiley & Sons—New York, London (1964), "Heterocyclic Compounds—Special topics in heterocyclic chemistry", Chapter 18, Section 14, pp.482-515, written by D. M. Sturmer and published by John Wiley & Sons—New York, London (1977), and "Rodd's Chemistry of Carbon Compounds" 2nd. Ed. vol. IV, part B, Chapter 15, pp. 369-422, published by Elsevier Science Publishing Company Inc.—New York, London (1977) and the like.

In the present invention, not only the sensitizing dye represented by the formula (I) but also a sensitizing dye other than that of the general formula (I) may be used, they may also be combined. Usable dyes involve a cyanine dye, merocyanine dye, composite cyanine dye, composite merocyanine dye, holbpolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

The sensitizing dye of the general formula (I) can be preferably used at $4\times10^{-6}$ to $8\times10^{-3}$ mol per one mol of silver halide. Further, a sensitizing dye other than that of the general formula (I) may be used.

The sensitizing dye of the invention can be directly dispersed in an emulsion. Further, these are firstly dissolved in an appropriate solvent, for example, methyl alcohol, ethyl alcohol, methylcellosolve, acetone, water, pyridine or a mix solvent thereof, and can be also added to an emulsion in a form of a solution. At this time, additives such as a base, an acid and a surfactant can be coexisted. Ultra sonic can be also used for dissolution. Further, as the method of adding the compound, there can be used a method of dissolving the compound in a volatile organic solvent, dispersing the solution in hydrophilic colloid and adding the dispersion in the emulsion which is described in U.S. Pat. No. 3,469,987; a method of dispersing in an aqueous solvent and adding the dispersion in an emulsion which is described in JP-B-46-24185; a method of dissolving a compound in a surfactant and adding the solution in an emulsion which is described in U.S. Pat. No. 3,822,135; a method of using a compound providing red shift to dissolve and adding the solution in an emulsion which is described in JP-A-51-74624; and a method of dissolving a compound in an acid which does not substantially contain water and adding the solution in an emulsion which is described in JP-A-50-80826. Additionally, methods described in U.S. Pat. Nos. 2,912,343, 3,342,605, 2,996,287, 3,429,835 and the like are used for addition to an emulsion.

Further, another aspect of the present invention is a silver halide color photosensitive material containing at least one compound selected from a group consisting of the above type 1 and type 2, wherein the total coating amount of silver of the photosensitive silver halide is 6.0 g/m$^2$ or less in terms of metal silver and the photosensitivity is the ISO speed of 400 or more.

When the ISO speed is lower than 400, it is not preferable as a photosensitive material for photographing because photographing luminous quantity and shutter speed are limited. The ISO speed is preferably 800 or more. It is needless to say that the ISO speed is preferably as high as possible, but the upper limit is about 10000.

The range of the preferable coating amount of silver differs depending on the layer composition of a photosensitive material and a coupler species, and cannot be simply determined. A photosensitive material having the ISO speed of 400 or more causes sensitivity lowering and the deterioration of particle size property due to exposure of natural radial rays which become a problem for practical use, when the amount of silver exceeds 6.0 g/m$^2$. Further, the amount of silver is less than 3.0 g/m$^2$, the maximum density which is required for a color photosensitive material cannot be secured. The photosensitive material having the ISO speed of 400 or more is preferably 3.0 g/m$^2$ or more and 6.0 g/m$^2$ or less, and more preferably 3.5 g/m$^2$ or more and 4.5 g/m$^2$ or less.

The preferable amount of silver of the silver halide emulsion layer in the color photosensitive material which contains the compound of the invention ha been mentioned above, but as a layer reducing the amount of silver, a high sensitive emulsion layer is preferable so that effect by reduction of the amount of silver works significantly, and at least one of the highest blue-sensitive layer, the highest green-sensitive layer and the highest red-sensitive layer is preferable. The coating amount of silver of the photosensitive silver halide in the highest blue-sensitive layer, the highest green-sensitive layer and the highest red-sensitive layer of the color photosensitive material containing the compound of the invention is preferably 4.0 g/m$^2$ or less in terms of metal silver, and more preferably 3.0 g/m$^2$ or less. In the ISO speed of 400 or more, 2.7 g/m$^2$ or less is particularly preferable.

The silver halide emulsion used for the present invention is preferably silver bromide, silver chloride, silver iodobromide, silver iodochlorobromide, silver chlorobromide, silver chloroiodobromide, silver iodochloride or the like. The mode of silver halide grains may be regular-crystal grains such as an octahedron, a cubic, and a tetradecahedron, but tabular grains are more preferable.

The following emulsion as the silver halide grains of the emulsion can be mentioned as a preferable example.

(1) Silver halide tabular grains consisting of silver iodobromide or silver chloroiodobromide in which a parallel principal plane is a (111) plane, the aspect ratio of grains which occupy 50% or more of the total projection area of a particle is 2 or more, 10 dislocation lines per one grain are contained, and the content ratio of silver halide is less than 10% by mol.

(2) Silver halide tabular grains consisting of silver iodobromide or silver chloroiodobromide in which a parallel principal plane is a (111) plane, and which are hexagonal grains in which the ratio of the length of a side having the maximum length to the length of a side having the minimum length of grains which occupy 50% or more of the total projection area of a particle is 2 or less, have at least one epitaxial junction per one grain at the apex portion and/or a side face portion and/or a principal plane portion of the hexagonal silver halide grains, and have the content ratio of silver halide of less than 10% by mol.

(3) Silver halide tabular grains consisting of silver iodobromide or silver chloroiodobromide in which a parallel principal plane is a (100) plane, the aspect ratio of grains which occupy 50% or more of the total projection area of a particle is 2 or more, and the content ratio of silver halide is less than 10% by mol.

(4) Silver halide tabular grains in which a parallel principal plane is a (111) plane or a (100) plane, and the aspect ratio of grains which occupy 50% or more of the total projection area of a particle is 2 or more, the silver halide tabular grains containing at least 80% by mol of silver halide.

The detailed description of the silver halide tabular grains in which a parallel principal plane is a (111) plane in the above description (1) is mentioned in the description of JP-A-2002-122954, pages 8 to 10.

The detailed description of the silver halide tabular grains having one epitaxial junction in the above description (2) is mentioned in the description of JP-A-2002-122954, pages 14 to 19.

The detailed description of the tabular silver halide particles in which a parallel principal plane is a (100) plane in the above description (3) is mentioned in the description of JP-A-2002-122954, pages 10 to 11.

The detailed description of the tabular silver halide particles in which a parallel principal plane is a (111) plane or a (100) plane, and the aspect ratio is 2 or more, the grains containing at least 80% by mol of silver halide in the above description (4) is mentioned in the description of JP-A-2002-122954, pages 10 to 14.

In the silver halide tabular grains, the aspect ratio means a ratio of diameter to thickness in silver halide. Namely, it is a value obtained by dividing the diameters of the respective silver halide grains by thicknesses. Hereat, the diameter indicates the diameter of a circle having the same area as the projection area of a particle when the silver halide grains are observed by a microscope or an electron microscope.

As a preferable aspect, the color photosensitive material of the invention has respectively at least one of a red-sensitive silver halide emulsion layer, a green-sensitive silver halide emulsion layer and a blue-sensitive silver halide emulsion layer, in which each of the silver halide emulsions is preferably composed of 2 layers or more of silver halide emulsion layers having different sensitivities. 50% or more of the total projection area of the silver halide grains contained in at least one layer of the emulsion layers having the highest sensitivity among 2 layers or more of the silver halide emulsion layers is the silver halide tabular grains having an aspect ratio of 2 or more, and the average aspect ratio is 8 or more, more preferably 10 or more, and most preferably 12 or more. The average aspect ratio is the average value of the aspect ratios of the total tabular grains in the emulsion.

Supplemental addition of gelatin may be effected during the grain formation in order to obtain monodisperse tabular grains of high aspect ratio. The added gelatin is preferably a chemically modified gelatin as described in JP-A's-10-148897 and 11-143002. This chemically modified gelatin is a gelatin characterized in that at least two carboxyl groups have newly been introduced at a chemical modification of amino groups contained in the gelatin, and it is preferred that gelatin trimellitate be used as the same. Also, gelatin succinate is preferably used. The chemically modified gelatin is preferably added prior to the growth step, more preferably immediately after the nucleation. The addition amount thereof is preferably 60% or greater, more preferably 80% or greater, and most preferably 90% or greater, based on the total mass of dispersion medium used in grain formation.

The tabular grain emulsion is preferably constituted of silver iodobromide or silver chloroiodobromide. Although silver chloride may be contained, the silver chloride content is preferably 8 mol % or less, more preferably 3 mol % or less, and most preferably 0 mol %. With respect to the silver iodide content, it is preferably 20 mol % or less inasmuch as the variation coefficient of the grain size distribution of the tabular grain emulsion is preferably 30% or less. The lowering of the variation coefficient of the distribution of equivalent circular diameter of the tabular grain emulsion can be facilitated by decreasing the silver iodide content. It is especially preferred that the variation coefficient of the grain size distribution of the tabular grain emulsion be 20% or less while the silver iodide content be 10 mol % or less.

Furthermore, it is preferred that the tabular grain emulsion have some intragranular structure with respect to the silver iodide distribution. The silver iodide distribution may have a double structure, a treble structure, a quadruple structure or a structure of higher order.

In the present invention, it is preferable that tabular grains have dislocation lines. Dislocation lines in tabular grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocations in each grain viewed in a direction perpendicular to the principal planes of the grain.

The average number of dislocation lines of tabular grains used in the present invention is preferably 10 or more, and more preferably, 20 or more per grain. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains. Several hundreds of dislocation lines are sometimes found.

Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular grain can have dislocation lines either almost uniformly across the whole peripheral region or at a particular position of the peripheral region. That is, in the case of a hexagonal tabular silver halide grain, dislocation lines can be limited to either portions near the six corners or only a portion near one of the six corners. In contrast, it is also possible to limit dislocation lines to only portions near the edges except for the portions near the six corners.

Dislocation lines can also be formed across a region containing the centers of two principal planes of a tabular grain. When dislocation lines are formed across the entire region of the principal planes, the direction of the dislocation lines is sometimes crystallographically, approximately a (211) direction with respect to a direction perpendicular to the principal planes. In some cases, however, the direction is a (110) direction or random. The lengths of the individual dislocation lines are also random; the dislocation lines are sometimes observed as short lines on the principal planes and sometimes observed as long lines reaching the edges (peripheral region). Although dislocation lines are sometimes straight, they are often zigzagged. In many cases, dislocation lines cross each other.

As described above, the position of dislocation lines can be either limited on the peripheral region or the principal planes or a local position on at least one of them. That is, dislocation lines can be present on both the peripheral region and the principal planes.

Introducing dislocation lines to a tabular grain can be achieved by forming a specific silver iodide rich phase inside the grain. This silver iodide rich phase can include a discontinuous silver iodide rich region. More specifically, after a substrate grain is prepared, the silver iodide rich phase is formed and covered with a layer having a silver iodide content lower than that of the silver iodide rich phase. The silver iodide content of the substrate tabular grain is lower than that of the silver iodide rich phase, and is preferably 0 to 20 mol %, and more preferably, 0 to 15 mol %.

In this specification, the silver iodide rich phase inside a grain is a silver halide solid solution containing silver iodide. This silver halide is preferably silver iodide, silver iodobromide, or silver bromochloroiodide, and more preferably, silver iodide or silver iodobromide (the silver iodide content with respect to a silver halide contained in this silver iodide rich phase is 10 to 40 mol %). To cause this silver iodide rich phase inside a grain (to be referred to as an internal silver iodide rich phase hereinafter) to selectively exist on the edge, the corner, or the surface of a substrate grain, it is desirable to control the formation conditions of the substrate grain, the formation conditions of the internal silver iodide rich phase, and the formation conditions of a phase covering the outside of the internal silver iodide rich phase. Important factors as the formation conditions of a substrate grain are the pAg (the logarithm of the reciprocal of a silver ion concentration), the presence/absence, type, and amount of a silver halide solvent, and the temperature. By controlling the pAg to preferably 8.5 or less, more preferably, 8 or less during the growth of substrate grains, the internal silver iodide rich phase can be made to selectively exist in portions near the corners or on the surface of the substrate grain, when this silver iodide rich phase is formed later.

On the other hand, by controlling the pAg to preferably 8.5 or more, more preferably, 9 or more during the growth of substrate grains, the internal silver iodide rich phase can be made to exist on the edges of the substrate grain. The threshold value of the pAg rises and falls depending on the temperature and the presence/absence, type, and amount of a silver halide solvent. When thiocyanate is used as the silver halide solvent, this threshold value of the pAg shifts to higher values. The value of the pAg at the end of the growth of substrate grains is particularly important, among other pAg values during the growth. On the other hand, even if the pAg during the growth does not meet the above value, the position of the internal silver iodide rich phase can be controlled by performing ripening by controlling the pAg to the above proper value after the growth of substrate grains. In this case, ammonia, an amine compound, a thiourea derivative, or thiocyanate salt can be effectively used as the silver halide solvent. The internal silver iodide rich phase can be formed by a so-called conversion method.

This method includes a method which, at a certain point during grain formation, adds halogen ion smaller in solubility for salt for forming silver ion than halogen ion that forms grains or portions near the surfaces of grains at that point. In the present invention, the amount of halogen ion having a smaller solubility to be added preferably takes a certain value (related to a halogen composition) with respect to the surface area of grains at that point. For example, at a given point during grain formation, it is preferable to add a certain amount or more of KI with respect to the surface area of silver halide grains at that point. More specifically, it is preferable to add $8.2\times10^{-5}$ mol/m$^2$ or more of iodide salt.

A more preferable method of forming the internal silver iodide rich phase is to add an aqueous silver salt solution simultaneously with addition of an aqueous silver halide solution containing iodide salt. As an example, an aqueous $AgNO_3$ solution is added simultaneously with addition of an aqueous KI solution by the double-jet method. In this case, the addition start timings and the addition end timings of the aqueous KI solution and the aqueous $AgNO_3$ solution can be shifted from each other. The addition molar ratio of the aqueous $AgNO_3$ solution to the aqueous KI solution is preferably 0.1 or more, more preferably, 0.5 or more, and most preferably, 1 or more. The total addition molar quantity of the aqueous $AgNO_3$ solution can exit in a silver excess region with respect to halogen ion in the system and iodine ion added. During the addition of the aqueous silver halide solution containing iodine ion and the addition of the aqueous silver salt solution by the double-jet method, the pAg preferably decreases with the addition time by the double-jet. The pAg before the addition is preferably 6.5 to 13, and more preferably, 7.0 to 11. The pAg at the end of the addition is most preferably 6.5 to 10.0.

In carrying out the above method, the solubility of a silver halide in the mixing system is preferably as low as possible. Therefore, the temperature of the mixing system at which the silver iodide rich phase is formed is preferably 30° C. to 80° C., and more preferably, 30° C. to 70° C.

The formation of the internal silver iodide rich phase is most preferably performed by adding fine-grain silver iodide, fine-grain silver iodobromide, fine-grain silver chloroiodide, or fine-grain silver bromochloroiodide. The addition of fine-grain silver iodide is particularly preferred. These fine grains normally have a grain size of 0.01 to 0.1 μm, but those having a grain size of 0.01 μm or less or 0.1 μm or more can also be used. Methods of preparing these fine silver halide grains are described in JP-A's-1-183417, 2-44335, 1-183644, 1-183645, 2-43534, and 2-43535, the disclosures of which are incorporated herein by reference. The internal silver iodide rich phase can be formed by adding and ripening these fine silver halide grains. In dissolving the fine grains by ripening, the silver halide solvent described above can also be used. These fine grains added need not immediately, completely dissolve to disappear but need only disappear by dissolution when the final grains are completed.

The internal silver iodide rich phase is located in a region of, when measuring from the center of, e.g., a hexagon formed in a plane by projecting a grain thereon, preferably 5 to less than 100 mol %, more preferably, 20 to less than 95 mol %, and most preferably, 50 to less than 90 mol % with respect to the total silver amount of the grain. The amount of a silver halide which forms the internal silver iodide rich phase is, as a silver amount, preferably 50 mol % or less, and more preferably, 20 mol % or less of the total silver amount of a grain. These values of amounts of the silver iodide rich phase are not those obtained by measuring the halogen composition of the final grain by using various analytical methods but formulated values in the producing of a silver halide emulsion. The internal silver iodide rich phase often disappears from the final grain owing to, e.g., recrystallization, and so all silver amounts described above are related to their formulated values.

It is, therefore, readily possible to observe dislocation lines in the final grains by the above method, but the internal silver iodide rich phase introduced to introduce dislocation lines cannot be observed as a definite phase in many cases because the silver iodide composition in the boundary continuously changes. The halogen compositions in each portion of a grain can be checked by combining X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain).

The silver iodide content of an outer phase covering the internal silver iodide rich phase is lower than that of the silver iodide rich phase, and is preferably 0 to 30 mol %, more preferably, 0 to 20 mol %, and most preferably, 0 to 10 mol % with respect to a silver halide amount contained in the outer phase.

Although the temperature and the pAg, at which the outer phase covering the internal silver iodide rich phase is formed, can take arbitrary values, the temperature is preferably 30° C. to 80° C., and most preferably, 35° C. to 70° C., and the pAg is preferably 6.5 to 11.5. The use of the silver halide solvents described above is sometimes preferable, and the most preferable silver halide solvent is thiocyanate salt.

Another method of introducing dislocation lines to tabular grains is to use an iodide ion releasing agent as described in JP-A's-6-11780, 6-11781, 6-11782, 6-11784, 6-27564 and 11-295832, the disclosure of which is incorporated herein by reference. This method is also preferably used.

Dislocation lines can also be introduced by appropriately combining this dislocation line introducing method with the above-mentioned dislocation line introducing method.

The variation coefficient of the inter-grain iodide distribution of silver halide grains used in the present invention is preferably 20% or less, more preferably, 15% or less, and most preferably, 10% or less. If the variation coefficient of the iodide content distribution of each individual silver halide is larger than 20%, no high contrast can be obtained, and a reduction of the sensitivity upon application of a pressure increases.

Any known method can be used as a method of producing silver halide grains used in the present invention and having a narrow inter-grain iodide distribution. Examples are a method of adding fine grains as disclosed in JP-A-1-183417 and a method which uses an iodide ion releasing agent as disclosed in JP-A-2-68538, the disclosures of which are incorporated herein by reference. These methods can be used alone or in combination.

The variation coefficient of the inter-grain iodide distribution of silver halide grains used in the present invention is preferably 20% or less. The most preferred method of monodispersing the inter-grain iodide distribution is a method described in JP-A-3-213845, the disclosure of which is incorporated herein by reference. That is, fine silver halide grains containing 95 mol % or more of silver iodide are formed by mixing an aqueous solution of a water-soluble silver salt and an aqueous solution of a water-soluble halide (containing 95 mol % or more of iodide ions) in a mixer placed outside a reaction vessel, and supplied to the reaction vessel immediately after the formation. In this manner, a monodisperse inter-grain iodide distribution can be achieved. The reaction vessel is a vessel which causes nucleation and/or crystal growth of tabular silver halide grains.

As described in JP-A-3-213845, the disclosure of which is incorporated herein by reference, the following three technologies can be used as a method of adding the silver halide grains prepared in the mixer and as a preparing means used in the method.

(1) After being formed in the mixer, the fine grains are immediately added to the reaction vessel.

(2) Strong and efficient stirring is performed in the mixer.

(3) An aqueous protective colloid solution is poured into the mixer.

The protective colloid used in method (3) above can be singly poured into the mixer or can be poured into the mixer after being contained in an aqueous halogen salt solution or aqueous silver nitrate solution. The concentration of the protective colloid is 1 mass % or more, preferably 2 to 5 mass %. Examples of a polymer compound having a protective colloid function with respect to silver halide grains used in the present invention are a polyacrylamide polymer, an amino polymer, a polymer having a thioether group, polyvinyl alcohol, an acrylic acid polymer, a polymer having hydroxyquinoline, cellulose, starch, acetal, polyvinylpyrrolidone, and a ternary polymer. The use of low-molecular-weight gelatin is preferred. The weight-average molecular weight of this low-molecular-weight gelatin is preferably 30,000 or less, and more preferably, 10,000 or less.

When fine silver halide grains are to be prepared, the grain formation temperature is preferably 35° C. or less, and particularly preferably, 25° C. or less. The temperature of the reaction vessel to which fine silver halide grains are added is 50° C. or more, preferably 60° C. or more, and more preferably, 70° C. or more.

The grain size of a fine silver halide used in the present invention can be directly confirmed by a transmission electron microscope by placing the grain on a mesh. The size of fine grains used in the present invention is preferably 0.3 μm or less, more preferably, 0.1 μm or less, and most preferably, 0.01 μm or less.

This fine silver halide can be added simultaneously with another halogen ion or silver ion or can be added alone. The mixing amount of the fine silver halide grains is 0.005 to 20 mol %, preferably 0.01 to 10 mol % with respect to a total silver halide.

The silver iodide content of each grain can be measured by analyzing the composition of the grain by using an X-ray microanalyzer. The variation coefficient of an inter-grain iodide distribution is a value defined by (standard deviation/average silver iodide content)×100=variation coefficient (%)

by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [μm] of each grain sometimes have a correlation and sometimes do not. However, Yi and Xi desirably have no correlation. The silver halogen composition structure of a grain used in the present invention can be checked by combining, e.g., X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain). When the silver iodide content is measured in the present invention, the grain surface is a region about 5 nm deep from the surface, and the grain interior is a region except for the surface. The halogen composition of this grain surface can usually be measured by the ESCA method.

In the present invention, regular-crystal grains such as cubic, octahedral, and tetradecahedral grains and irregular twinned-crystal grains can be used in addition to aforementioned tabular grains.

The general aspects of the emulsions of the present invention will be described below.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates, and sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

Succinated gelatin in which 95% or more of amino groups were modified, and trimellitic gelatin or oxidation-treated gelatin are preferable. Further, low molecular weight gelatin and low molecular weight oxidation-treated gelatin are preferably used.

Moreover, gelatin containing 30% or more of a component having a molecular weight distribution of 280 thousands and preferably 35% or more may be used. The lime-processed gelatin consists of sub α (low molecular weight), α (a molecular weight of about 100 thousands), β (a molecular weight of about 200 thousands), γ (a molecular weight of about 300 thousands) and a major high polymer portion (void: larger than a molecular weight of about 300 thousands) based on its molecular weight. The ratios of the respective components, namely molecular weight distribution is measured according to the PAGI method which is internationally prescribed. Further detailed description and production process are described in JP-A-11-237704 in details.

The emulsion of the invention is preferably rinsed with water, and dispersed in protective colloid newly prepared. The above-mentioned hydrophilic colloid and gelatin can be used for the protective colloid. At this time, gelatin containing 30% or more and preferably 35% or more of a component having a molecular weight distribution of 280 thousands is preferably used. The temperature of rinsing with water is selected in accordance with its purpose, but preferably, it is selected within a range of 5° C. to 50° C. pH at rinsing with water is selected in accordance with its purpose, but preferably, it is selected between 2 and 10, and more preferably, between 3 and 8. pAg at rinsing with water is selected in accordance with its purpose, but preferably, it is selected between 5 and 10. The method of rinsing with water can be used by selecting from a noodle water rinsing method, a dialysis method using a semi permeation membrane, a centrifugal separation method, a coagulation sedimentation method, and an ion exchange method. In case of the coagulation sedimentation method, it can be selected from a method using a sulfate, a method using an organic solvent, a method using a water-soluble polymer, a method using a gelatin derivative and the like.

Reduction sensitization preferable performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods. The method of adding reduction sensitizers is preferred in that the level of reduction sensitization can be finely adjusted.

As examples of the reduction sensitizer stannous chloride, ascorbic acid and its derivatives, hydroquinone and its derivatives, catechol and is derivatives, hydroxylamine and its derivatives, amines and polyamines, hydrazine and its derivatives, para-phenylenediamin and its derivatives, formamidinesulfinic acid(thiourea dioxide), a silane compound, and a borane compound, can be mentioned. In reduction sensitization of the present invention, it is possible to selectively use these reduction sensitizers or to use two or more types of compounds together. Regarding the methods for performing the reduction sensitization, those disclosed in U.S. Pat. Nos. 2,518,698, 3,201,254, 3,411,917, 3,779,777, 3,930,867, may be used. Regarding the methods for using the reduction sensitizer, those disclosed in JP-B's-57-33572 and 58-1410, JP-A-57-179835, may be used. Preferable compounds as the reduction sensitizer are catechol and its derivatives, hydroxylamine and its derivatives, and formamidinesulfinic acid(thiourea dioxide). Although the addition amount of reduction sensitizers must be so selected as to meet the emulsion manufacturing conditions, a proper amount is $10^{-7}$ to $10^{-1}$ mol per mol of a silver halide.

The reduction sensitizer is added during grain formation by dissolving thereof to water, or organic solvents such as alcohols, glycols, ketones, esters, and amides.

Examples of the silver halide solvents which can be employed in the present invention include (a) organic thioethers described in U.S. Pat. Nos. 3,271,157, 3,531,289, and 3,574,628, JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) ammonia and (f) thiocyanates.

Thiocyanates, ammonia and tetramethylthiourea can be mentioned as especially preferred silver halide solvents. The amount of added solvent, although varied depending on the type thereof, is, if thiocyanate is use, preferably in the range of $1\times10^{-4}$ to $1\times10^{-2}$ mol per mol of silver halide.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, hexa-coordinated complex salt, or tetra-coordinated complex salt. Examples are $CdBr_2$, $CdCl_2$, $Cd(NO_3)_2$, $Pb(NO_3)_2$, $Pb(CH_3COO)_2$, $K_4[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se and Te, cyanate, thiocyanate, selenocyanate, carbonate, phosphate, or acetate may be present.

The silver halide grains of the present invention can be subjected to at least one of chalcogen sensitization such as sulfur sensitization, selenium sensitization and tellurium sensitization, noble metal sensitization such as gold sensitization and palladium sensitization, and reduction sensitization, in a desired step in the process for preparation of the silver halide emulsion. Two or more kinds of sensitization are preferably used in combination. Various types of emulsion can be prepared according to in which step chemical sensitization is performed. The types include a type in which a chemical sensitizing core is embedded in each grain, a type in which a chemical sensitizing core is embedded in a position close to a surface of each grain, and a type in which a chemical sensitizing core is formed on a surface of each grain. The location of a chemical sensitizing core of the emulsion which can be used for the photosensitive material of the present invention can be selected according to the object. Generally, preferable is the case where at least one kind of chemical sensitizing core is formed in the vicinity of a surface of each grain.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. Chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for silver halide emulsions used in the present invention. The amount of gold sensitizer is preferably $1\times10^{-4}$ to $1\times10^{-7}$ mol, and more preferably, $1\times10^{-5}$ to $5\times10^{-7}$ mol. A preferred amount of palladium compound is $1\times10^{-3}$ to $5\times10^{-7}$ mol. A preferred amount of thiocyan compound or selenocyan compound is $5\times10^{-2}$ to $1\times10^{-6}$ mol.

The amount of sulfur sensitizer used for silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is favored sensitizing methods for silver halide emulsions of the present invention. Known labile selenium compounds are used in selenium sensitization. Practical examples of selenium compounds are colloidal metal selenium, selenoureas (e.g., N,N-dimethylselenourea and N,N-diethylselenourea), selenoketones, and selenoamides. It is sometimes favorable to perform selenium sensitization in combination with one or both of sulfur sensitization and noble metal sensitization.

Photographic emulsions used in the present invention are preferably subjected to spectral sensitization by methine dyes and the like in order to achieve the effects of the present invention. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. Any nucleus commonly used as a basic heterocyclic nucleus in cyanine dyes can be applied to these dyes. Examples of an applicable nucleus are a pyrroline nucleus, oxazoline nucleus, thiozoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B-43-4936, JP-B-53-12375, JP-A-52-110618, and JP-A-52-109925.

Emulsions can contain, in addition to the sensitizing dyes, dyes having no spectral sensitizing effect or substances not essentially absorbing visible light and presenting supersensitization.

The sensitizing dyes can be added to an emulsion at any point in the preparation of an emulsion, which is conventionally known to be useful. Most ordinarily, the addition is performed after the completion of chemical sensitization and before coating. However, it is possible to perform the addition at the same timing as the addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before the completion of the formation of a silver halide grain precipitation to start spectral sensitization. Alternatively, as disclosed in U.S. Pat. No. 4,225,666, these compounds can be added separately; a portion of the compounds is added prior to chemical sensitization, while the remaining portion is added after that. That is, the compounds can be added at any timing during the formation of silver halide grains, including the method disclosed in U.S. Pat. No. 4,183,756.

The addition amount of the sensitizing dye is preferably $4\times10^{-6}$ to $8\times10^{-3}$ mol per mol of silver halide. When the silver halide grains preferably have a grain size of 0.2 to 1.2 μm, it is effective that the addition amount is about $5\times10^{-5}$ to $2\times10^{-3}$ mol.

The present invention is also preferably used in combination with the technique of increasing a light absorption with a spectral sensitizing dye. The multilayer adsorption can be effected by, for example, the method of effecting adsorption of sensitizing dyes on the surface of silver halide grains in an amount greater than monolayer saturated coating amount by the use of intermolecular force, or the method of effecting adsorption on silver halide grains of a dye consisting of two or more separate nonconjugated dye chromophores coupled with each other through covalent bond, known as coupled dye. The particulars thereof are described in the following patents relating to multilayer adsorption.

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173 and 2001-350442, and EP's 985965A, 985964A, 985966A, 985967A, 1085372A, 1085373A, 1172688A, 1199595A and 887700A1.

Moreover, the present invention is preferably used in combination with techniques described in JP-A's-10-239789, 2001-75222 and 10-171058.

It is preferable to use an oxidizer for silver during the process of producing emulsions used in the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones. It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The silver halide color photosensitive material of the invention can provide one layer or more of photosensitive layers on a support. Further, photosensitive layers can be provided not only one side of the support, but also on both sides. The photosensitive material of the invention can be used as a black and white silver halide photosensitive material (for example, an X-ray sensitive material, a lith type sensitive material, a negative film for photographing black and white, etc.) and a color photosensitive material (for example, a negative color film, a color solarization film, a color paper etc.). Moreover, it can be also used for a photosensitive material for diffusion transfer (for example, a color diffusion transfer element and a silver salt diffusion transfer element), a thermal development photosensitive material (black and white, color) and the like.

The silver halide color photosensitive material will be described in detail below, which however naturally in no way limit the scope of the invention.

The silver halide color photosensitive material of the present invention is only required to have at least one light-sensitive layer selected from a Blue-sensitive layer, a Green-sensitive layer and a red-sensitive layer. The number of layers and the order of arrangement thereof are not particularly limited. Typical example thereof is a silver halide photosensitive material having at least one light-sensitive unit layer comprising a plural of silver halide emulsion layers each having the substantially the same color sensitivity but different in speed. The light-sensitive unit layer is a unit layer having color sensitivity to any one of blue light, green light and red light. In a multi-layered silver halide color photosensitive material, the arrangement of the unit layer is generally, in the order, from a support, of a red-sensitive layer. However, the arrangement order may be reversed depending on the purpose of the photographic material.

A non lightsensitive layer can be formed between the silver halide lightsensitive layers and as the uppermost layer and the lowermost layer.

These intermediate layers may contain, e.g., couplers and DIR compounds such as those described in JP-A's-61-43748, 59-113438, 59-113440, 61-20037 and 61-20038. Color-mixing prevention agents may also be contained, as is usually used.

As for a plurality of silver halide emulsion layers constituting respective unit lightsensitive layer, a two-layered structure of high- and Low-speed emulsion layers can be preferably used in this order so as to the speed becomes lower toward the support as described in West German Patent 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a Low-speed emulsion layer is formed farther from a support and a High-speed layer is formed closer to the support.

More specifically, layers can be arranged from the farthest side from a support in the order of Low-speed Blue-sensitive layer (BL)/High-speed Blue-sensitive layer (BH)/High-speed Green-sensitive layer (GH)/Low-speed Green-sensitive layer (GL)/High-speed red-sensitive layer (RH)/Low-speed red-sensitive layer (RL), the order of BH/BL/GL/GH/RH/RL or the order of BH/BL/GH/GL/RL/RH.

In addition, as described in JP-B-55-34932, the disclosure of which is incorporated herein by reference, layers can be arranged from the farthest side from a support in the order of Blue-sensitive layer/GH/RH/GL/RL. Furthermore, as described in JP-A's-56-25738 and 62-63936, the disclosures of which are incorporated herein by reference, layers can be arranged from the farthest side from a support in the order of Blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/High-speed emulsion layer/Low-speed emulsion layer from the farthest side from a support in a layer sensitive to one color as described in JP-A-59-202464, the disclosure of which is incorporated herein by reference.

In addition, the order of High-speed emulsion layer/Low-speed emulsion layer/medium-speed emulsion layer or Low-speed emulsion layer/medium-speed emulsion layer/High-speed emulsion layer can be adopted. Furthermore, the arrangement can be changed as described above even when four or more layers are formed.

A variety of layer constitutions and layer arrangements can be effected accordance with the intended use.

Although the several different additives described above are used in a light-sensitive material according to this technique, a variety of other additives can also be used in accordance with the intended use.

These additives are described in more detail in Research Disclosures Item 17643 (December, 1978), Item 18716 (November, 1979), and Item 308119 (December, 1989), the disclosures of which are incorporated herein by reference. The corresponding portions are summarized in a table below.

| | Additives | RD17643 | RD18716 |
|---|---|---|---|
| 1. | Chemical sensitizers | page 23 | page 648, right column |

-continued

| | Additives | RD17643 | RD18716 |
|---|---|---|---|
| 2. | Sensitivity increasing agents | | do |
| 3. | Spectral sensitizers, super sensitizers | pages 23-24 | page 648, right column to page 649, right column |
| 4. | Brighteners | page 24 | page 647, right column |
| 5. | Antifoggants and stabilizers | pages 24-25 | page 649, right column |
| 6. | Light absorbents, filter dyes, ultraviolet absorbents | pages 25-26 | page 649, right column to page 650, left column |
| 7. | Stain preventing agents | page 25, right column | page 650, left to right columns |
| 8. | Dye image stabilizers | page 25 | |
| 9. | Hardening agents | page 26 | page 651, left column |
| 10. | Binders | page 26 | do |
| 11. | Plasticizers, lubricants | page 27 | page 650, right column |
| 12. | Coating aids, surface active agents | pages 26-27 | do |
| 13. | Antistatic agents | page 27 | do |
| 14. | Matting agents | | |

| | Additives | RD308119 |
|---|---|---|
| 1. | Chemical sensitizers | page 996 |
| 2. | Sensitivity increasing agents | |
| 3. | Spectral sensitizers, super sensitizers | page 996, right column to page 998, right column |
| 4. | Brighteners | page 998, right column |
| 5. | Antifoggants and stabilizers | page 998, right column to page 1,000, right column |
| 6. | Light absorbents, filter dyes, ultraviolet absorbents | page 1,003, left to right columns |
| 7. | Stain preventing agents | page 1,002, right column |
| 8. | Dye image stabilizers | page 1,002, right column |
| 9. | Hardening agents | page 1,004, right column to page 1,005, left column |
| 10. | Binders | page 1,003, right column to page 1,004, right column |
| 11. | Plasticizers, lubricants | page 1,006, left to right columns |
| 12. | Coating aids, surface active agents | page 1,005, left column to page 1,006, left column |
| 13. | Antistatic agents | page 1,006, right column to page 1,007, left column |
| 14. | Matting agents | page 1,008, left column to page 1,009, left column |

In order to prevent deterioration in photographic properties caused by formaldehyde gas, a compound described in U.S. Pat. Nos. 4,411,987 or 4,435,503, which can react with and fix formaldehyde, is preferably added to a light-sensitive material.

Further, the present invention is preferably used in combination with compounds each having a heteroatom capable of exerting sensitivity enhancing effects. With respect to the practical compounds and the method of using thereof, it is preferable to add the compound described in JP-A-2003-156823, the disclosure of which is herein incorporated by reference, e.g. compound (B), with reference to the process as described in the publication.

Various color couplers can be used in the present invention, and specific examples of these couplers are described in patents described in above-mentioned RD No. 17643, VII-C to VII-G and No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patent Nos. 1,425,020 and 1,476,760, U.S. Pat. Nos. 3,973,968, 4,314,023, and 4,511,649, and European Patent No. 249,473A.

Examples of a magenta coupler are preferably 5-pyrazolone and pyrazoloazole compounds, and more preferably, compounds described in, e.g., U.S. Pat. Nos. 4,310,619 and 4,351,897, European Patent No. 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO88/04795.

Examples of a cyan coupler are phenol and naphthol couplers, preferably those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,211, 4,367,282, 4,409,320, and 4,576,910, British Patent No. 2,102,137, and European Patent No. 341,188A.

Preferred examples of a coupler capable of forming colored dyes having proper diffusibility are those described in U.S. Pat. No. 4,366,237, British Patent No. 2,125,570, European Patent No. 96,570, and West German Patent (Publication) No. 3,234,533.

Preferred examples of a colored coupler for correcting unnecessary absorption of a colored dye are those described in RD No. 17643, VII-G and No. 307105, VII-G, U.S. Pat. No. 4,163,670, JP-B-57-39413, U.S. Pat. Nos. 4,004,929 and 4,138,258, and British Patent No. 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 can be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Favored examples of a coupler for imagewise releasing a nucleating agent or a development accelerator are described in British Patent Nos. 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with the oxidation product of a developing agent.

Examples of other couplers which can be used in a light-sensitive material of the present invention are competing couplers described in, e.g., U.S. Pat. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in European Patent Nos. 173,302A and 313,308A; bleaching accelerator releasing couplers described in, e.g., RD. Nos. 11449 and 24241 and JP-A-61-201247; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

Couplers for use in the present invention can be added to a light-sensitive material by various known dispersion methods.

Examples of a high-boiling organic solvent to be used in an oil-in-water dispersion method are described in, e.g., U.S. Pat. No. 2,322,027 and JP-A-2003-149776.

Examples of a high-boiling organic solvent having a boiling point of 175° C. or more at atmospheric pressure to be used in the oil-in-water dispersion method are phthalic esters (e.g., dibutylphthalate, dicyclohexylphthalate, di-2-ethylhexylphthalate, decylphthalate, bis(2,4-di-tert-amylphenyl) phthalate, bis(2,4-di-tert-amylphenyl)isophthalate, and bis (1,1-diethylpropyl)phthalate); phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate); benzoates (e.g., 2-ethylhexylbenzoate, dodecylbenzoate, and 2-ethylhexyl-p-hydroxybenzoate); amides (e.g., N,N-diethyldodecaneamide, N,N-diethyllaurylamide, and N-tetradecylpyrrolidone); alcohols or phenols (e.g., isostearylalcohol and 2,4-di-tert-amylphenol); aliphatic carboxylates (e.g., bis(2-ethylhexyl)sebacate, dioctylazelate, glyceroltributylate, isostearyllactate, and trioctylcitrate); an aniline derivative (e.g., N,N-dibutyl-2-butoxy-5-tert-octylaniline); and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

The steps and effects of a latex dispersion method and examples of an impregnating latex are described in, e.g., U.S. Pat. No. 4,199,363 and West German Patent Application (OLS) Nos. 2,541,274 and 2,541,230.

Phenethyl alcohol and various types of an antiseptic agent or a mildewproofing agent are preferably added to a color light-sensitive material of the present invention. Examples of the antiseptic agent and the mildewproofing agent are 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for general purposes or motion pictures, a color reversal film for slides or television, color paper, a color positive film, and color reversal paper. The present invention is also particularly preferably usable as a color dupe film.

A support which can be suitably used in the present invention is described in, e.g., RD. No. 17643, page 28, RD. No. 18716, from page 647, right column to page 648, left column, and RD. No. 307105, page 879.

In a light-sensitive material of the present invention, the sum total of film thicknesses of all hydrophilic colloidal layers on the side having emulsion layers is preferably 28 μm or less, more preferably, 23 μm or less, further preferably, 18 μm or less, and most preferably, 16 μm or less. A film swell speed $T_{1/2}$ is preferably 30 sec or less, and more preferably, 20 sec or less. The film thickness means a film thickness measured under moisture conditioning at a temperature of 25° C. and a relative humidity of 55% (two days). The film swell speed $T_{1/2}$ can be measured in accordance with a known method in this field of art. For example, the film swell speed $T_{1/2}$ can be measured by using a swell meter described in Photogr. Sci Eng., A. Green et al., Vol. 19, No. 2, pp. 124-129. When 90% of a maximum swell film thickness reached by performing processing by using a color developing agent at 30° C. for 3 min and 15 sec is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating.

In a light-sensitive material of the present invention, hydrophilic colloid layers (called back layers) having a total dried film thickness of 2 to 20 μm are preferably formed on the side of a support away from the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

A color photographic light-sensitive material according to the present invention can be developed by conventional methods described in RD. No. 17643, pp. 28-29, RD. No. 18716, p. 651, the left to right column, and RD No. 307105, pp. 880-881.

A color developer used in the development of a light-sensitive material of the present invention is preferably an aqueous alkaline solution mainly consisting of an aromatic primary amine-based color developing agent. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylan iline, 3-methyl-4-amino-N-ethyl-β-methoxyethylaniline, and sulfates, hydrochlorides, and p-toluenesulfonates thereof. Of these compounds, sulfate of 3-methyl-4-amino-N-ethyl-N-β-hydroxyethylaniline is most preferred. Two or more types of these compounds can be used jointly in accordance with the application.

In general, the color developer contains a pH buffering agent such as a carbonate, a borate, or a phosphate of an alkali metal, and a development restrainer or an antifoggant such as a bromide, an iodide, benzimidazoles, benzothiazoles, or a mercapto compound. If necessary, the color developer can also contain a preservative such as hydroxylamine, diethylhydroxylamine, a sulfite, hydrazines such as N,N-biscarboxymethylhydrazine, phenylsemicarbazides, triethanolamine, or catechol sulfonic acids; an organic solvent such as ethyleneglycol or diethyleneglycol; a development accelerator such as benzylalcohol, polyethyleneglycol, a quaternary ammonium salt, or amines; a dye forming coupler, a competing coupler, and an auxiliary developing agent such as 1-phenyl-3-pyrazolidone; a viscosity imparting agent; and various chelating agents represented by aminopolycarboxylic acid, aminopolyphosphonic acid, alkylphosphonic acid, and phosphonocarboxylic acid. Representative examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts of these acids.

In order to perform reversal development, black-and-white development is usually performed and then color development is performed.

As a black-and-white developer, well-known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in combination. The pH of the color and black-and-white developers is generally 9 to 12. Although the replenishment rate of these developers depends on a color photographic light-sensitive material to be processed, it is generally 3 liters (liters will be also referred to as "L" hereinafter) or less per $m^2$ of a light-sensitive material. The replenishment rate can be decreased to 500 milliliters (milliliters will be also referred to as "mL" hereinafter) or less by decreasing a bromide ion concentration in the replenisher. In order to decrease the replenishment rate, the area of contact of a processing solution with air is preferably decreased to prevent evaporation and air oxidation of the solution.

The area of contact of a photographic processing solution with air in a processing tank can be represented by an aperture rate defined below:

Aperture rate=[area ($cm^2$) of contact of processing solution with air]÷[volume ($cm^3$) of processing solution]

The above aperture rate is preferably 0.1 or less, and more preferably, 0.001 to 0.05. In order to reduce the aperture rate, a shielding member such as a floating cover can be placed on the liquid surface of the photographic processing solution in the processing tank. In addition, a method of using a movable cover described in JP-A-1-82033 or a slit developing method descried in JP-A-63-216050 can be used. The aperture is preferably reduced not only in color and black-and-white development steps but also in all subsequent steps, e.g., bleaching, bleach-fixing, fixing, washing, and stabilizing steps. In addition, the replenishment rate can be reduced by using a means of suppressing storage of bromide ions in the developing solution.

The color development time is normally two to five minutes. The processing time, however, can be shortened by setting high temperature and high pH and using the color developing agent at high concentration.

A photographic emulsion layer is generally subjected to bleaching after color development. Bleaching can be performed either simultaneously with fixing (bleach-fixing) or independently thereof. In addition, in order to increase the processing speed, bleach-fixing can be performed after bleaching. Also, the processing can be performed in a bleach-fixing bath having two continuous tanks, fixing can be performed before bleach-fixing, or bleaching can be performed after bleach-fixing, in accordance with the application. Examples of the bleaching agent are a compound of a multivalent metal such as iron(III), peroxides (in particular, soda persulfate is suited to color negative motion picture films), quinones, and a nitro compound. Typical examples of the bleaching agent are organic complex salts of iron(III), e.g., complex salts of aminopolycarboxylic acids such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid, and complex salts of citric acid, tartaric acid, and malic acid. Of these compounds, iron (III) complex salts of aminopolycarboxylic acid such as iron (III) complex salts of ethylenediaminetetraacetic acid and 1,3-diaminopropanetetraacetic acid are preferred because they can increase the processing speed and prevent environmental contamination. The iron(III) complex salt of aminopolycarboxylic acid is particularly useful in both the bleaching and bleach-fixing solutions. The pH of the bleaching or bleach-fixing solution using the iron(III) complex salt of aminopolycarboxylic acid is normally 4.0 to 8. In order to increase the processing speed, however, the processing can be performed at lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-18426, and RD No. 17129 (July, 1978); a thiazolidine derivative described in JP-A-51-140129; thiourea derivatives described in JP-B-45-8506, JP-A-52-20832, JP-A-53-32735, and U.S. Pat. No. 3,706,561, and iodide salts described in West German Patent No. 1,127,715 and JP-A-58-16235; polyoxyethylene compounds descried in West German Patent Nos. 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and bromide ion. Of these compounds, a compound having a mercapto group or a disulfide group is preferable since the compound has a large accelerating effect. In particular, compounds described in U.S. Pat. No. 3,893,858, West German Patent No. 1,290,812, and JP-A-53-95630 are preferred. Compounds described in U.S. Pat. No. 4,552,884 are also preferred. These bleaching accelerators can be added to a light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent bleaching stains. The most preferable organic acid is a compound having an acid dissociation constant (pKa) of 2 to 5, e.g., acetic acid, propionic acid, or hydroxy acetic acid.

Examples of the fixing agent and the bleach-fixing agent are thiosulfate, thiocyanate, a thioether-based compound, thioureas, and a large amount of iodide salt. Of these compounds, the use of thiosulfate is common, and especially ammonium thiosulfate can be used in the widest range of applications. In addition, a combination of thiosulfate and, e.g., thiocyanate, a thioether-based compound, or thiourea is preferably used. As a preservative of the fixing solution or the bleach-fixing solution, sulfite, bisulfite, a carbonyl bisulfite adduct, or a sulfinic acid compound described in EP 294,769A is preferred. Furthermore, in order to stabilize the fixing solution or the bleach-fixing solution, various types of aminopolycarboxylic acids or organic phosphonic acids are preferably added to the solution.

In the present invention, 0.1 to 10 mol/L of a compound having a pKa of 6.0 to 9.0 are preferably added to the fixing solution or the bleach-fixing solution in order to adjust the pH. It is preferable to add 0.1 to 10 mols/L of imidazoles such as imidazole, 1-methylimidazole, 1-ethylimidazole, and 2-methylimidazole.

The total time of a desilvering step is preferably as short as possible provided that no desilvering defect occurs. The time is preferably one to three minutes, and more preferably, one to two minutes. A processing temperature is 25° C. to 50° C., and preferably, 35° C. to 45° C. Within the preferable temperature range, the desilvering speed is increased, and the generation of stains after the processing can be effectively prevented.

In the desilvering step, stirring is preferably as strong as possible. Examples of a method of strengthening stirring are a method of colliding a jet stream of the processing solution against the emulsion surface of a light-sensitive material described in JP-A-62-183460, and a method of increasing the stirring effect using rotating means described in JP-A-62-183461. Other examples are a method of moving a light-sensitive material while the emulsion surface is brought into contact with a wiper blade placed in a solution to cause disturbance on the emulsion surface, thereby improving the stirring effect, and a method of increasing the circulating flow amount in an overall processing solution. Such a stirring improving means is effective in any of the bleaching solution, the bleach-fixing solution, and the fixing solution. Improving stirring presumably accelerates the supply of the bleaching agent and the fixing agent into an emulsion film to thereby increase the desilvering rate. The above stirring improving means is more effective when the bleaching accelerator is used, i.e., this means can significantly increase the accelerating effect or eliminate fixing interference caused by the bleaching accelerator.

An automatic processor for processing a light-sensitive material of the present invention preferably has a light-sensitive material conveyor means described in JP-A-60-191257, JP-A-60-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially the processing time of each processing step and reduces the replenishment rate of a processing solution.

A silver halide color photographic light-sensitive material of the present invention is normally subjected to a washing step and/or a stabilizing step after desilvering. The amount of water used in the washing step can be arbitrarily determined over a broad range in accordance with the properties (e.g., a property determined by a material used such as a coupler) of the light-sensitive material, the application of the material, the temperature of the water, the number of water tanks (the number of stages), a replenishing method such as a counter or forward current, and other diverse conditions. The relationship between the amount of water and the number of water tanks in a multi-stage counter-current method can be obtained by a method described in "Journal of the Society of Motion Picture and Television Engineering", Vol. 64, pp. 248-253 (May, 1955).

According to the above-described multi-stage counter-current method, the amount of water used for washing can be greatly decreased. Since washing water stays in the tanks for a long period of time, however, bacteria multiply and floating substances stick to a light-sensitive material. In order to solve this problem in the processing of a color light-sensitive material of the present invention, a method of decreasing calcium and magnesium ions described in JP-A-62-288838 can be very effectively used. It is also possible to use an isothiazolone compound, cyabendazoles, and a chlorine-based germicide such as chlorinated sodium isocyanurate described in JP-A-57-8542, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing a light-sensitive material of the present invention is 4 to 9, preferably 5 to 8. The water temperature and the washing time can vary in accordance with the properties and applications of a light-sensitive material. Normally, the washing time is 20 sec to 10 min at a temperature of 15° C. to 45° C., preferably 30 sec to 5 min at 25° C. to 40° C. A light-sensitive material of the present invention can be processed directly by a stabilizing agent in place of washing. All known methods described in JP-A-57-8543, JP-A-58-14834, and JP-A-60-220345 can be used in such a stabilizing process.

Stabilizing is sometimes performed subsequently to washing. An example is a stabilizing bath containing a dye stabilizing agent and a surface-active agent to be used as a final bath of a color light-sensitive material for photography. Examples of the dye stabilizing agent are aldehydes such as formalin and glutaraldehyde, an N-methylol compound, hexamethylenetetramine, and an aldehyde sulfurous acid adduct. Various chelating agents or antifungal agents can be added to the stabilizing bath.

An overflow solution produced upon washing and/or replenishment of the stabilizing solution can be reused in another step such as a desilvering step.

In processing using an automatic processor or the like, if each processing solution described above is condensed by evaporation, water is preferably added to correct the condensation.

A silver halide color photographic light-sensitive material of the present invention can contain a color developing agent in order to simplify the processing and increase the processing speed. For this purpose, various types of precursors of the color developing agent can be preferably used. Examples of the precursor are indoaniline-based compounds described in U.S. Pat. No. 3,342,597, e.g., Schiff base compounds described in U.S. Pat. No. 3,342,599 and RD Nos. 14,850 and 15,159, aldol compounds described in RD No. 13,924, metal salt complexes described in U.S. Pat. No. 3,719,492, and urethane-based compounds described in JP-A-53-135628.

A silver halide color light-sensitive material of the present invention can contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing can be accelerated at higher temperatures to shorten the processing time, or the image quality or the stability of a processing solution can be improved at lower temperatures.

A silver halide light-sensitive material of the present invention can be applied to thermal development light-sensitive materials described in, e.g., U.S. Pat. No. 4,500,626, JP-A-60-133449, JP-A-59-218443, JP-A-61-238056, and European Patent No. 210,660A2.

When a silver halide color photographic light-sensitive material of the present invention is applied to a film unit with lens, such as described in JP-B-2-32615 or Jpn. UM Appln. KOKOKU Publication No. 3-39784, the effects of the present invention can be achieved more easily.

The magnetic recording layer for use in the present invention will be described below.

The magnetic recording layer preferably used in the present invention is obtained by coating on a support with a water-base or organic solvent coating liquid having magnetic material grains dispersed in a binder.

Suitable magnetic material grains can be composed of any of ferromagnetic iron oxides such as γ $Fe_2O_3$, Co coated γ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated γ $Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$.

The saturation magnetization (σ s) of the ferromagnetic material preferably ranges from $3.0\times10^4$ to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A's-4-259911 and 5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins preferably ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyalcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 μm, preferably 0.2 to 5 μm, and more preferably from 0.3 to 3 μm. The weight ratio of magnetic material grains to binder is preferably in the range of 0.5:100 to 60:100, more preferably 1:100 to 30:100. The coating amount of magnetic material grains ranges from 0.005 to 3 $g/m^2$, preferably from 0.01 to 2 $g/m^2$, and more preferably from 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as that of the magnetic recording layer. The photosensitive material having the magnetic recording layer is described in U.S. Pat. Nos. 5,336,589, 5,250,404, 5,229,259, and 5,215,874 and EP No. 466,130.

The polyester support for preferred use in the present invention will be described below. Particulars thereof together with the below mentioned photosensitive material, processing, cartridge and working examples are specified in Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol % are especially preferred. Polyethylene 2,6-naphthalate is most preferred. The average molecular weight thereof ranges from approximately 5,000 to 200,000. The Tg of the polyester of the present invention is preferably at least 50° C., more preferably at least 90° C.

The polyester support is preferably subjected to heat treatment at a temperature of from 40° C. to less than Tg, more preferably from Tg minus 20° C. to less than Tg, in order to suppress curling. This heat treatment may be conducted at a temperature held constant within the above temperature range or may be conducted while cooling. The period of heat treatment preferably ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

Next, in the present invention, a surface treatment is preferably conducted for bonding a support and a photosensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

Next, the subbing layer may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 μm) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of $10^7$ Ω·cm or less, preferably $10^5$ Ω·cm or less, and having a grain size of 0.001 to 1.0 μm or a composite oxide thereof (Sb, P, B. In, S, Si, C, etc.) and fine grains of sol form metal oxides or composite oxides thereof.

The content thereof in the photosensitive material is preferably in the range of 5 to 500 mg/m$^2$, more preferably 10 to 350 mg/m$^2$. The ratio of amount of conductive crystalline oxide or composite oxide thereof to binder is preferably in the range of 1/300 to 100/1, more preferably 1/100 to 100/5.

It is preferred that the photosensitive material of the present invention have lubricity. The lubricant containing layer is preferably provided on both the lightsensitive layer side and the back side. Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the photosensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 μm. Narrow grain size distribution thereof is preferred, and it is desired that at least 90% of the whole number of grains be included in the range of 0.9 to 1.1 times the average grain size. Moreover, for enhancing the mat properties, it is preferred that fine grains of 0.8 μm or less be simultaneously added, which include, for example, fine grains of polymethyl methacrylate (0.2 μm), poly(methyl methacrylate/methacrylic acid) (9/1 in molar ratio, 0.3 μm), polystyrene (0.25 μm) and colloidal silica (0.03 μm).

A support used in examples of the present invention can be prepared with reference to the process as described in JP-A-2001-281815, the disclosure of which is herein incorporated by reference.

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

A color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z. A color photosensitive film of the present invention is also suited as a film with lens such as Fuji Film FUJICOLOR UTSURUNDESU SUPER SLIM and UTSURUNDESU ACE 800.

A photographed film is printed through the following steps in a miniature laboratory system.

(1) Reception (an exposed cartridge film is received from a customer)
(2) Detaching step (the film is transferred from the cartridge to an intermediate cartridge for development)
(3) Film development
(4) Reattaching step (the developed negative film is returned to the original cartridge)
(5) Printing (prints of three types C, H, and P and an index print are continuously automatically printed on color paper [preferably Fuji Film SUPER FA8])
(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferred. Examples of a film processor for the MINI-LAB CHAMPION are the FP922AL, FP562B, FP562B,AL, FP362B, and FP362B,AL, and recommended processing chemicals are the FUJICOLOR JUST-IT CN-16L and CN-16Q. Examples of a printer processor are the PP3008AR, PP3008A, PP1828AR, PP1828A, PP1258AR, PP1258A, PP728AR, and PP728A, and a recommended processing chemicals are the FUJICOLOR JUST-IT CP-47L and CP-40FAII.

In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35 mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy disk, Zip disk, CR-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

Examples of the present invention will be described below. However, the present invention is not limited to these examples.

EXAMPLE 1A

The silver halide emulsions Em-A to Em-O listed in Table 1 were prepared with reference to the process for preparing emulsions Em-A to Em-O as described in Example 1 of JP-A-2001-281815.

TABLE 1

| Emulsion name | Average iodide (mol %) | Equivalent-sphere diameter (μm) | Average aspect ratio | Equivalent-circle diameter (μm) | Grain thickness (μm) | Shape |
|---|---|---|---|---|---|---|
| Em-A | 4 | 1.0 | 25 | 2.8 | 0.11 | Tabular |
| Em-B | 5 | 0.7 | 15 | 1.6 | 0.11 | Tabular |
| Em-C | 4.7 | 0.51 | 7 | 0.85 | 0.12 | Tabular |
| Em-D | 1 | 0.51 | 11 | 1.0 | 0.09 | Tabular |
| Em-E | 5 | 1.0 | 25 | 2.8 | 0.11 | Tabular |
| Em-F | 5.5 | 0.75 | 15 | 1.6 | 0.11 | Tabular |
| Em-G | 4.7 | 0.73 | 9.9 | 1.39 | 0.14 | Tabular |
| Em-H | 2.5 | 0.51 | 9 | 0.42 | 0.10 | Tabular |
| Em-I | 1.5 | 0.37 | 9 | 0.67 | 0.074 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.6 | 12 | 3.2 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

In the tabular grains of Table 1, dislocation lines as described in JP-A-3-237450 are observed through a high-voltage electron microscope.

(Preparation of Sample 001A)

Multilayer coating of a cellulose triacetate support was effected with the following compositions, thereby obtaining a color negative film (sample 001A).

(Compositions of Light-sensitive Layers)

The main materials used in the individual layers are classified as follows.

ExC: Cyan coupler UV: Ultraviolet absorbent
ExM: Magenta coupler HBS: High-boiling organic solvent
ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

1st Layer (1st Antihalation Layer)

| | | |
|---|---|---|
| Black colloidal silver | silver | 0.122 |
| Silver iodobromide emulsion of 0.07 μm | silver | 0.01 |
| Gelatin | | 0.919 |
| ExC-1 | | 0.002 |
| ExC-3 | | 0.002 |

-continued

| | |
|---|---|
| Cpd-2 | 0.001 |
| HBS-1 | 0.005 |
| HBS-2 | 0.002 |
| F-8 | 0.001 |

2nd Layer (2nd Antihalation Layer)

| | | |
|---|---|---|
| Black colloidal silver | silver | 0.055 |
| Gelatin | | 0.425 |
| ExF-1 | | 0.002 |
| Solid disperse dye ExF-9 | | 0.120 |

-continued

| | |
|---|---|
| HBS-1 | 0.074 |
| F-8 | 0.001 |

3rd Layer (Interlayer)

| | |
|---|---|
| Cpd-1 | 0.080 |
| HBS-1 | 0.042 |
| Gelatin | 0.300 |

4th Layer (Low-speed Red-sensitive Emulsion Layer)

| | | |
|---|---|---|
| Em-D | silver | 0.577 |
| Em-C | silver | 0.347 |
| ExC-1 | | 0.233 |
| ExC-2 | | 0.026 |
| ExC-3 | | 0.129 |
| ExC-4 | | 0.155 |
| ExC-5 | | 0.029 |
| ExC-6 | | 0.013 |
| Cpd-2 | | 0.025 |
| Cpd-4 | | 0.025 |
| ExC-8 | | 0.050 |
| HBS-1 | | 0.114 |

-continued

| | |
|---|---|
| HBS-5 | 0.038 |
| Gelatin | 1.474 |

5th Layer (Medium-speed Red-sensitive Emulsion Layer)

| | | |
|---|---|---|
| Em-B | silver | 0.731 |
| Em-C | silver | 0.181 |
| ExC-1 | | 0.154 |
| ExC-2 | | 0.037 |
| ExC-3 | | 0.018 |
| ExC-4 | | 0.103 |
| ExC-5 | | 0.037 |
| ExC-6 | | 0.050 |
| Cpd-2 | | 0.036 |
| Cpd-4 | | 0.028 |
| Cpd-6 | | 0.060 |
| ExC-7 | | 0.010 |
| HBS-1 | | 0.129 |
| Gelatin | | 1.086 |

6th Layer (High-speed Red-sensitive Emulsion Layer)

| | | |
|---|---|---|
| Em-A | silver | 0.630 |
| ExC-1 | | 0.072 |
| ExC-3 | | 0.035 |
| ExC-10 | | 0.080 |
| Cpd-2 | | 0.064 |
| Cpd-4 | | 0.077 |
| Cpd-6 | | 0.060 |
| ExC-7 | | 0.040 |
| HBS-1 | | 0.329 |
| HBS-2 | | 0.120 |
| Gelatin | | 1.245 |

7th Layer (Interlayer)

| | |
|---|---|
| Cpd-1 | 0.094 |
| Cpd-7 | 0.369 |
| Solid disperse dye ExF-4 | 0.030 |
| HBS-1 | 0.049 |
| Polyethylacrylate latex | 0.088 |
| Gelatin | 0.886 |

8th Layer (Layer for Donating Interlayer Effect to Red-Sensitive Layer)

| | | |
|---|---|---|
| Em-J | silver | 0.240 |
| Em-K | silver | 0.100 |
| Cpd-4 | | 0.030 |
| ExM-2 | | 0.057 |
| ExM-3 | | 0.016 |
| ExM-4 | | 0.051 |
| ExY-1 | | 0.008 |
| ExY-6 | | 0.042 |
| ExC-9 | | 0.011 |
| HBS-1 | | 0.090 |
| HBS-3 | | 0.003 |
| HBS-5 | | 0.030 |
| Gelatin | | 0.610 |

9th Layer (Low-speed Green-sensitive Emulsion Layer)

| | | |
|---|---|---|
| Em-H | silver | 0.200 |
| Em-G | silver | 0.120 |
| Em-I | silver | 0.230 |
| ExM-6 | | 0.380 |
| ExM-3 | | 0.047 |
| ExC-11 | | 0.020 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |

10th Layer (Medium-speed Green-sensitive Emulsion Layer)

| | | |
|---|---|---|
| Em-F | silver | 0.336 |
| ExM-2 | | 0.049 |
| ExM-3 | | 0.035 |
| ExM-4 | | 0.014 |
| ExY-1 | | 0.003 |
| ExY-5 | | 0.006 |
| ExC-6 | | 0.007 |
| ExC-8 | | 0.010 |
| ExC-9 | | 0.012 |
| HBS-1 | | 0.065 |
| HBS-3 | | 0.002 |
| HBS-5 | | 0.020 |
| Cpd-5 | | 0.004 |
| Gelatin | | 0.446 |

11th Layer (High-speed Green-sensitive Emulsion Layer)

| | | |
|---|---|---|
| Em-E | silver | 0.356 |
| Em-G | silver | 0.144 |
| ExC-7 | | 0.010 |
| ExM-1 | | 0.022 |
| ExM-2 | | 0.045 |
| ExM-3 | | 0.014 |
| ExM-4 | | 0.010 |
| ExM-5 | | 0.010 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethylacrylate latex | | 0.099 |
| Gelatin | | 0.939 |

12th Layer (Yellow Filter Layer)

| | |
|---|---|
| Cpd-1 | 0.094 |
| Solid disperse dye ExF-2 | 0.150 |
| Solid disperse dye ExF-5 | 0.010 |
| Oil-soluble dye ExF-7 | 0.010 |
| HBS-1 | 0.049 |
| Gelatin | 0.630 |

13th Layer (Low-speed Blue-sensitive Emulsion Layer)

| | | |
|---|---|---|
| Em-O | silver | 0.060 |
| Em-M | silver | 0.404 |
| Em-N | silver | 0.076 |
| ExC-1 | | 0.048 |

-continued

| | |
|---|---|
| ExY-1 | 0.012 |
| ExY-2 | 0.350 |
| ExY-6 | 0.060 |
| ExY-7 | 0.300 |
| ExC-9 | 0.012 |
| Cpd-2 | 0.100 |
| Cpd-3 | 0.004 |
| HBS-1 | 0.222 |
| HBS-5 | 0.074 |
| Gelatin | 2.058 |

14th Layer (High-speed Blue-sensitive Emulsion Layer)

| | |
|---|---|
| Em-L | silver 0.464 |
| ExY-2 | 0.100 |
| ExY-7 | 0.100 |
| Cpd-2 | 0.075 |
| Cpd-3 | 0.001 |
| HBS-1 | 0.071 |
| Gelatin | 0.678 |

15th Layer (1st Protective Layer)
Silver iodobromide emulsion of 0.07 μm

| | |
|---|---|
| Silver iodobromide emulsion of 0.07 μm | silver 0.280 |
| UV-1 | 0.100 |
| UV-2 | 0.060 |
| UV-3 | 0.095 |
| UV-4 | 0.013 |
| UV-5 | 0.200 |
| F-11 | 0.009 |
| S-1 | 0.086 |
| HBS-1 | 0.175 |
| HBS-4 | 0.050 |
| Gelatin | 1.984 |

16th Layer (2nd Protective Layer)

| | |
|---|---|
| H-1 | 0.400 |
| B-1 (diameter 1.7 μm) | 0.050 |

-continued

| | |
|---|---|
| B-2 (diameter 1.7 μm) | 0.150 |
| B-3 | 0.050 |
| S-1 | 0.200 |
| Gelatin | 0.750 |

In addition to the above components, to improve the storage stability, processability, resistance to pressure, antiseptic and mildewproofing properties, antistatic properties, and coating properties, the individual layers contained W-1 to W-9, B-4 to B-6, F-1 to F-17, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total | 7.210 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid fine-grain dispersion. The average grain size of the fine dye grains was 0.29 μm.

Following the same procedure as above, solid dispersions of ExF-4 and ExF-9 were obtained. The average grain sizes of the fine dye grains were 0.28 μm and 0.49 μm, respectively. ExF-5 was dispersed by a microprecipitation dispersion method described in Example 1 of EP 549,489A. The average grain size was found to be 0.06 μm.

Compounds used in the formation of each layer were as follows.

ExC-1

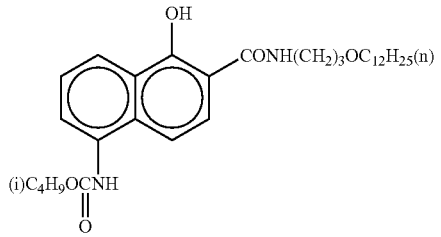

-continued
ExC-2
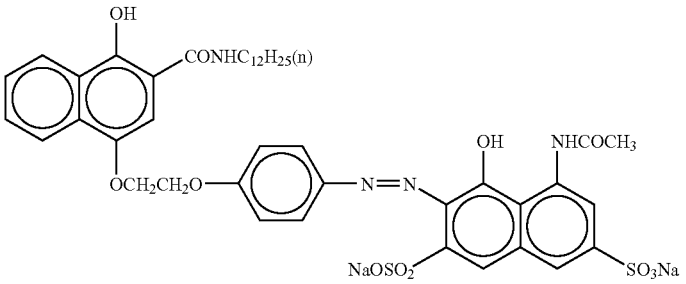
ExC-3
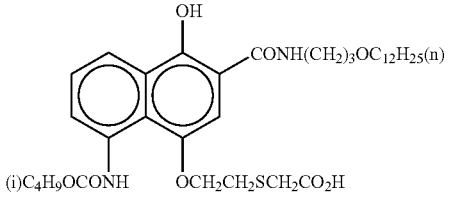
ExC-4
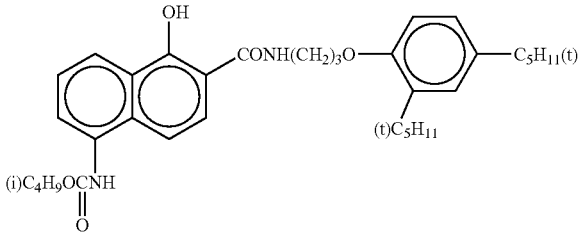
ExC-5
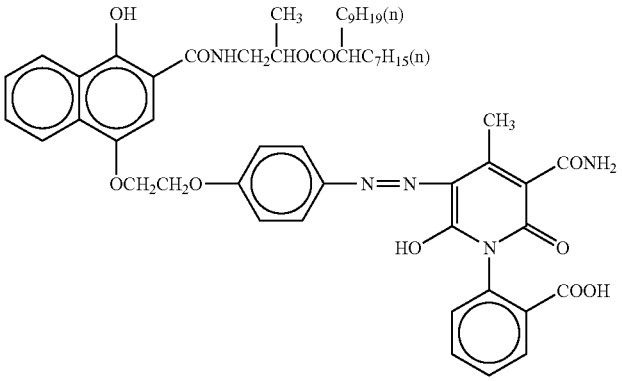
ExC-6
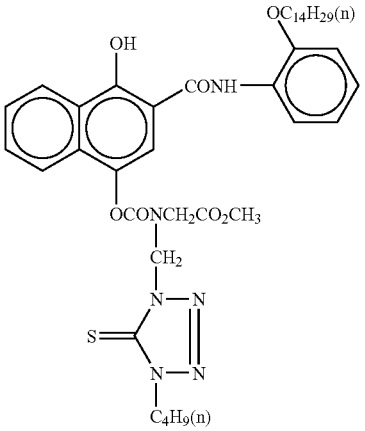

-continued
ExC-7
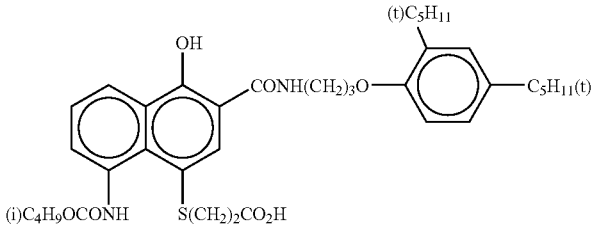
ExC-8
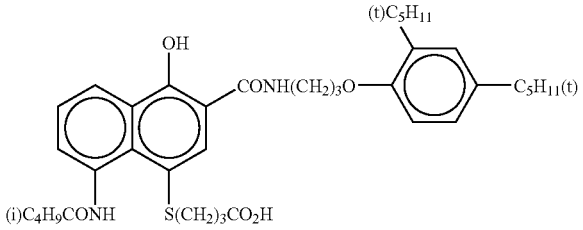
ExC-9
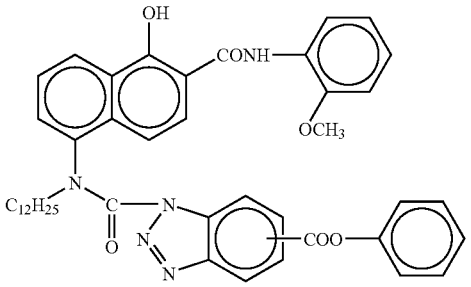
ExC-10
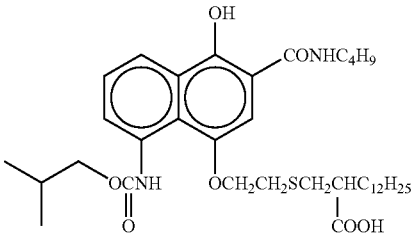
ExM-1
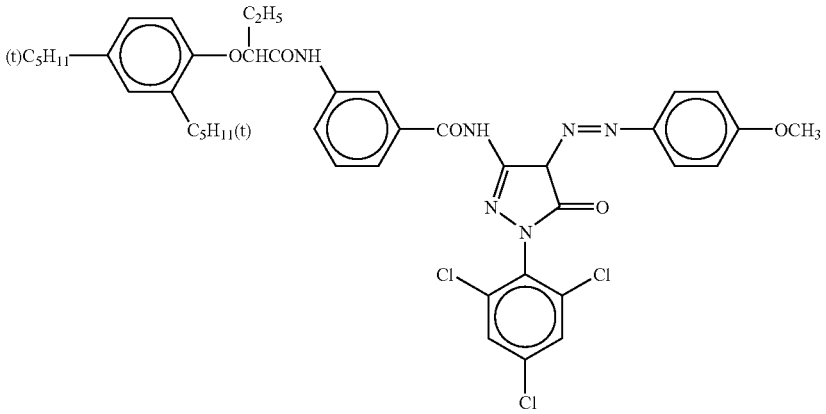
ExM-2
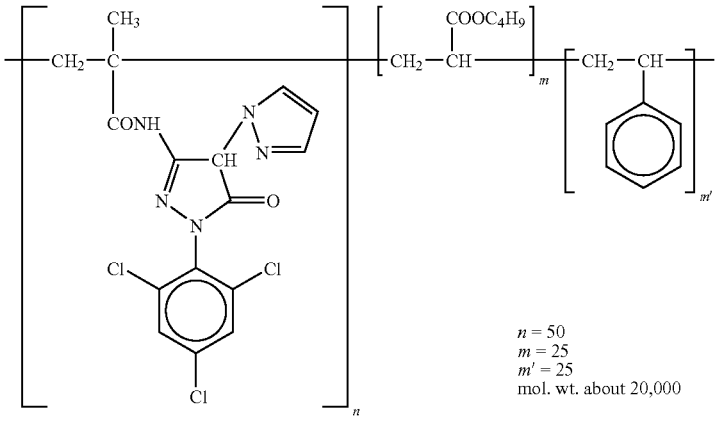
$n = 50$
$m = 25$
$m' = 25$
mol. wt. about 20,000

-continued
ExM-3
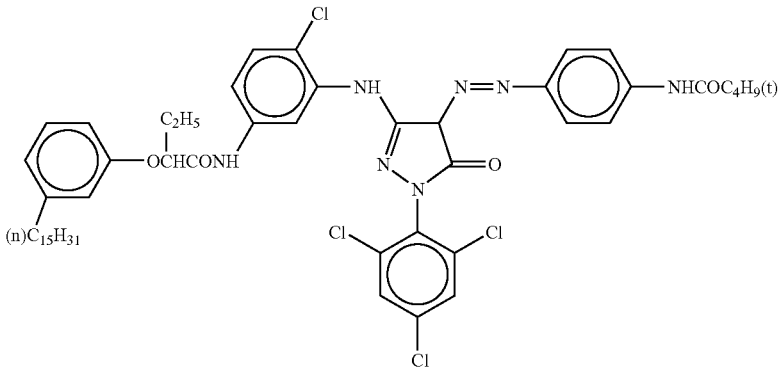
ExM-6
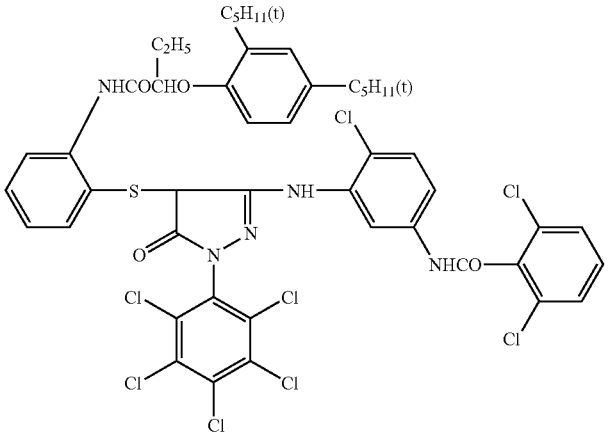
ExC-11
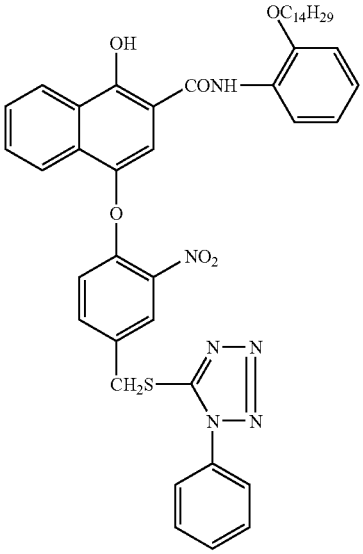

-continued
ExM-4
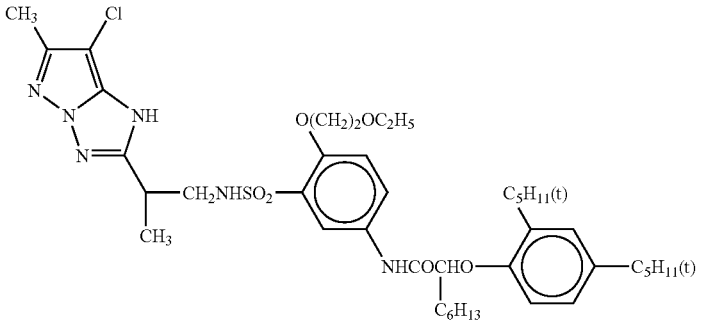
ExM-5
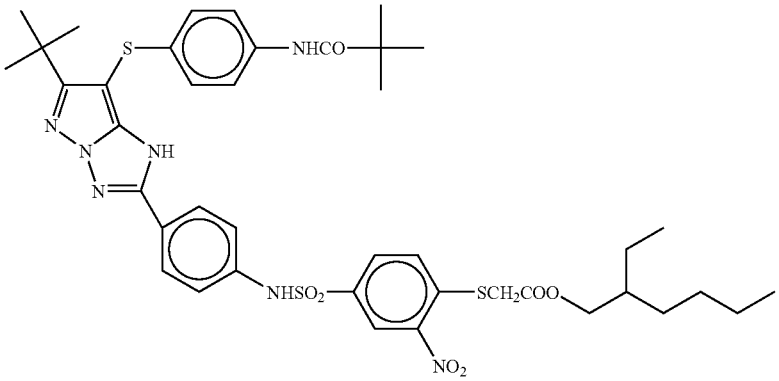
ExY-1
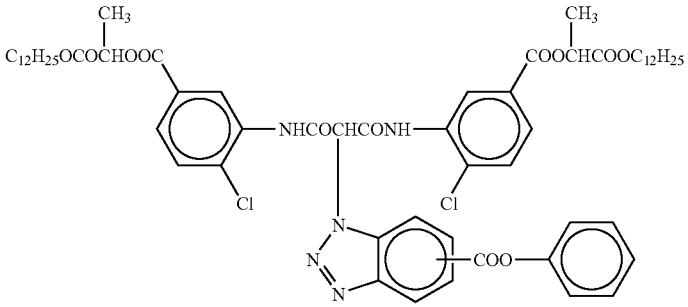
ExY-2
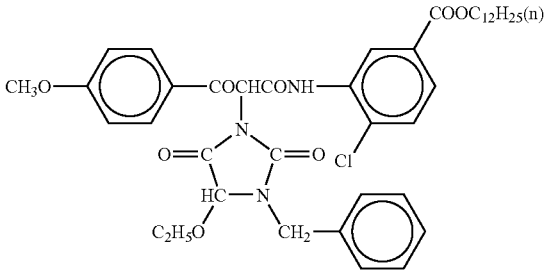
ExY-5
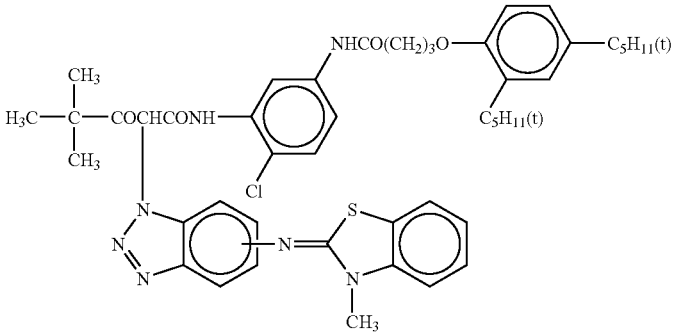

-continued
ExY-6
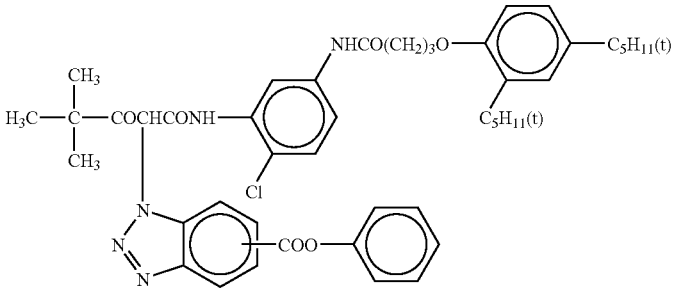
ExY-7
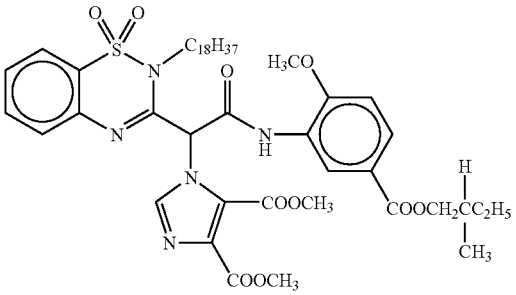
Cpd-1
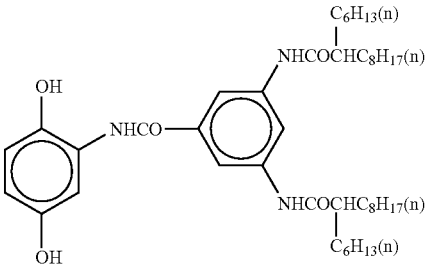
Cpd-2
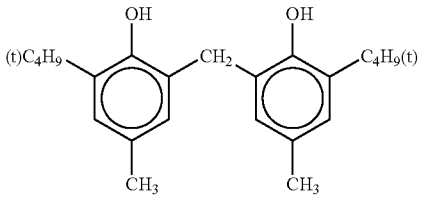
Cpd-3
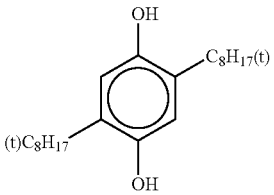
Cpd-4
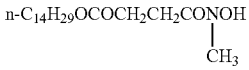
Cpd-5
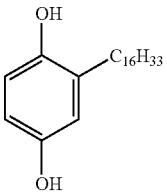
Cpd-6
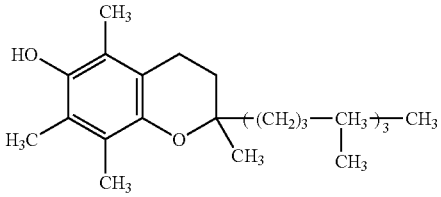
Cpd-7
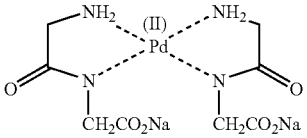
UV-1
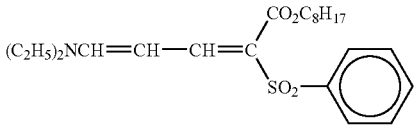
UV-2
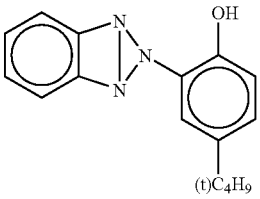

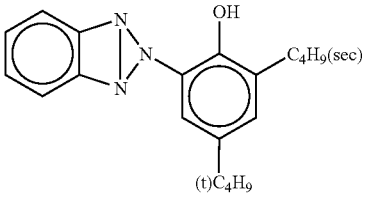
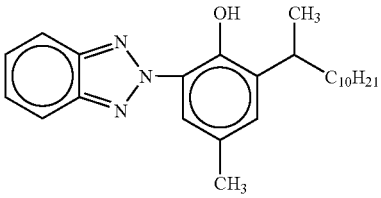
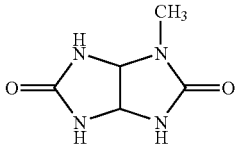
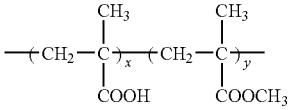
$x/y$ = 40/60 (mass ratio)
Weight-average molecular weight: about 20,000
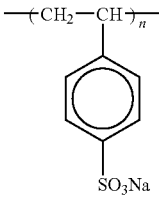
Weight-average molecular weight: about 750,000
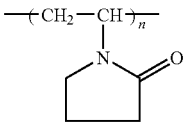
Weight-average molecular weight: about 10,000
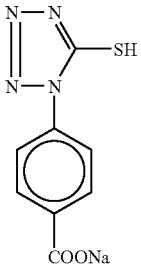
-continued
UV-3
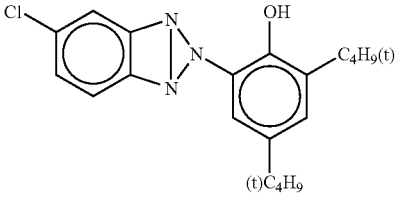
UV-4
UV-5
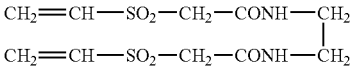
H-1
S-1
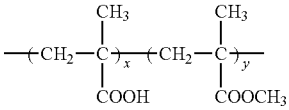
$x/y$ = 10/90 (mass ratio)
Weight-average molecular weight: about 35,000
B-1
B-2
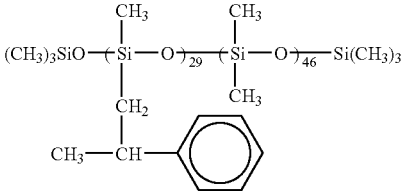
(mole ratio)
Weight-average molecular weight: about 8,000
B-3
B-4
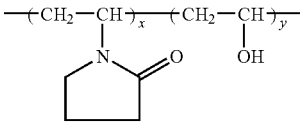
$x/y$ = 70/30 (mass ratio)
Weight-average molecular weight: about 17,000
B-5
B-6
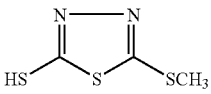
F-1
F-2
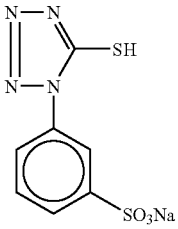
F-3

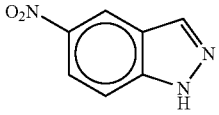
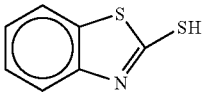
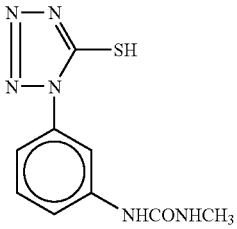
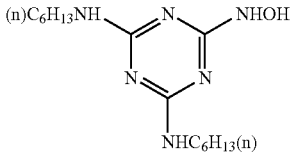
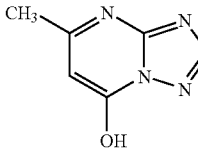
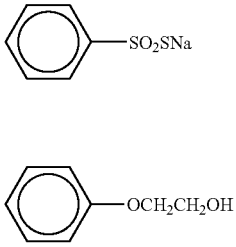
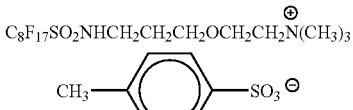
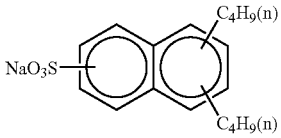
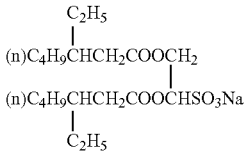
-continued
F-4
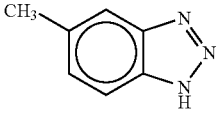
F-5
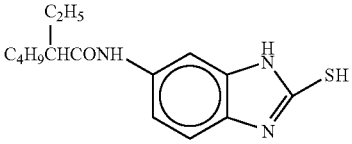
F-6
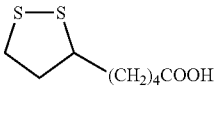
F-7
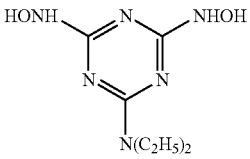
F-8
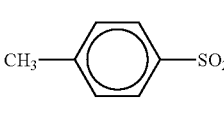
F-9
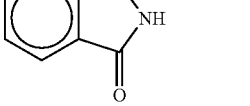
F-10
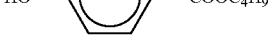
F-11
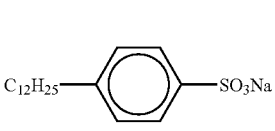
F-12
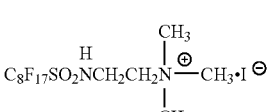
F-13
F-14
F-15
F-16
F-17
W-1
W-2
W-3
W-4
W-5
W-6

-continued
W-7
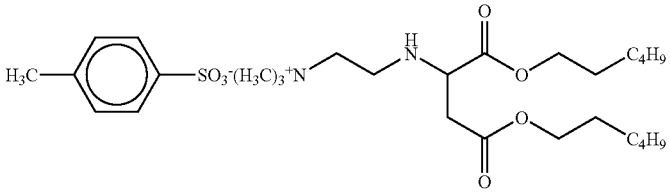
W-8
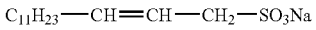
W-9
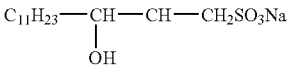
W-10
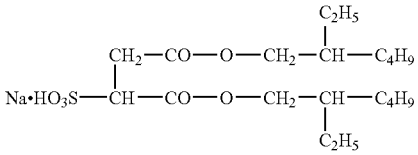
W-11
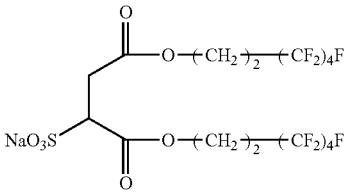
HBS-1
Tricresyl phosphate
HBS-2
Di-n-butyl phthalate
HBS-3
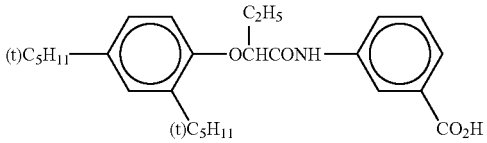
HBS-4
Tri (2-ethylhexyl) phosphate
HBS-5
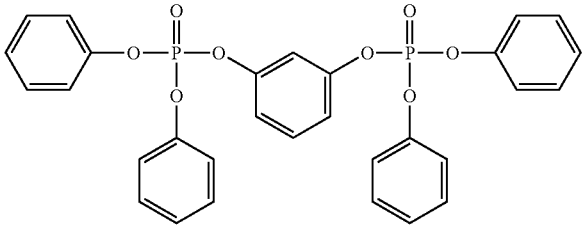
ExF-1
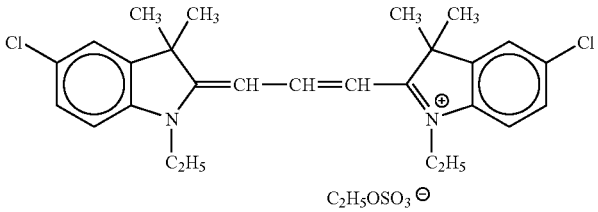
ExF-2
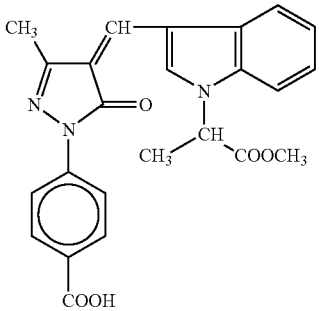
ExF-4
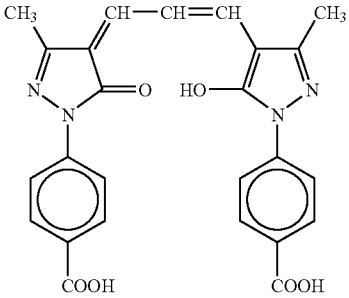

-continued

ExF-5

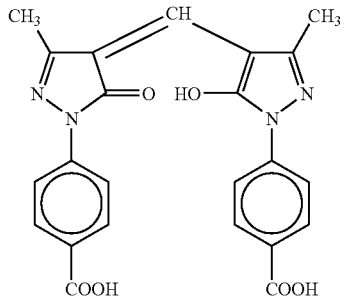

ExF-7

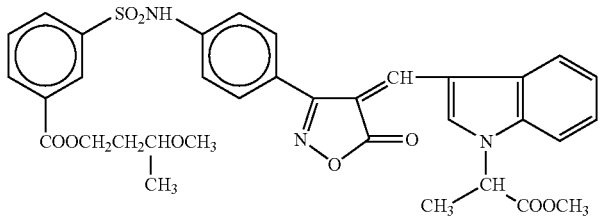

ExF-9

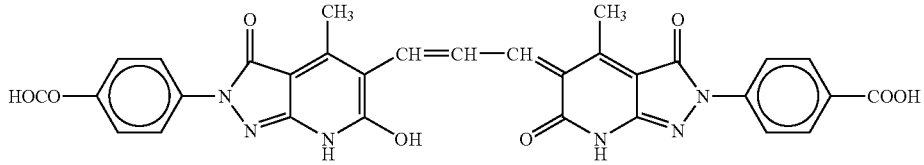

A negative color film sample 001A was prepared as described above. Further, the Low-speed Green-sensitive emulsion layer of the negative color film sample 001A was modified as described below to prepare samples 002A to 016A. Namely, a compound capable of discharging electrons of the invention was added to the Low-speed Green-sensitive emulsion layer by $1\times10^{-7}$ mol/mol-silver before coating, and ExM-6 was changed to the above A-2 which is the coupler of the invention, and ExC-11 was changed to the above B-1 which is the coupler of the invention. The coupler was replaced by an amount by which the sensitivities right after film curing of the samples 001A, 005A, 009A and 013A were designed to be equal.

The modification content is shown in Table 2.

TABLE 2

| Sample No. | Coupler | | Compound capable of discharging electrons | Remark |
|---|---|---|---|---|
| 001A | ExM-6 | ExC-11 | Absence | Comp. |
| 002A | ExM-6 | ExC-11 | Exemplified compound 7 | Comp. |
| 003A | ExM-6 | ExC-11 | Exemplified compound 37 | Comp. |
| 004A | ExM-6 | ExC-11 | T-1 | Comp. |
| 005A | A-2 | ExC-11 | Absence | Comp. |
| 006A | A-2 | ExC-11 | Exemplified compound 7 | Inv. |
| 007A | A-2 | ExC-11 | Exemplified compound 37 | Inv. |
| 008A | A-2 | ExC-11 | T-1 | Inv. |
| 009A | ExM-6 | B-1 | Absence | Comp. |
| 010A | ExM-6 | B-1 | Exemplified compound 7 | Inv. |
| 011A | ExM-6 | B-1 | Exemplified compound 37 | Inv. |
| 012A | ExM-6 | B-1 | T-1 | Inv. |
| 013A | A-2 | B-1 | Absence | Comp. |
| 014A | A-2 | B-1 | Exemplified compound 7 | Inv. |
| 015A | A-2 | B-1 | Exemplified compound 37 | Inv. |
| 016A | A-2 | B-1 | T-1 | Inv. |

The film curing treatment of the above-mentioned samples was carried out under conditions of a temperature of 40° C. and a relative humidity of 70%. Then, the samples were passed through a gelatin filter SC-39 manufactured by Fuji Photo Film Co., Ltd. (a long wavelength light transmission filter whose cut-off wavelength is 390 nm) and a continuous wedge and exposed for 1/100 second, and photo sensitivity and preservation property in the lapse of time were evaluated by measuring the density of samples to which the following development treatment was carried out, with a green filter.

The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing Steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization | 20 sec | 38.0° C. | 15 mL | 3 L |

-continued

| Step | Time | Temperature | Replenishment rate* | Tank volume |
|---|---|---|---|---|
| (2) Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35 mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| (Color developer) | [Tank solution] (g) | [Replenisher] (g) |
|---|---|---|
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |

| (Bleaching solution) | [Tank solution] (g) | [Replenisher] (g) |
|---|---|---|
| Ferric ammonium 1,3-diaminopropanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixer (1) Tank Solution)

A 5:95 mixture (v/v) of the above bleaching tank solution and the below fixing tank solution (pH 6.8)

| (Fixer (2)) | [Tank solution] (g) | [Replenisher] (g) |
|---|---|---|
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |
| (Washing water) | | |

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-mononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis (1,2,4-triazole-1-ylmethyl)piperazine | 0.75 |
| Water to make | 1.0 L |
| pH | 8.5 |

The result of photo sensitivity and preservation property in the lapse of time is shown in the following Table 3. The sensitivity was indicated by the relative value of the reciprocal number of exposure required for reaching at a density of a fog density of a characteristic curve obtained plus 1.0 (the sensitivity of the sample 001A was referred to as 100). Further, after the film curing treatment of another one set of samples 001A to 016A which were separate from these samples was carried out under conditions of a temperature of 40° C. and a relative humidity of 70%, the samples were preserved for two months under conditions of a temperature of 30° C. and a relative humidity of 80%, and then, exposure and development were carried out in the same manner as described above to determine the sensitivity in the same manner as described above.

TABLE 3

| Sample No. | Sensitivity right after film curing* | Sensitivity after preserving for two months under conditions of 30° C. and 80% r.h.** | Remark |
|---|---|---|---|
| 001A | 100 | 98 | Comp. |
| 002A | 135 | 107 | Comp. |
| 003A | 123 | 105 | Comp. |
| 004A | 120 | 98 | Comp. |
| 005A | 100 | 98 | Comp. |
| 006A | 138 | 135 | Inv. |
| 007A | 126 | 123 | Inv. |
| 008A | 123 | 120 | Inv. |

TABLE 3-continued

| Sample No. | Sensitivity right after film curing* | Sensitivity after preserving for two months under conditions of 30° C. and 80% r.h.** | Remark |
|---|---|---|---|
| 009A | 100 | 98 | Comp. |
| 010A | 135 | 129 | Inv. |
| 011A | 123 | 117 | Inv. |
| 012A | 120 | 115 | Inv. |
| 013A | 100 | 98 | Comp. |
| 014A | 141 | 138 | Inv. |
| 015A | 129 | 126 | Inv. |
| 016A | 126 | 123 | Inv. |

*Sensitivities of Samples Nos. 002A to 016A are relative values assuming the sensitivity of Sample 001A is 100.
**Sensitivities of Samples Nos. 002A to 016A are relative values assuming the sensitivity of Sample 001A is 100.

It is grasped from the above result that there is obtained a silver halide color photosensitive material by which the high sensitivity was accomplished and the sensitivity lowering was remarkably improved when they were preserved under a high humidity for a long term by using the coupler of the invention in combination with the compound capable of discharging electrons of the invention. Further, it is grasped that the combination with the exemplified compound 7 is more preferable by comparing the exemplified compound 7 by which one electron-oxidized product prepared by one electron oxidation can discharge two electrons, with the exemplified compound 37 by which one electron-oxidized product prepared by one electron oxidation discharges one electron or T-1.

EXAMPLE 2A

Samples were prepared in the same manner as in Example 1A except that the coupler A-1 was used in place of the coupler A-2 in the samples 005A to 008A and 013A to 016A of Example 1A of the invention, and the same evaluation as Example 1A was carried out.

The same effect as Example 1A was also obtained for the samples of the invention when A-1 was used in place of the coupler A-2.

EXAMPLE 3A

Samples were prepared in the same manner as in Example 1A except that the coupler A-3 was used in place of the coupler A-2 in the samples 001A to 016A of Example 1A of the invention, and the same evaluation as Example 1A was carried out.

The same effect as Example 1A was also obtained for the samples of the invention when A-3 was used in place of the coupler A-2.

EXAMPLE 4A

Samples were prepared in the same manner as in Example 1A except that the coupler A-4 was used in place of the coupler A-2 in the samples 005A to 008A and 013A to 016A of Example 1A of the invention, and the same evaluation as Example 1A was carried out.

The same effect as Example 1A was also obtained for the samples of the invention when A-4 was used in place of the coupler A-2.

EXAMPLE 5A

Samples were prepared in the same manner as in Example 1A except that the coupler A-5 was used in place of the coupler A-2 in the samples 005A to 008A and 013A to 016A of Example 1A of the invention, and the same evaluation as Example 1A was carried out.

The same effect as Example 1A was also obtained for the samples of the invention when A-5 was used in place of the coupler A-2.

EXAMPLE 6A

Samples were prepared in the same manner as in Example 1A except that the coupler A-6 was used in place of the coupler A-2 in the samples 005A to 008A and 013A to 016A of Example 1A of the invention, and the same evaluation as Example 1A was carried out.

The same effect as Example 1A was also obtained for the samples of the invention when A-6 was used in place of the coupler A-2.

EXAMPLE 7A

A sample was prepared by replacing the coupler of the Low-speed Green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 505 of Example 5 of JP-A-2001-142170. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing the tabular silver iodobromide or iodochlorobromide grains having a (111) surface as a principal plane in which the variation coefficient of an equivalent circular diameter is 40% or less, an equivalent circular diameter is 3.5 μm or more, the thickness of grains is 0.25 μm or less, and the twin plane spacing is 0.016 μm or less.

EXAMPLE 8A

A sample was prepared by replacing the coupler of the Low-speed Green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 202 of Example 4 of JP-A-2001-159799. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodobromide or iodochlorobromide grains having a (111) plane as a principal plane in which the variation coefficient of an equivalent circular diameter is 40% or less, a circle equivalent diameter is 3.5 μm or more, the thickness of grains is 0.25 μm or less, the content of silver iodide is 2% by mol or more and 6% by mole or less, the content of silver chloride is 3 mol or less, and the distribution of silver iodide is a multiple structure with fivefold structure or more.

EXAMPLE 9A

A sample was prepared by replacing the coupler of the Low-speed Green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 905 of Example 7 of JP-A-2000-347336. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising inorganic grains in the dispersing medium phase of an emulsion.

EXAMPLE 10A

A sample was prepared by replacing the coupler of the Low-speed Green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 904 of Example 9 of JP-A-11-295832. When the same evaluation as Example 1A was carried out, the sample of the invention using the coupler represented by A-2 and/or B-1 of the invention in combination with the compound capable of discharging electrons which is represented-by the exemplified compounds 7, 22 and 37 of the invention obtained same effect as Example 1A, also in case of the photosensitive material comprising an emulsion containing tabular grains with an aspect ratio of 3 or more, and having a high level iodine layer formed by suddenly preparing iodide ions from an iodide ion-discharging agent and containing a metal complex.

EXAMPLE 11A

A sample was prepared by replacing the coupler of the Low-speed Green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 222 of Example 8 of JP-A-2000-321698. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular grains in which an aspect ratio is 8 or more, an average iodine content is 2 mol or more, ten or more dislocation lines per one grain exist, and the variation coefficient of iodine distribution between grains is 20% or less.

EXAMPLE 12A

A sample was prepared by replacing the coupler of the Low-speed Green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 109 of Example 1 of JP-A-2001-231175. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material containing a Pd (II) complex.

EXAMPLE 13A

A sample was prepared by replacing the coupler of the Low-speed Green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 302 of Example 3 of JP-A-2001-324773. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion produced in the presence of an oxo-acid salt of halogen.

EXAMPLE 14A

Samples were prepared in the same manner as in Example 1A except that the infrared absorbing dyes (62), (63), (64), (72), (74) and (87) of JP-A-9-96891 were introduced into the second layer of Example 1A of the invention in the samples 001A to 016A of Example 1A of the invention, and the same evaluation as Example 1A was carried out. The sample of the invention obtained same effect as Example 1A, also in case of introducing an infrared absorbing dye.

EXAMPLE 15A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 403 of Example 4 of JP-A-2001-228572. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodobromide or iodochlorobromide grains having a (111) plane as a principal plane in which the variation coefficient of an equivalent circular diameter is 3% to 40%, an equivalent circular diameter is 1.0 μm or more, the thickness of grains is 0.10 μm or less, and the portions of a side and a corner are not lost.

EXAMPLE 16A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 403 of Example 4 of JP-A-2001-228572. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodobromide or iodochlorobromide grains having a (111) plane as a principal plane in which the variation coefficient of an equivalent circular diameter is 40% or less, an equivalent circular diameter is 1.0 μm or more, the thickness of grains is 0.10 μm or less, the tabular grains having a specific structure of the content ratio of silver iodide, having five or more dislocation lines per one grain at the outer peripheral of the grains, and further having a positive holes catching zone.

EXAMPLE 17A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 713 of Example 7 of JP-A-2001-281778. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodobromide or iodochlorobromide grains having a thickness of 0.1 μm or less which has an electron catching zone and has a silver iodobromide phase in which an annual ring is not observed.

EXAMPLE 18A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 205 of Example 2 of JP-A-2001-296627. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion which reduced the generation of non tabular grains, particularly rod grains caused by preparation of the tabular grains.

EXAMPLE 19A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 303 of Example 3 of JP-A-2002-169240. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodobromide or iodochlorobromide grains having a (111) plane as a principal plane in which the variation coefficient of an equivalent circular diameter is 3% to 40%, an equivalent circular diameter is 1.0 μm or more, the thickness of grains is 0.10 μm or less, and the portions of a side and a corner are lost.

EXAMPLE 20A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 205 of Example 2 of JP-A-2001-255613. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodobromide or iodochlorobromide grains having a (111) plane as a principal plane in which an equivalent circular diameter is 1.0 μm or more and the thickness of grains is 0.10 μm or less, the tabular grains comprising core portions substantially not containing dislocation lines and shell portions containing dislocation lines in which the shell thickness of a direction vertical to the principal plane is 0.01 μm or more.

EXAMPLE 21A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 304 of Example 3 of JP-A-2002-268162. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodobromide or iodochlorobromide grains having a (111) plane as a principal plane and having two parallel twin planes in which the thickness of grains is 0.12 μm or less and a phase with the high level content of silver iodide exists in a grain fringe potion at at least one of an upper side and a lower side than a zone sandwiched by two twin planes.

EXAMPLE 22A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 209 of Example 3 of JP-A-2001-235821. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodochlorobromide grains having a (111) plane as a principal plane which are hexagonal tabular grains having a ratio of the maximum side length/the minimum side length of 2 or more and have respectively one of epitaxial junction only at the six apex portions of hexagon and in which the content of silver chloride is 1% by mole or more and 6% by mol or less, and the content of silver iodide is 0.5% by mole or more and 10% by mol or less.

EXAMPLE 23A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 202 of Example 4 of JP-A-2002-169241. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodochlorobromide grains having a (111) plane as a principal plane which have epitaxial junctions containing at least one or more of dislocation lines at at least one apex portion.

EXAMPLE 24A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the Example 3 of JP-A-2002-278008. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodochlorobromide grains having a (111) plane as a principal plane which have epitaxial junction portions in which the content of silver chloride at at least one or more of apex portions of a hexagon is 5 to 25% by mole.

EXAMPLE 25A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 303 of Example 3 of JP-A-2002-169239. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular silver iodochlorobromide grains having a (111) plane as a principal plane in which an equivalent circular diameter is 3.0 μm or more, and an aspect ratio is 8 or more, the tabular grains having epitaxial junction portions.

EXAMPLE 26A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 101 of Example 5 of JP-A-7-134351. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising a hydrazine compound as an adsorptive group on silver halide.

EXAMPLE 27A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 602 of Example 6 of JP-A-2000-250157. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing a bispyridinium salt compound.

EXAMPLE 28A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 218 of Example 2 of JP-A-9-251193. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular grains obtained by carrying out nucleus formation in a dispersion medium solution containing low molecular weight gelatin having a molecular weight of 70000 to 1000 and carrying out grain growth in the presence of chemical modification gelatin in which the chemical modification ratio of an amino group is 15 to 100%.

EXAMPLE 29A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 103 of Example 2 of JP-A-2001-100343. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing tabular grains obtained by carrying out grain growth in the presence of a dispersion medium in which 40% by mass or more is chemical modification gelatin or low molecular weight gelatin.

EXAMPLE 30A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 305 of Example 3 of JP-A-2001-281780. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising an emulsion containing gelatin containing a lot of a high molecular weight component.

EXAMPLE 31A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 203 of Example 3 of JP-A-3-39946. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material comprising a tabular emulsion containing mercaptobenzthiazole compounds.

EXAMPLE 32A

A sample was prepared by replacing the coupler of the low-speed green-sensitive emulsion layer in the same manner as in the samples 001A to 016A of Example 1A of the invention and by setting the presence or absence of the addition of a compound capable of discharging electrons in the same manner as in the samples 001A to 016A of Example 1A of the invention, in the sample 001 of Example 1 of JP-A-2001-75242. When the same evaluation as Example 1A was carried out, the sample of the invention using the coupler represented by A-2 and/or B-1 of the invention in combination with the compound capable of discharging electrons which is represented by the exemplified compounds 7, 22 and 37 of the invention obtained same effect as Example 1A, also in case of the photosensitive material with high sensitivity which enabled faithful color reproduction.

EXAMPLE 1B

The sample 001B was prepared in the same manner as in the sample 001A of Example 1A except that the low-speed green-sensitive emulsion layer of the ninth layer was replaced with a low-speed green-sensitive emulsion layer described below and further W-10 (0.025 g/m$^2$) and W-11 (0.005 g/m$^2$) were added to the sixteenth layer. Further, the samples 002B to 016B were prepared by carrying out modifications below in the low-speed green-sensitive emulsion layer of the sample 001B. Namely, the compound capable of discharging electrons of the invention was added by $1\times10^{-7}$ mol/mol of silver before coating to the low-speed green-sensitive emulsion layers, HBS-1 was changed to the compound of the formula (P) which is the high boiling organic solvent of the invention, and HBS-2 was changed to the compound (S-2) which is the high-boiling organic solvent of the invention. The amount of the high-boiling organic solvent was replaced with an amount so as to equalize the sensitivity of the cured films of the sample 001B, 005B, 009B and 013B.

9th Layer (Low-Speed Green-Sensitive Emulsion Layer)

| | |
|---|---|
| Em-H | silver 0.200 |
| Em-G | silver 0.120 |
| Em-I | silver 0.230 |
| ExM-2 | 0.378 |
| ExM-3 | 0.047 |
| ExY-1 | 0.009 |
| ExC-9 | 0.007 |
| HBS-1 | 0.250 |
| HBS-2 | 0.120 |
| Cpd-5 | 0.010 |
| Gelatin | 1.470 |

Formula (P)

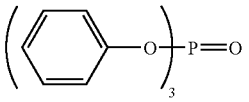

S-2

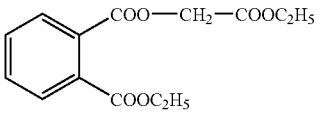

The modification content is shown in Table 4.

TABLE 4

| Sample No. | High-boiling organic solvent | | Compound capable of discharging electrons | Remark |
|---|---|---|---|---|
| 001B | HBS-1 | HBS-2 | Absence | Comp. |
| 002B | HBS-1 | HBS-2 | Exemplified compound 7 | Comp. |
| 003B | HBS-1 | HBS-2 | Exemplified compound 37 | Comp. |
| 004B | HBS-1 | HBS-2 | T-1 | Comp. |
| 005B | Formula (P) | HBS-2 | Absence | Comp. |
| 006B | Formula (P) | HBS-2 | Exemplified compound 7 | Inv. |
| 007B | Formula (P) | HBS-2 | Exemplified compound 37 | Inv. |
| 008B | Formula (P) | HBS-2 | T-1 | Inv. |
| 009B | HBS-1 | S-2 | Absence | Comp. |
| 010B | HBS-1 | S-2 | Exemplified compound 7 | Inv. |
| 011B | HBS-1 | S-2 | Exemplified compound 37 | Inv. |
| 012B | HBS-1 | S-2 | T-1 | Inv. |
| 013B | Formula (P) | S-2 | Absence | Comp. |
| 014B | Formula (P) | S-2 | Exemplified compound 7 | Inv. |
| 015B | Formula (P) | S-2 | Exemplified compound 37 | Inv. |
| 016B | Formula (P) | S-2 | T-1 | Inv. |

The evaluation result of photo sensitivity and preservation property in the lapse of time obtained in the same manner as in Example 1A is shown in the following Table 5. The sensitivity was indicated by the relative value of the reciprocal number of exposure required for reaching at a density of a fog density of a characteristic curve obtained plus 0.8 (the sensitivity of the sample 001B was referred to as 100). Further, after the film curing treatment of another one set of samples 001B to 016B which were separate from these samples was carried out under conditions of a temperature of 40° C. and a relative humidity of 70%, the samples were preserved for three days under conditions of a temperature of 50° C. and a relative humidity of 80%, and then, exposure and development were carried out in the same manner as described above to determine the sensitivity in the same manner as described above.

TABLE 5

| Sample No. | Sensitivity right after film curing* | Sensitivity after preserving for three days under conditions of 50° C. and 80% r.h.** | Remark |
|---|---|---|---|
| 001B | 100 | 95 | Comp. |
| 002B | 135 | 110 | Comp. |
| 003B | 123 | 107 | Comp. |
| 004B | 120 | 105 | Comp. |
| 005B | 100 | 95 | Comp. |
| 006B | 138 | 132 | Inv. |
| 007B | 126 | 123 | Inv. |
| 008B | 123 | 120 | Inv. |
| 009B | 100 | 95 | Comp. |
| 010B | 135 | 129 | Inv. |
| 011B | 123 | 120 | Inv. |

TABLE 5-continued

| Sample No. | Sensitivity right after film curing* | Sensitivity after preserving for three days under conditions of 50° C. and 80% r.h.** | Remark |
|---|---|---|---|
| 012B | 120 | 117 | Inv. |
| 013B | 100 | 95 | Comp. |
| 014B | 138 | 132 | Inv. |
| 015B | 129 | 126 | Inv. |
| 016B | 129 | 123 | Inv. |

*Sensitivities of Samples Nos. 002B to 016B are relative values assuming the sensitivity of Sample 001B is 100.
**Sensitivities of Samples Nos. 002B to 016B are relative values assuming the sensitivity of Sample 001B is 100.

It is grasped from the above result that there is obtained a silver halide color photosensitive material by which the high sensitivity was accomplished and the sensitivity lowering was remarkably improved when they were preserved under a high humidity for a short term by using the high-boiling organic solvent of the invention in combination with the compound capable of discharging electrons of the invention. Further, the similar effect could be also confirmed by replacing the compound S-2 with the compound S-1 in the samples 009B to 016B.

EXAMPLE 2B

The samples 102B to 108B were prepared by carrying out modifications described below in the low-speed green-sensitive emulsion layer of the samples 001B of Example 1B of the invention. Namely, the compound capable of discharging electrons of the invention was added by $1\times10^{-7}$ mol/mol of silver before coating to the low-speed green-sensitive emulsion layer, and W-11 of the second protective layer was changed to the compound (FT-0) which is the surfactant of the invention.

(FT-0)

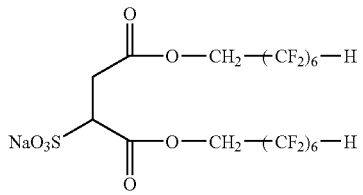

The modification content will be shown in Table 6 below.

TABLE 6

| Sample No. | Surfactant | Compound capable of discharging electrons | Remark |
|---|---|---|---|
| 001B | W-11 | Absence | Comp. |
| 102B | W-11 | Exemplified compound 7 | Comp. |
| 103B | W-11 | Exemplified compound 37 | Comp. |
| 104B | W-11 | T-1 | Comp. |
| 105B | FT-0 | Absence | Comp. |
| 106B | FT-0 | Exemplified compound 7 | Inv. |
| 107B | FT-0 | Exemplified compound 37 | Inv. |
| 108B | FT-0 | T-1 | Inv. |

The evaluation of photo performance was carried out in the same manner as in Example 1B. The evaluation result of photo sensitivity and preservation property in the lapse of time will be shown in the following Table 7.

TABLE 7

| Sample No. | Sensitivity right after film curing* | Sensitivity after preserving for three days under conditions of 50° C. and 80% r.h.** | Remark |
|---|---|---|---|
| 001B | 100 | 98 | Comp. |
| 102B | 135 | 107 | Comp. |
| 103B | 123 | 102 | Comp. |
| 104B | 120 | 100 | Comp. |
| 105B | 100 | 98 | Comp. |
| 106B | 135 | 126 | Inv. |
| 107B | 123 | 115 | Inv. |
| 108B | 123 | 115 | Inv. |

*Sensitivities of Samples Nos. 102B to 108B are relative values assuming the sensitivity of Sample 001B is 100.
**Sensitivities of Samples Nos. 102B to 108B are relative values assuming the sensitivity of Sample 001B is 100.

It is grasped from the above result that there is obtained a silver halide color photosensitive material by which the high sensitivity was accomplished and the sensitivity lowering was remarkably improved when they were preserved under a high temperature and high humidity for a short term by using the surfactant of the invention in combination with the compound capable of discharging electrons of the invention.

EXAMPLE 3B

Samples were prepared in the same manner as in the samples 006B to 008B, 010B to 012B and 014B to 016B of Example 1B of the invention and the samples 106B to 108B of Example 2B of the invention except that the exemplification compounds 7, 37 and T-1 which are the compounds capable of discharging electrons were replaced with the alternative exemplification compounds 1, 8, 22, 12, 14, 19, 20, 22, 24, 31, 35, 37, 40, T-2, T-3, T-4, T-28, T-39 and T-52 of the invention, and the same evaluation as Examples 1B and 2B was carried out. The samples of the invention obtained also the same effect as Example 1B and 2B even in a case that the exemplification compounds 1, 8, 22, 12, 14, 19, 20, 22, 24, 31, 35, 37, 40, T-2, T-3, T-4, T-28, T-39 and T-52 of the invention were used.

EXAMPLE 4B

Samples were prepared in the same manner as in the samples 106B to 108B of Examples 2B of the invention except that the surfactant represented by (FT-0) was replaced with the surfactants FT-1 to FT-24 of the invention, and the same evaluation as Example 2B was carried out. The samples of the present invention obtained also the same effect as Example 2B even in a case that the surfactants FT-1 to FT-24 of the invention were used.

EXAMPLE 5B

Samples were prepared in the same manner as in the samples 106B to 108B of Examples 2B of the invention except that the surfactant represented by (FT-0) was replaced with compounds FS-3, FS-9, FR-1 and FR-3 which are described in Example 1 of JP-A-2003-149774 and similar to the compounds of the invention, and the same evaluation as Example 2B was carried out. Effect as the samples of the invention was not obtained in a case that the surfactants FS-3, FS-9, FR-1 and FR-3 other than that of the invention were used.

FS-3

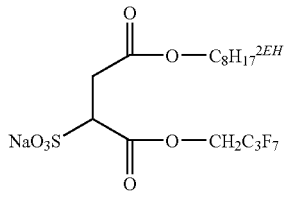

(2*EH*: 2-ethylhexyl group)

FS-9

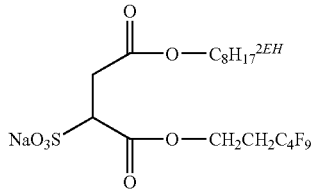

(2*EH*: 2-ethylhexyl group)

FR-1

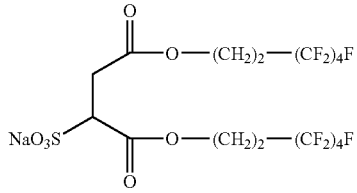

FR-3

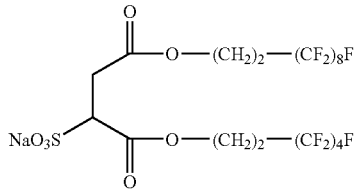

EXAMPLE 6B

In the sample 505 of Example 5 of JP-A-2001-142170, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material using an emulsion comprising the tabular silver iodobromide or iodochlorobromide grains having a (111) plane as a principal plane in which the variation coefficient of an equivalent circular diameter is 40% or less, an equivalent circular diameter is 3.5 μm or more, the thickness of grains is 0.25 μm or less, and the twin plane spacing is 0.016 μm or less.

EXAMPLE 7B

In the sample 202 of Example 4 of JP-A-2001-159799, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodobromide or iodochlorobromide grains having a (111) plane as a principal plane in which the variation coefficient of an equivalent circular diameter is 40% or less, a circle equivalent diameter is 3.5 μm or more, the thickness of grains is 0.25 μm or less, the content of silver iodide is 2% by mol or more and 6% by mole or less, the content of silver chloride is 3 mol or less, and the distribution of silver iodide is a multiple structure with fivefold structure or more.

EXAMPLE 8B

In the sample 905 of Example 7 of JP-A-2000-347336, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second -protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising inorganic grains in the dispersing medium phase of an emulsion.

EXAMPLE 9B

In the sample 904 of Example 9 of JP-A-11-295832, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular grains with an aspect ratio of 3 or more, and having a high level iodine layer formed by suddenly preparing iodide ions from an iodide ion-discharging agent and containing a metal complex.

EXAMPLE 10B

In the sample 222 of Example 8 of JP-A-2000-321698, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular grains in which an aspect ratio is 8 or more, an average iodine content is 2 mol or more, ten or more dislocation lines per one grain exist, and the variation coefficient of iodine distribution between grains is 20% or less.

EXAMPLE 11B

In the sample 109 of Example 1 of JP-A-2000-231175, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37-and T-1 of the invention obtained the same effect as Examples 1B and 2B, also in case of the photosensitive material containing a Pd (II) complex.

EXAMPLE 12B

In the sample 302 of Example 3 of JP-A-2001-324773, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion produced in the presence of an oxo-acid salt of halogen.

EXAMPLE 13B

Samples were prepared in the same manner as in Examples 1B and 2B except that the infrared absorbing dyes (62), (63), (64), (72), (74) and (87) of JP-A-9-96891 were introduced into the second layer of Example 1B of the invention in the samples 001B to 016B of Example 1B of the invention, and the same evaluation as Example 1B was carried out. The sample of the invention obtained same effect as Examples 1B and 2B, also in case of introducing an infrared absorbing dye.

EXAMPLE 14B

In the sample 403 of Example 4 of JP-A-2001-228572, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodobromide or iodochlorobromide grains having a (111) plane as a principal plane in which the variation coefficient of an equivalent circular diameter is 3% to 40%, an equivalent circular diameter is 1.0 μm or more, the thickness of grains is 0.10 μm or less, and the portions of a side and a corner are not lost.

EXAMPLE 15B

In Example 6 of JP-A-2001-264911, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodobromide or iodochlorobromide grains having a (111) plane as a principal plane in which the variation coefficient of an equivalent circular diameter is 40% or less, an equivalent circular diameter is 1.0 μm or more, the thickness of grains is 0.10 μm or less, the tabular grains having a specific structure of the content ratio of silver iodide, having five or more dislocation lines per one grain at the outer peripheral of the grains, and further having a positive holes catching zone.

EXAMPLE 16B

In the sample 713 of Example 7 of JP-A-2001-281778, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodobromide or iodochlorobromide grains having a thickness of 0.1 μm or less which has an electron catching zone and has a silver iodobromide phase in which an annual ring is not observed.

EXAMPLE 17B

In the sample 205 of Example 2 of JP-A-2001-296627, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion which reduced the generation of non tabular grains, particularly rod grains caused by preparation of the tabular grains.

EXAMPLE 18B

In the sample 303 of Example 3 of JP-A-2002-169240, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodobromide or iodochlorobromide grains having a (111) plane as a principal plane in which the variation coefficient of an equivalent circular diameter is 3% to 40%, an equivalent circular diameter is 1.0 μm or more, the thickness of grains is 0.10 μm or less, and the portions of a side and a corner are lost.

EXAMPLE 19B

In the sample 205 of Example 2 of JP-A-2001-255613, samples were prepared by replacing the high-boiling organic solvent of the low-speed green-sensitive emulsion layer in the same -manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodobromide or iodochlorobromide grains having a (111) plane as a principal plane in which an equivalent circular diameter is 1.0 μm or more and the thickness of grains is 0.10 μm or less, the tabular grains comprising core portions substantially not containing dislocation lines and shell portions containing dislocation lines in which the shell thickness of a direction vertical to the principal plane is 0.01 μm or more.

EXAMPLE 20B

In the sample 304 of Example 3 of JP-A-2002-268162, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodobromide or iodochlorobromide grains having a (111) plane as a principal plane and having two parallel twin planes in which the thickness of grains is 0.12 μm or less and a phase with the high level content of silver iodide exists in a grain fringe potion at at least one of an upper side and a lower side than a zone sandwiched by two twin planes.

EXAMPLE 21B

In the sample 209 of Example 3 of JP-A-2001-235821, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodochlorobromide grains having a (111) plane as a principal plane which are hexagonal tabular grains having a ratio of the maximum side length/the minimum side length of 2 or more and have respectively one of epitaxial junction only at the six apex portions of hexagon and in which the content of silver chloride is 1% by mole or more and 6% by mol or less, and the content of silver iodide is 0.5% by mole or more and 10% by mol or less.

EXAMPLE 22B

In the sample 202 of Example 4 of JP-A-2002-169241, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodochlorobromide grains having a (111) plane as a principal plane which have epitaxial junctions containing at least one or more of dislocation lines at at least one apex portion.

EXAMPLE 23B

In Example 3 of JP-A-2002-278008, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or-absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodochlorobromide grains having a (111) plane as a principal plane which have epitaxial junction portions in which the content of silver chloride at at least one or more of apex portions of a hexagon is 5 to 25% by mole.

EXAMPLE 24B

In the sample 303 of Example 3 of JP-A-2002-169239, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular silver iodochlorobromide grains having a (111) plane as a principal plane in which an equivalent circular diameter is 3.0 μm or more, and an aspect ratio is 8 or more, the tabular grains having epitaxial junction portions.

EXAMPLE 25B

In the sample 101 of Example 5 of JP-A-7-134351, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising a hydrazine compound as an adsorptive group on silver halide.

EXAMPLE 26B

In the sample 602 of Example 6 of JP-A-2000-250157, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing a bispyridinium salt compound.

EXAMPLE 27B

In the sample 218 of Example 2 of JP-A-9-251193, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular grains obtained by carrying out nucleus formation in a dispersion medium solution containing low molecular weight gelatin having a molecular weight of 70000 to 1000 and carrying out grain growth in the presence of chemical modification gelatin in which the chemical modification ratio of an amino group is 15 to 100%.

EXAMPLE 28B

In the sample 103 of Example 2 of JP-A-2001-100343, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing tabular grains obtained by carrying out grain growth in the presence of a dispersion medium in which 40% by mass or more is chemical modification gelatin or low molecular weight gelatin.

EXAMPLE 29B

In the sample 305 of Example 3 of JP-A-2001-281780, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising an emulsion containing gelatin containing a lot of a high molecular weight component.

EXAMPLE 30B

In the sample 203 of Example 3 of JP-A-3-39946, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification. compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material comprising a tabular emulsion containing mercaptobenzthiazole compounds.

EXAMPLE 31B

In the sample 001 of Example 1 of JP-A-2001-75242, samples were prepared by replacing the high-boiling organic solvent of the low-speed green-sensitive emulsion layer in the same manner as in the samples 001B to 016B of Example 1B of the invention, and by carrying out the presence or absence of the compound capable of discharging electrons in the same manner as in the samples 001B to 016B of Example 1B of the invention, and samples were prepared by replacing the surfactant of the second protective layer in the same manner as in the samples 102B to 108B of Example 2B of the invention and by carrying out the presence or absence of the compound capable of discharging electrons in the same manner as in the samples 102B to 108B of Example 2B of the invention. When the same evaluation as Example 1B was carried out, the samples of the present invention using the high-boiling organic solvent of the invention (the compound represented by the formula (P) and the compound (S-2)) in combination with the compound capable of discharging electrons which is represented by the exemplification compounds 7, 37 and T-1 of the present invention and the samples of the invention using the surfactant ((FT-0)) of the invention in combination with the compound capable of discharging electrons which is represented by the exemplification compounds 7, 37 and T-1 of the invention obtained the same effect as Examples 1B and 2B, also in case of the photosensitive material with high sensitivity which enabled faithful color reproduction.

EXAMPLE 1C

In the same manner as in the above Example 1A of the invention, the silver halide (silver iodobromide) emulsions Em-A to Em-O described in the above Table 1 were prepared referring to the production method for Em-A to Em-O described in Example 1 of JP-A-2001-281815, and the samples 101C to 116C (Table 8) were prepared.

Provided that modified points are as follow.

Disodium 3,5-disulfocathecol was not used in formation of the grains of the emulsion Em-L. Thiourea dioxide was not used for formation of the grains of the emulsion Em-O, the emulsion Em-M and the emulsion Em-N.

With respect to the high-speed blue-sensitive emulsion, the sensitizing dyes 9 (called as the sensitizing dye 1 in the present case), 10 (called as the sensitizing dye 3 in the present case) and 11 (called as the sensitizing dye 2 in the present case) which were described in Example 1 of JP-A-2001-281815 were changed as Table 8.

Further, the compound capable of discharging electrons of the invention was added by $3\times10^{-6}$ mol/mol to the high-speed blue-sensitive emulsion layer. The compounds added were shown in Table 8.

Further, in the low-speed green-sensitive emulsion of the ninth layer, ExM-2 (0.378 g/m$^2$), ExY-1 (0.009 g/m$^2$) and ExC-9 (0.007 g/m$^2$) were used in place of ExM-6 and ExC-11.

Sensitizing Dye 1

(Sensitizing Dye 9 Described in JP-A-2001-281815)

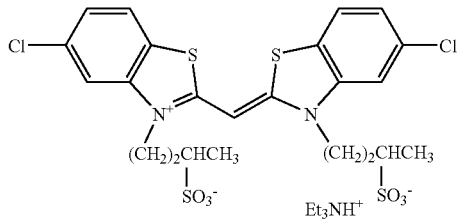

Sensitizing Dye 2

(Sensitizing Dye 11 Described in JP-A-2001-281815)

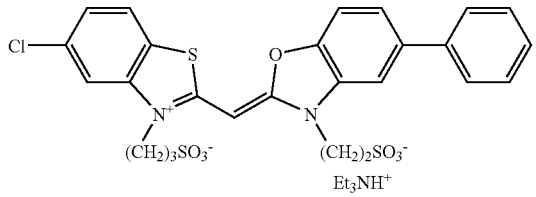

Sensitizing Dye 3

(Sensitizing Dye VII-2 Described in JP-A-2000-221628)

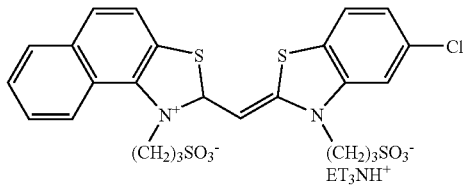

The samples 101C and 116C which were prepared as described above were exposed for 1/100 second through a gelatin filter SC-39 manufactured by Fuji Photo Film Co., Ltd. (a long wavelength light transmission filter whose cut-off wavelength is 390 nm) and a continuous wedge. The sensitivity of the blue-sensitive layer was calculated by carrying out development processing described below and measuring respective densities with three filter conditions (a blue filter, a green filter and a red filter). The sensitivity was represented by the relative value of logarithm of the reciprocal number of exposure represented by lux-sec which provides a fog enhancement of 0.2. With respect to the fog density, a processing solution in which 2-methyl-4-[N-ethyl-N-(β-hydroxyethyl)amino]aniline sulfate of a main development reagent was removed from a development solution was prepared, and the fogging density was calculated from processing difference between the presence and absence of the main development reagent.

With respect to pressure property, the test of pressure property was carried out according to the following test method A. Then, exposure for sensitometry was provided to carry out the above color development.

Test Method A

The test method is that after a sample was placed in atmosphere of relative humidity of 55% for 3 hours or more, a load of 4 g was added with a thread with a thickness of 0.1 mmϕ in the same atmosphere, and the surface of an emulsion is scratched at a speed of 1 cm/sec. With respect to the sample developed, the densities of a pressured portion and a portion not pressured were measured with a measurement slit of 5 μm×10 mm.

The increase of the fog caused by pressure is referred to as ΔFog.

Further, at an exposure region with not more than 100-fold exposure of the exposure EO providing a density of the fog+0.2, a pressure sensitivity-reducing region at which the density is lowered by 0.01 or more caused by pressure between a certain exposure E1 to an exposure E2 is set as ((logE2−logE1)/2)×100 (%). The results above were shown in Table 9.

The development was carried out in the same manner as described above.

TABLE 8

| Sample No. | Sensitizing dye | Content ratio of sensitizing dye (%)* | Compound capable of discharging electrons | Remark |
|---|---|---|---|---|
| 101C | 1/ /2 | 66.6/ /33.3 | Absence | Comp. |
| 102C | 1/ /2 | 66.6/ /33.3 | Exemplified compound 7 | Comp. |
| 103C | 1/ /2 | 66.6/ /33.3 | Exemplified compound 37 | Comp. |
| 104C | 1/ /2 | 66.6/ /33.3 | T-1 | Comp. |
| 105C | 1/3/2 | 33.3/33.3/33.3 | Absence | Comp. |
| 106C | 1/3/2 | 33.3/33.3/33.3 | Exemplified compound 7 | Comp. |
| 107C | 1/3/2 | 33.3/33.3/33.3 | Exemplified compound 37 | Comp. |
| 108C | 1/3/2 | 33.3/33.3/33.3 | T-1 | Comp. |
| 109C | 1/B-10/2 | 33.3/33.3/33.3 | Absence | Comp. |
| 110C | 1/B-10/2 | 33.3/33.3/33.3 | Exemplified compound 7 | Inv. |
| 111C | 1/B-10/2 | 33.3/33.3/33.3 | Exemplified compound 37 | Inv. |
| 112C | 1/B-10/2 | 33.3/33.3/33.3 | T-1 | Inv. |
| 113C | 1/B-1/2 | 33.3/33.3/33.3 | Absence | Comp. |
| 114C | 1/B-1/2 | 33.3/33.3/33.3 | Exemplified compound 7 | Inv. |
| 115C | 1/B-1/2 | 33.3/33.3/33.3 | Exemplified compound 37 | Inv. |
| 116C | 1/B-1/2 | 33.3/33.3/33.3 | T-1 | Inv. |

*Total amounts of sensitizing dyes were unified into $3.5\times10^{-4}$ mol/mol Ag.

TABLE 9

| Sample No. | Blue filter fog | Blue filter sensitivity* | Pressure property ΔFog | Pressure sensitivity-reducing region | Remark |
|---|---|---|---|---|---|
| 101C | 0.15 | 100 | 0.13 | 58% | Comp. |
| 102C | 0.30 | 173 | 0.27 | 25% | Comp. |
| 103C | 0.25 | 132 | 0.30 | 24% | Comp. |
| 104C | 0.28 | 117 | 0.32 | 25% | Comp. |
| 105C | 0.13 | 98 | 0.20 | 65% | Comp. |
| 106C | 0.26 | 172 | 0.30 | 28% | Comp. |
| 107C | 0.20 | 131 | 0.33 | 28% | Comp. |
| 108C | 0.22 | 116 | 0.35 | 30% | Comp. |
| 109C | 0.13 | 105 | 0.17 | 62% | Comp. |
| 110C | 0.23 | 195 | 0.18 | 23% | Inv. |
| 111C | 0.18 | 145 | 0.17 | 22% | Inv. |
| 112C | 0.20 | 126 | 0.18 | 22% | Inv. |
| 113C | 0.13 | 102 | 0.16 | 60% | Comp. |
| 114C | 0.25 | 181 | 0.15 | 22% | Inv. |
| 115C | 0.20 | 133 | 0.15 | 21% | Inv. |
| 116C | 0.23 | 119 | 0.16 | 22% | Inv. |

*Sensitivities of Samples Nos. 102C to 116C are relative values assuming the sensitivity of Sample 101C is 100.

From the above results, it is grasped that the silver halide color photosensitive material with high sensitivity and low pressure fogging is obtained by using the sensitizing dye of the invention and the compound capable of discharging electrons of the invention. It is also grasped that the combination with the exemplification compound 7 is more preferable by comparing the exemplification compound 7 in which one electron oxidation product preparing by one electron oxidation can discharge two electrons, in comparison with the exemplification compounds 37 to T-1 in which one electron oxidation product preparing by one electron oxidation can discharge one electron.

EXAMPLE 2C

In the sample 505 of Example 5 of JP-A-2001-142170, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the photosensitive material in which pressure property was improved by tabular grains having a large size zone.

EXAMPLE 3C

In the sample 202 of Example 4 of JP-A-2001-159799, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the large size tabular emulsions with high sensitivity and having little processing dependency.

EXAMPLE 4C

In the sample 905 of Example 7 of JP-A-2000-347336, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the photosensitive material comprising inorganic grains in the dispersing medium phase of an emulsion.

EXAMPLE 5C

In the sample 904 of Example 9 of JP-A-11-295832, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion containing tabular grains having a high level iodine layer formed by suddenly preparing iodide ions from an iodide ion-discharging agent.

EXAMPLE 6C

In the sample 222 of Example 8 of JP-A-2000-321698, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion containing tabular grains in which an aspect ratio is 8 or more, an average iodine content is 2 mol or more, ten or more dislocation lines per one grain exist, and the variation coefficient of iodine distribution between grains is 20% or less.

EXAMPLE 7C

In the sample 109 of Example 1 of JP-A-2000-231175, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1).

EXAMPLE 8C

In the sample 302 of Example 3 of JP-A-2001-324773, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1).

EXAMPLE 9C

Samples in the presence or absence of the compounds capable of discharging electrons were prepared by introducing the infrared absorbents (62), (63), (64), (72), (74) and (87) of JP-A-9-96891 into the second layer of Example 1C of the invention, and using the respective sensitizing dyes of the invention and the comparison in the same manner as in Example 1C. When the same evaluation as in Example 1C was carried out, good photograph property with high sensitivity and little pressure fog was obtained.

EXAMPLE 10C

In the sample 403 of Example 4 of JP-A-2001-228572, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion containing tabular silver iodobromide or iodochlorobromide grains having a (111) plane as a principal plane in which the variation coefficient of an equivalent circular diameter is 3% to 40%, an equivalent circular diameter is 1.0 μm or more, the thickness of grains is 0.10 μm or less, and the portions of a side and a corner are not lost.

EXAMPLE 11C

In Example 6 of JP-A-2001-264911, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the photosensitive material in which pressure property and preservation stability were improved by tabular grains having a large size zone.

EXAMPLE 12C

In the sample 713 of Example 7 of JP-A-2001-281778, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion containing silver iodobromide or iodochlorobromide grains having a thickness of 0.1 μm or less which has an electron catching zone and has a silver iodobromide phase in which an annual ring is not observed.

EXAMPLE 13C

In the sample 205 of Example 2 of JP-A-2001-296627, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion which reduced the generation of non tabular grains, particularly rod grains caused by preparation of the tabular grains.

EXAMPLE 14C

In the sample 303 of Example 3 of JP-A-2002-169240, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion in which the stability of solubility in the lapse of time of the coating solution was improved.

EXAMPLE 15C

In the sample 205 of Example 2 of JP-A-2001-255613, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the (111) tabular grains having little pressure fog of a large size zone.

EXAMPLE 16C

In the sample 304 of Example 3 of JP-A-2002-268162, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the tabular grains which reduced fog at preservation in the lapse of time.

EXAMPLE 17C

In the sample 209 of Example 3 of JP-A-2001-235821, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the entire epitaxial emulsion in which the content of silver chloride is 1% by mole or more and 6% by mol or less, and the content of silver iodide is 0.5% by mole or more and 10% by mol or less.

EXAMPLE 18C

In the sample 202 of Example 4 of JP-A-2002-169241, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion containing tabular silver iodochlorobromide grains having a (111) plane as a principal plane which have epitaxial junctions at at least one apex portion.

EXAMPLE 19C

In Example 3 of JP-A-2002-278008, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion containing tabular silver iodochlorobromide grains having a (111) plane as a principal plane which have epitaxial junction portions in which the content of silver chloride at at least one or more of apex portions of a hexagon is 5 to 25% by mole.

EXAMPLE 20C

In the sample 303 of Example 3 of JP-A-2002-169239, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons. (the exemplification compounds 7, 37 and T-1), in the emulsion containing tabular silver iodochlorobromide grains having a (111) plane as a principal plane in which an equivalent circular diameter is 3.0 μm or more, and an aspect ratio is 8 or more, the tabular grains having epitaxial junction portions.

EXAMPLE 21C

In the sample 101 of Example 5 of JP-A-7-134351, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the photosensitive material comprising a hydrazine compound as an adsorptive group on silver halide.

EXAMPLE 22C

In the sample 602 of Example 6 of JP-A-2000-250157, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the photosensitive material comprising an emulsion containing a bispyridinium salt compound.

EXAMPLE 23C

In the sample 218 of Example 2 of JP-A-9-251193, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion produced by using the chemically modified gelatin which contains low molecular weight gelatin having a molecular weight of 70000 to 1000 in a dispersion medium solution at the nucleus formation process and in which the chemical modification rate of an amino group is 15 to 100% at the growth process in the production process of the emulsion.

EXAMPLE 24C

In the sample 103 of Example 2 of JP-A-2001-100343, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion produced in the presence of the chemically modified gelatin in which the grains growth is 40% by mass or more of a dispersion medium or low molecular weight gelatin in the production process of the emulsion.

EXAMPLE 25C

In the sample 305 of Example 3 of JP-A-2001-281780, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the emulsion containing gelatin containing a lot of a high molecular weight component.

EXAMPLE 26C

In the sample 203 of Example 3 of JP-A-3-39946, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the tabular emulsion containing mercaptobenzthiazole compounds.

EXAMPLE 27C

In the sample 001 of Example 1 of JP-A-2001-75242, emulsions were prepared by replacing the sensitizing dyes of the high-speed blue-sensitive emulsion layer with the sensitizing dyes of the invention of Example 1C of the invention, and further, samples were prepared by adding the compounds capable of discharging electrons of Example 1C of the invention to the high-speed blue-sensitive emulsion layer. Samples in the presence or absence of the compound capable of discharging electrons were prepared by using the respective sensitizing dyes of the invention and the comparison in the same manner as in Example 1C. When the same evaluation as in Example 1C was carried out, photograph property with high sensitivity and little pressure fog was obtained by using the sensitizing dyes (B-10 and B-1) of the invention in combination with the compounds capable of discharging electrons (the exemplification compounds 7, 37 and T-1), in the photosensitive material with high sensitivity which enabled faithful color reproduction.

EXAMPLE 1D (Preparation of Multilayer Coating Sample and Evaluation Thereof)

1) Support

The support used in the Examples was prepared by the following method.

After drying 100 parts by mass of a polyethylene-2,6-naphthalate polymer and 2 parts by mass of Tinuvin P.326 (manufactured by Chiba Geigy Co., Ltd.), they were melted at 300° C. and then extruded from a T-die, 3.3-fold longitudinal orientation was carried out at 140°, successively, 3.3-fold horizontal orientation was carried out at 130° C., and they were further thermally fixed at 250° for 6 seconds to obtain a PEN (polyethylene naphthalate) film with a thickness of 90 μm. Note that, appropriate amounts of a blue dye, a magenta dye and a yellow dye (I-1, I-4, I-6, I-24, I-26, I-27 and II-5) described in Unexamined Technical Procedure: UT No. 94-6023) were added to the PEN film. Further, it was wound up on a stainless wound core with a diameter of 20 cm, and thermal hysteresis was provided at 110° C. for 48 hours to prepare a support hardly wound.

2) Coating of Under-Coating Layer

After corona discharge treatment, UV discharge treatment and further glow discharge treatment were carried out on both sides of the above-mentioned support, the under-coating solution of 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2O$ and 0.02 g/m$^2$ of a polyamide-epichlorohydrin polycondensate was coated on the respective faces (10 ml/m$^2$, a bar coater was used), and an under coating layer was provided on a high temperature side at orientation. Drying was carried out at 115° C. for 6 minutes (all of a roller and a conveyance device at a drying zone are set at 115° C.).

3) Coating of Back Layer

An antistatic layer, a magnetic recording layer and further a lubricating layer were coated on one side face of the above-mentioned support as the back layer.

3-1) Coating of Antistatic Layer 0.2 g/m$^2$ of the dispersion product (a secondary agglomerated particle diameter of about 0.08 μm) of fine grain powder in which the specific resistance of a tin oxide-antimony dioxide composite with an average grain diameter of 0.005 μm is 5 Ω·cm, 0.05 g/m$^2$ of gelatin, 0.02 g/m$^2$ of$(CH_2{=}CHSO_2CH_2CH_2NHCO)_2CH_2O$, 0.005g/m$^2$ of a poly(a degree of polymerization of 10) oxyethylene-p-nonylphenol and resorcin were coated.

3-2) Coating of Magnetic Recording Layer 0.06 g/m$^2$ of cobalt-γ-iron oxide (a specific surface area of 43 g/m$^2$, a long axis of 0.14 μm, a short axis of 0.03 μm, a saturated magnetism of 89 Am$^2$/kg, $Fe^{2+}/Fe^{3+}$=6/94, the surface is treated with aluminum oxide-silicon oxide by 2% by mass of iron oxide) which was coating-treated with a 3-poly(a degree of polymerization of 15) oxyethylene-propyloxytrimethoxysilane (15% by mass) was coated with a bar coater using 1.2 g/m$^2$ of diacetylcellulose (the dispersion of iron oxide was carried out with an open kneader and a sand mill), 0.3 g/m$^2$ of $C_2H_5C(CH_2OCONH{-}C_6H_3(CH_3)NCO)_3$ as a curing agent, and acetone, methyl ethyl ketone and cyclohexanone as a solvent to obtain a magnetic recording layer with a film thickness of 1.2 μm. Silica grains (0.3 μm) as a matting agent and aluminum oxide (0.15 μm) which was coating-treated with the 3-poly(a degree of polymerization of 15) oxyethylene-propyloxytrimethoxysilane (15% by mass) were added so as to be respectively 10 mg/m$^2$. Drying was carried out at 115° C. for 6 minutes (all of a roller and a conveyance device at a drying zone are set at 115° C.). The increasing proportion of color density of $D^B$ at the magnetic recording layer with an X-light (blue filter) was about 0.1, the saturated magnetism moment of the magnetic recording layer was 4.2 $\mu m^2$/kg, and holding power was $7.3\times10^4$ A/m and a square shape ratio was 65%.

3-3) Coating of Lubricating Layer

A mixture of diacetylcellulose (25 mg/$m^2$) and $C_6H_{13}CH(OH)C_{10}H_{20}0COOC_{40}H_{81}$ (the compound a, 6 mg/$m^2$)/$C_{50}H_{101}O(CH_2CH_2O)_{16}H$ (the compound b, 9 mg/$m^2$) was coated. Further, the mixture was melted at 105° C. in xylene/propylenemonomethylether (1/1), poured in propylene monomethyl ether (10-fold amount) at normal temperature and dispersed to prepare emulsion, and it was converted to a dispersion (an average particle diameter of 0.01 μm) in acetone to be added. Silica grains (0.3 μm) as a matting agent and aluminum oxide (0.15 μm) which was coating-treated with the 3-poly(a degree of polymerization of 15) oxyethylene-propyloxytrimethoxysilane (15% by mass) were added so as to be respectively 15 mg/$m^2$. Drying was carried out at 115° C. for 6 minutes (all of a roller and a conveyance device at a drying zone are set at 115° C.). The lubricating layer was a dynamic frictional coefficient of 0.06 (a stainless hard ball of 5 mmϕ, a load of 100 g, and a peed of 6 cm/min.), a static frictional coefficient of 0.07 (a clipping method) and the dynamic frictional coefficient between an emulsion face and a lubricating layer which are described later of 0.12, and was a superior characteristic.

4) Coating of Photosensitive Layer

Then, the respective layers having the following compositions were coated in duplication at the reverse side of the back layer obtained as described above, to prepare the sample 101D which is the negative color photosensitive material.

The physical properties of the silver halide emulsions Em-A to Em-O are shown in Table 10.

TABLE 10

| Emulsion name | Layer used | Grain shape | Average equivalent-sphere diameter (μm) |
|---|---|---|---|
| Em-A | High-speed blue-sensitive layer | (111) main plane tabular grain | 1.6 |
| Em-B | Low-speed blue-sensitive layer | (111) main plane tabular grain | 0.9 |
| Em-C | Low-speed blue-sensitive layer | (111) main plane tabular grain | 0.5 |
| Em-D | Low-speed blue-sensitive layer | (111) main plane tabular grain | 0.2 |
| Em-E | Layer for donating interlayer effect to red-sensitive layer | (111) main plane tabular grain | 1.1 |
| Em-F | High-speed green-sensitive layer | (111) main plane tabular grain | 1.2 |
| Em-G | Medium-speed green-sensitive layer | (111) main plane tabular grain | 0.9 |
| Em-H | Low and medium-speed green-sensitive layers | (111) main plane tabular grain | 0.6 |
| Em-I | Low-speed green-sensitive layer | (111) main plane tabular grain | 0.5 |
| Em-j | Low-speed green-sensitive layer | (111) main plane tabular grain | 0.4 |
| Em-K | High-speed red-sensitive layer | (111) main plane tabular grain | 1.2 |
| Em-L | Medium-speed red-sensitive layer | (111) main plane tabular grain | 0.9 |
| Em-M | Low and medium-speed red-sensitive layers | (111) main plane tabular grain | 0.6 |
| Em-N | Low-speed red-sensitive layer | (111) main plane tabular grain | 0.4 |
| Em-O | Low-speed red-sensitive layer | (111) main plane tabular grain | 0.3 |

TABLE 10-continued

| Emulsion name | Average equivalent-circle diameter (μm)/variation coefficient (%) | Average grain thickness (μm)/variation coefficient (%) | Average aspect Ratio | Ratio of tabular grains to total projected area occupied by all the grains (%) |
|---|---|---|---|---|
| Em-A | 5.2/26 | 0.101/29 | 51 | 97 |
| Em-B | 2.3/19 | 0.092/23 | 25 | 99 |
| Em-C | 0.9/18 | 0.103/19 | 8.7 | 99 |
| Em-D | 0.2/7 | 0.2/7 | 1 | 0 |
| Em-E | 3.0/18 | 0.099/16 | 30 | 96 |
| Em-F | 6.0/18 | 0.032/16 | 188 | 99 |
| Em-G | 3.8/23 | 0.034/17 | 112 | 99 |
| Em-H | 1.8/20 | 0.044/13 | 41 | 99 |
| Em-I | 1.2/21 | 0.058/13 | 21 | 97 |
| Em-J | 1.0/17 | 0.043/12 | 23 | 96 |
| Em-K | 5.4/18 | 0.40/15 | 135 | 99 |
| Em-L | 3.6/23 | 0.038/16 | 95 | 99 |
| Em-M | 1.5/20 | 0.064/12 | 23 | 97 |
| Em-N | 0.9/17 | 0.053/11 | 17 | 96 |
| Em-O | 0.7/18 | 0.037/10 | 19 | 96 |

| Emulsion name | Characteristics of grains accounting for 70% or more of the total projected area |
|---|---|
| Em-A | Density of dislocation lines at fringe portions was high. |
| Em-B | Density of dislocation lines at fringe portions was high. |
| Em-C | Density of dislocation lines at fringe portions and main planes was high. |
| Em-D | No dislocation lines were observed. |
| Em-E | Density of dislocation lines at fringe portions was high. |
| Em-F | Perfect epitaxial jc. at six apex portions of hex.tabular grain were observed. |
| Em-G | Perfect epitaxial jc. at six apex portions of hex.tabular grain were observed. |
| Em-H | Perfect epitaxial jc. at six apex portions of hex.tabular grain were observed. |
| Em-I | Perfect epitaxial jc. at six apex portions of hex.tabular grain were observed. |
| Em-J | Perfect epitaxial jc. at six apex portions of hex.tabular grain were observed. |
| Em-K | Perfect epitaxial jc. at six apex portions of hex.tabular grain were observed. |
| Em-L | Perfect epitaxial jc. at six apex portions of hex.tabular grain were observed. |
| Em-M | Perfect epitaxial jc. at six apex portions of hex.tabular grain were observed. |
| Em-N | Perfect epitaxial jc. at six apex portions of hex.tabular grain were observed. |
| Em-O | Perfect epitaxial jc. at six apex portions of hex.tabular grain were observed. |

| Emulsion name | Silver amount ratio of grain structure (%) and halogen composition (listed in order from center of grain); < > indicates epitaxial junction |
|---|---|
| Em-A | (1%) AgBr/(10%) $AgBr_{90}I_{10}$/(60%) $AgBr_{85}I_{15}$/(12%) AgBr/(4%)AgI/(13%) AgBr |
| Em-B | (1%) AgBr/(20%) $AgBr_{90}I_{10}$/(50%) $AgBr_{85}I_{15}$/(6%) AgBr/(3%) AgI/(19%) AgBr |
| Em-C | (15%) AgBr/(40%) $AgBr_{97}I_3$/(10%) AgBr/(2%) AgI/(33%) AgBr |
| Em-D | (35%) AgBr/(25%) $AgBr_{90}I_{10}$/(1%) AgI/(39%) AgBr |
| Em-E | (8%) AgBr/(35%) $AgBr_{97}I_3$/(15%) AgBr/(4%) AgI/(38%) AgBr |
| Em-F | (7%) AgBr/(66%) $AgBr_{97}I_3$/(25%) $AgBr_{86}I_{14}$/(2%) ($AgBr_{60}Cl_{30}I_{10}$) |
| Em-G | (15%) AgBr/(67%) $AgBr_{97}I_3$/(15%) $AgBr_{93}I_7$/(3%) ($AgBr_{70}Cl_{25}I_5$) |
| Em-H | (15%) AgBr/(65%) $AgBr_{99}I_1$/(15%) $AgBr_{95}I_5$/(5%) ($AgBr_{80}Cl_{20}$) |
| Em-I | (82%) AgBr/(10%) $AgBr_{95}I_5$/(8%) ($AgBr_{75}Cl_{20}I_5$) |
| Em-J | (78%) AgBr/(10%) $AgBr_{95}I_5$/(12%) ($AgBr_{75}Cl_{20}I_5$) |
| Em-K | (7%) AgBr/(66%) $AgBr_{97}I_3$/(25%) $AgBr_{86}I$ /(2%) ($AgBr_{60}Cl_{30}I_{10}$) |
| Em-L | (15%) AgBr/(67%) $AgBr_{97}I_3$/(15%) $AgBr_{93}I_7$/(3%) ($AgBr_{70}Cl_{25}I_5$) |
| Em-M | (15%) AgBr/(65%) $AgBr_{99}I_1$/(15%) $AgBr_{95}I_5$/(5%) ($AgBr_{80}Cl_{20}$) |

TABLE 10-continued

| | |
|---|---|
| Em-N | (78%) AgBr/(10%) $AgBr_{95}I_5$/(12%) ($AgBr_{75}Cl_{20}I_5$) |
| Em-O | (78%) AgBr/(10%)$AgBr_{95}I_5$/(12%) ($AgBr_{70}Cl_{20}I_{10}$) |

| Emulsion name | Average iodide content (mol %)/ inter-grain variation coefficient (%) | Surface iodide content (mol %) | Average chloride content (mol %)/ inter-grain variation coefficient (%) | Surface chloride content (mol %) | Twin plane spacing (μm)/ variation coefficient (%) | (100) face ratio in side planes (%) |
|---|---|---|---|---|---|---|
| Em-A | 14/17 | 8 | 0 | 0 | 0.013/25 | 21 |
| Em-B | 12.5/22 | 7 | 0 | 0 | 0.011/18 | 32 |
| Em-C | 3.2/15 | 2 | 0 | 0 | 0.011/22 | 18 |
| Em-D | 3.5/8 | 0.9 | 0 | 0 | — | — |
| Em-E | 5.1/9 | 3.5 | 0 | 0 | 0.010/22 | 3 |
| Em-F | 5.7/9 | 12 | 0.6/<10 | 2 | 0.008/18 | 8 |
| Em-G | 1.4/7 | 6 | 0.8/<10 | 2 | 0.008/18 | 10 |
| Em-H | 0.9/8 | 4 | 1/<10 | 3 | 0.008/18 | 12 |
| Em-I | 1.1/8 | 4 | 1.6/<10 | 5 | 0.008/18 | 25 |
| Em-J | 2.0/14 | 4 | 2.4/8 | 7 | 0.008/18 | 17 |
| Em-K | 5.7/9 | 12 | 0.6/<10 | 2 | 0.008/18 | 8 |
| Em-L | 3.2/7 | 6 | 0.8/<10 | 2 | 0.008/18 | 10 |
| Em-M | 1.4/7 | 4 | 1/<10 | 3 | 0.008/18 | 12 |
| Em-N | 1.1/8 | 4 | 2.4/8 | 7 | 0.008/18 | 17 |
| Em-O | 1.7/8 | 4 | 2.4/8 | 7 | 0.008/18 | 22 |

| Emulsion name | Sensitizing dye | Dopant | Chemical sensitization, antifoggant, etc. |
|---|---|---|---|
| Em-A | ExS-1, 2 | $K_2IrCl_6$ | Prepared by appropriately being selected and combined based on the contents described in the above patent literatures. |
| Em-B | ExS-1, 2 | $K_2IrCl_6$ | Prepared by appropriately being selected and combined based on the contents described in the above patent literatures. |
| Em-C | ExS-1, 2 | $K_2RhCl_6$,$K_2IrCl_6$ | Prepared by appropriately being selected and combined based on the contents described in the above patent literatures. |
| Em-D | ExS-1, 2 | $K_2IrCl_6$ | Prepared by appropriately being selected and combined based on the contents described in the above patent literatures. |
| Em-E | ExS-3, 4 | $K_2IrCl_6$,$K_2IrCl_5(H_2O)$, $K_4Fe(CN)_6$ | Prepared by appropriately being selected and combined based on the contents described in the above patent literatures. |
| Em-F | ExS-3, 5, 6, 7, 8 | $K_2IrCl_6$,$K_2IrCl_5(H_2O)$, $K_4Fe(CN)_6$ | Prepared by appropriately being selected and combined based on the contents described in the above patent literatures. |
| Em-G | ExS-3, 5, 6, 7, 8 | $K_2IrCl_6$,$K_2IrCl_5(H_2O)$, $K_4Fe(CN)_6$ | Prepared by appropriately being selected and combined based on the contents described in the above patent literatures. |
| Em-H | ExS-3, 5, 6, 7, 8 | $K_2IrCl_6$,$K_2IrCl_5(H_2O)$, $K_4Fe(CN)_6$ | Prepared by appropriately being selected and combined based on the contents described in the above patent literatures. |
| Em-I | ExS-3, 5, 6, 7, 8 | $K_2IrCl_6$,$K_2IrCl_5(H_2O)$, $K_4Fe(CN)_6$ | Prepared by appropriately being selected and combined based on the contents described in the above patent literatures. |
| Em-J | ExS-3, 5, 6, 7, 8 | $K_2IrCl_6$,$K_2IrCl_5(H_2O)$, $K_4Fe(CN)_6$ | Prepared by appropriately being selected and combined based on the contents described in the above patent literatures. |
| Em-K | ExS-9, 10, 11 | $K_2IrCl_6$,$K_2IrCl_5(H_2O)$, $K_4Fe(CN)_6$ | Prepared by appropriately being selected and combined based on the contents described in the above patent literatures. |
| Em-L | ExS-9, 10, 11 | $K_2IrCl_6$,$K_2IrCl_5(H_2O)$, $K_4Fe(CN)_6$ | Prepared by appropriately being selected and combined based on the contents described in the above patent literatures. |
| Em-M | ExS-9, 10, 11 | $K_2IrCl_6$,$K_2IrCl_5(H_2O)$, $K_4Fe(CN)_6$ | Prepared by appropriately being selected and combined based on the contents described in the above patent literatures. |
| Em-N | ExS-9, 10, 11 | $K_2IrCl_6$,$K_2IrCl_5(H_2O)$, $K_4Fe(CN)_6$ | Prepared by appropriately being selected and combined based on the contents described in the above patent literatures. |
| Em-O | ExS-9, 10, 11 | $K_2IrCl_6$,$K_2IrCl_5(H_2O)$, $K_4Fe(CN)_6$ | Prepared by appropriately being selected and combined based on the contents described in the above patent literatures. |

K, K-1 to K-3, F, F-1 to F-3, A and A-1 to A-3 which were shown in Table 11 were prepared by adding the compounds 7, 37 and T-1 of the invention to the respective emulsions by $3\times10^{-6}$ mol/mol Ag, for the emulsion K of the sixth layer, the emulsion F of the eleventh layer and the emulsion A of the fourteenth layer.

TABLE 11

| Compound name | 6th layer emulsion | 11th layer emulsion | 14th layer emulsion |
|---|---|---|---|
| Absence | K | F | A |
| 37 | K-1 | F-1 | A-1 |
| 7 | K-2 | F-2 | A-2 |
| T-1 | K-3 | F-3 | A-3 |

The sample 102D in which the emulsion K of the sixth layer, the emulsion F of the eleventh layer and the emulsion A of the fourteenth layer were replaced with the emulsion of the invention described in Table 11 for the sample 101D was prepared, and the samples 103D to 109D as shown in Table 12 were prepared by reducing the amount of the emulsions of the sixth layer, the eleventh layer and the fourteenth layer.

TABLE 12

| Sample No. | 6th layer Emul-sion | 6th layer Silver amount (g/m$^2$) | 11th layer Emul-sion | 11th layer Silver amount (g/m$^2$) | 14th layer Emul-sion | 14th layer Silver amount (g/m$^2$) | Sum of coating amounts of silver of 6th, 11th and 14th layers (g/m$^2$) | Total coating amounts of silver (g/m$^2$) |
|---|---|---|---|---|---|---|---|---|
| 101D (Comp.) | K | 1.49 | F | 1.42 | A | 1.44 | 4.35 | 6.15 |
| 102D (Comp.) | K-2 | 1.49 | F-2 | 1.42 | A-2 | 1.44 | 4.35 | 6.15 |
| 103D (Comp.) | K | 2.74 | F | 2.70 | A | 2.72 | 8.16 | 9.96 |
| 104D (Comp.) | K | 0.76 | F | 0.73 | A | 0.76 | 2.25 | 4.05 |
| 105D (Inv.) | K-1 | 0.83 | F-1 | 0.80 | A-1 | 0.81 | 2.44 | 4.25 |
| 106D (Inv.) | K-2 | 0.76 | F-2 | 0.73 | A-2 | 0.76 | 2.25 | 4.05 |
| 107D (Inv.) | K-3 | 0.90 | F-3 | 0.87 | A-3 | 0.88 | 2.65 | 4.45 |
| 108D (Inv.) | K-2 | 1.36 | F-2 | 1.29 | A-2 | 1.30 | 3.95 | 5.75 |
| 109D (Comp.) | K | 1.36 | F | 1.29 | A | 1.30 | 3.95 | 5.75 |

* By decreasing the silver amounts, 6th, 11th and 14th layers of Samples 105D to 108D were adjusted to obtain the same sensitivities as those of 6th, 11th and 14th layers, respectively, of sample 101D.

(Compositions of light-sensitive layers)

1st Layer (1st Antihalation Layer)

| | | |
|---|---|---|
| Black colloidal silver | silver | 0.043 |
| Gelatin | | 0.66 |
| ExM-1 | | 0.048 |
| Cpd-2 | | 0.001 |
| F-8 | | 0.001 |
| HBS-1 | | 0.090 |
| HBS-2 | | 0.010 |

2nd Layer (2nd Antihalation Layer)

| | | |
|---|---|---|
| Black colloidal silver | silver | 0.043 |
| Gelatin | | 0.80 |
| ExM-1 | | 0.057 |
| ExF-1 | | 0.002 |
| F-8 | | 0.001 |
| HBS-1 | | 0.090 |
| HBS-2 | | 0.010 |

3rd Layer (Interlayer)

| | |
|---|---|
| ExC-2 | 0.010 |
| Cpd-1 | 0.086 |
| UV-2 | 0.029 |
| UV-3 | 0.052 |
| UV-4 | 0.011 |
| HBS-1 | 0.100 |
| Gelatin | 0.600 |

4th Layer (Low-speed red-sensitive emulsion layer)

| | | |
|---|---|---|
| Em-M | silver | 0.175 |
| Em-N | silver | 0.211 |
| Em-O | silver | 0.043 |
| ExC-1 | | 0.222 |
| ExC-2 | | 0.010 |
| ExC-3 | | 0.072 |
| ExC-4 | | 0.148 |
| ExC-5 | | 0.005 |
| ExC-6 | | 0.008 |
| ExC-12 | | 0.071 |
| ExC-13 | | 0.010 |
| UV-2 | | 0.036 |

-continued

| | |
|---|---|
| UV-3 | 0.067 |
| UV-4 | 0.014 |
| Cpd-2 | 0.010 |
| Cpd-4 | 0.012 |
| HBS-1 | 0.240 |
| HBS-5 | 0.010 |
| Gelatin | 1.500 |

5th Layer (Medium-speed red-sensitive emulsion layer)

| | | |
|---|---|---|
| Em-L | silver | 0.160 |
| Em-M | silver | 0.110 |
| ExC-1 | | 0.111 |
| ExC-2 | | 0.039 |
| ExC-3 | | 0.018 |
| ExC-4 | | 0.074 |
| ExC-5 | | 0.019 |
| ExC-6 | | 0.024 |
| ExC-12 | | 0.010 |
| ExC-13 | | 0.021 |
| Cpd-2 | | 0.020 |
| Cpd-4 | | 0.021 |
| HBS-1 | | 0.129 |
| Gelatin | | 0.850 |

6th Layer (High-speed Red-sensitive Emulsion Layer)

| | | |
|---|---|---|
| Em-K | silver | 1.490 |
| ExC-1 | | 0.122 |
| ExC-6 | | 0.032 |
| ExC-12 | | 0.110 |
| ExC-13 | | 0.005 |
| ExC-14 | | 0.159 |
| Cpd-2 | | 0.068 |
| Cpd-4 | | 0.015 |
| HBS-1 | | 0.440 |
| Gelatin | | 1.510 |

7th Layer (Interlayer)

| | |
|---|---|
| Cpd-1 | 0.081 |
| Cpd-7 | 0.002 |
| Solid disperse dye ExF-4 | 0.015 |
| HBS-1 | 0.049 |

-continued

| | |
|---|---|
| Polyethylacrylate latex | 0.088 |
| Gelatin | 0.800 |

8th Layer (Layer for Donating Interlayer Effect to Red-sensitive Layer)

| | | |
|---|---|---|
| Em-E | silver | 0.170 |
| Cpd-4 | | 0.010 |
| ExM-2 | | 0.082 |
| ExM-3 | | 0.006 |
| ExM-4 | | 0.026 |
| ExY-1 | | 0.010 |
| ExY-6 | | 0.040 |
| ExC-15 | | 0.007 |
| HBS-1 | | 0.203 |
| HBS-3 | | 0.003 |
| HBS-5 | | 0.010 |
| Gelatin | | 0.520 |

9th Layer (Low-speed Green-sensitive Emulsion Layer)

| | | |
|---|---|---|
| Em-H | silver | 0.064 |
| Em-I | silver | 0.098 |
| Em-J | silver | 0.100 |
| ExM-2 | | 0.388 |
| ExM-3 | | 0.040 |
| ExY-1 | | 0.003 |
| ExY-5 | | 0.002 |
| ExC-15 | | 0.009 |
| HBS-1 | | 0.337 |
| HBS-3 | | 0.018 |
| HBS-4 | | 0.260 |
| HBS-5 | | 0.110 |
| Cpd-5 | | 0.010 |
| Gelatin | | 1.450 |

10th Layer (Medium-speed Green-sensitive Emulsion Layer)

| | | |
|---|---|---|
| Em-G | silver | 0.117 |
| Em-H | silver | 0.051 |
| ExM-2 | | 0.084 |
| ExM-3 | | 0.012 |
| ExM-4 | | 0.005 |
| ExY-5 | | 0.002 |
| ExC-6 | | 0.003 |
| ExC-15 | | 0.007 |
| ExC-12 | | 0.008 |
| HBS-1 | | 0.096 |
| HBS-3 | | 0.002 |
| HBS-5 | | 0.002 |
| Cpd-5 | | 0.004 |
| Gelatin | | 0.420 |

11th Layer (High-speed Green-sensitive Emulsion Layer)

| | | |
|---|---|---|
| Em-F | silver | 1.42 |
| ExC-6 | | 0.002 |
| ExC-12 | | 0.010 |
| ExM-1 | | 0.014 |
| ExM-2 | | 0.023 |
| ExM-3 | | 0.023 |
| ExM-4 | | 0.005 |
| ExM-7 | | 0.040 |
| ExY-5 | | 0.003 |

-continued

| | |
|---|---|
| Cpd-3 | 0.004 |
| Cpd-4 | 0.007 |
| Cpd-5 | 0.010 |
| HBS-1 | 0.259 |
| HBS-5 | 0.020 |
| Polyethylacrylate latex | 0.099 |
| Gelatin | 1.110 |

12th Layer (Yellow Filter Layer)

| | |
|---|---|
| Cpd-1 | 0.088 |
| Oil-soluble dye ExF-2 | 0.051 |
| Solid disperse dye ExF-8 | 0.010 |
| HBS-1 | 0.049 |
| Gelatin | 0.540 |

13th Layer (Low-speed Blue-sensitive Emulsion Layer)

| | | |
|---|---|---|
| Em-B | silver | 0.203 |
| Em-C | silver | 0.064 |
| Em-D | silver | 0.043 |
| ExC-1 | | 0.024 |
| ExC-15 | | 0.011 |
| ExY-1 | | 0.002 |
| ExY-2 | | 0.956 |
| ExY-6 | | 0.091 |
| Cpd-2 | | 0.037 |
| Cpd-3 | | 0.004 |
| HBS-1 | | 0.372 |
| HBS-5 | | 0.047 |
| Gelatin | | 2.000 |

14th Layer (High-speed Blue-sensitive Emulsion Layer)

| | | |
|---|---|---|
| Em-A | silver | 1.44 |
| ExY-2 | | 0.235 |
| ExY-6 | | 0.018 |
| Cpd-2 | | 0.075 |
| Cpd-3 | | 0.001 |
| HBS-1 | | 0.087 |
| Gelatin | | 1.300 |

15th Layer (1st Protective Layer)

| | | |
|---|---|---|
| Silver iodobromide emulsion (Average grain size: equivalent-sphere diameter 0.07 μm) | silver | 0.105 |
| UV-1 | | 0.358 |
| UV-2 | | 0.179 |
| UV-3 | | 0.254 |
| UV-4 | | 0.025 |
| F-11 | | 0.008 |
| S-1 | | 0.078 |
| ExF-10 | | 0.0024 |
| ExF-6 | | 0.0012 |
| ExF-11 | | 0.0010 |
| HBS-1 | | 0.175 |
| HBS-4 | | 0.050 |
| Gelatin | | 1.800 |

16th Layer (2nd Protective Layer)

| | |
|---|---|
| H-1 | 0.400 |
| B-1 (diameter 1.7 μm) | 0.050 |
| B-2 (diameter 1.7 μm) | 0.150 |
| B-3 | 0.050 |
| S-1 | 0.200 |
| Gelatin | 0.750 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-17, iron salt, lead salt, gold salt, platinum salt, ruthenium salt, iridium salt, and rhodium salt.

The effect of the emulsions produced by the production method of the present invention is shown in the multilayer color photosensitive material. These emulsions were prepared by appropriately being selected, combined and/or modified based on the sentences of the patents described below and/or the contents described in Examples.

The structure of the emulsions, chemical sensitization, spectral sensitization and the like were based on the contents described specifically in EP 573649B1, JP 2912768, JP-A-11-249249, JP-A-11-295832, JP-A-11-72860, U.S. Pat. Nos. 5,985,534, 5,965,343, JP 3002715, JP 3045624, JP 3045632, JP-A-2000-275771, U.S. Pat. No. 6,172,110, JP-A-2000-321702, JP-A-2000-321700, JP-A-2000-321698, U.S. Pat. No. 6,153,370, JP-A-2001-92065, JP-A-2001-92064, JP-A-2000-92059, JP-A-2001-147501, USP (Unexamined) 2001/0006768A1, JP-A-2001-228572, JP-A-2001-255613, JP-A-2001-264911, U.S. Pat. No. 6,280,920B1, JP-A-2001-264912, JP-A-2001-281778, USP (Unexamined) 2001/003143A1 and the like.

The production method for the emulsions was based on JP 2878903, JP-A-11-143002, JP-A-11-143003, JP-A-11-174612, U.S. Pat. Nos. 5,925,508, 5,955,253, JP-A-11-327072, U.S. Pat. No. 5,989,800, JP 3005382, JP 3014235, EP 04315858B1, U.S. Pat. No. 6,040,127, JP 30496647, JP 3045622, JP 3066692, EP 0563708B1, JP 3091041, JP-A-2000-338620, JP-A-2001-83651, JP-A-2001-75213, JP-A-2001-100343, U.S. Pat. No. 6,251,577B1, EP 0563701B1, JP-A-2001-281780, USP (Unexamined) 2001/0036606A1 and the like.

Preparation of Dispersion of Organic Solid Disperse Dye

The following ExF-4 was dispersed by the following methods. Namely, 21.7 mL of water, 3 mL of a 5% aqueous solution of sodium p-octylphenoxyethoxyethane sulfonate and 0.5 g of a 5% aqueous solution of p-octylphenoxypolyoxyethylene ether (a degree of polymerization of 10) were charged in a 700-mL pot mill, and 5.0 g of the dye ExF-4 and 500 mL of zirconium beads (a diameter of 1 mm) were added thereto to disperse the contents for 2 hours. A BO type vibrational ball mill manufactured by Chuou Kouki Co. was used for the dispersion. As the dispersion, the contents were taken out, they were added to 8 g of a 12.5% aqueous gelatin solution, and beads were removed by filtration to obtain a gelatin dispersion of the dye. The average particle diameter of the dye fine grains was 0.44 μm.

The oil-soluble dye ExF-2 was dispersed according to the microprecipitation dispersion method described in Example 1 of the specification of EP (Unexamined) 549489A. The average particle diameter was 0.06 μm.

The solid dispersion of ExF-8 was dispersed by the method below.

4000 g of water and 376 g of a 3% aqueous solution of W-2 were added to 2800 g of the wet cake of ExF-8 containing 18% of water to be stirred, and a slurry of a 32% concentration of ExF-8 was obtained. Then, 1700 mL of zirconia beads with an average particle diameter of 0.5 mm was filled in an ULTRA VISCO Mill (UVM-2) manufactured by Imex Inc., and they were pulverized at a peripheral speed of about 10 m/sec and a discharge amount of 0.5 L/min through slurry for 8 hours. The average particle diameter was 0.45 μm.

Compounds used for formation of the above-mentioned respective layers other than the above-mentioned compounds are shown below.

ExS-1

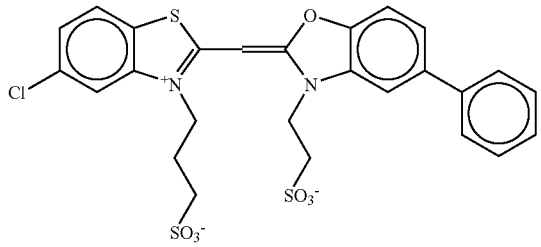

ExS-2

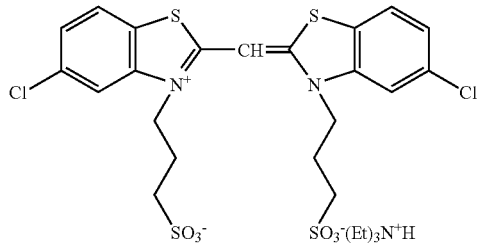

ExS-3

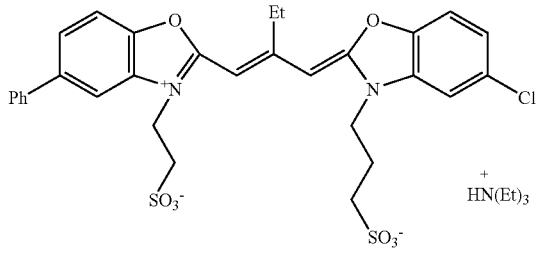

-continued
ExS-4
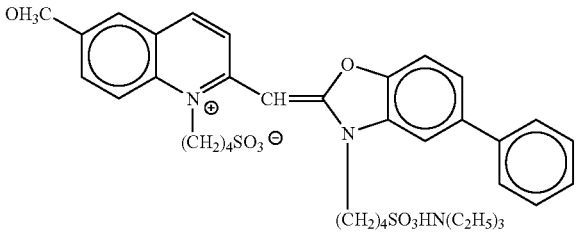
ExS-5
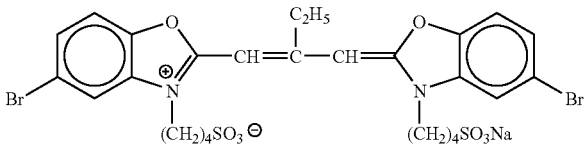
ExS-6
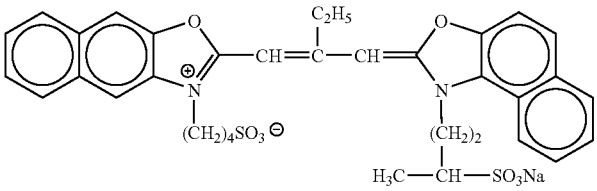
ExS-7
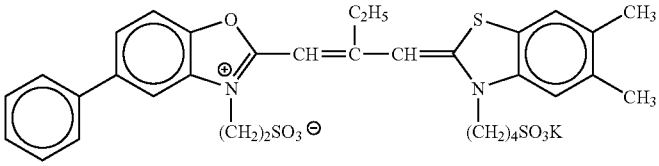
ExS-8
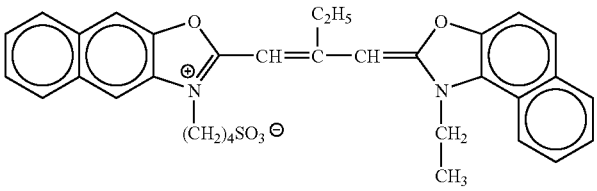
ExS-9
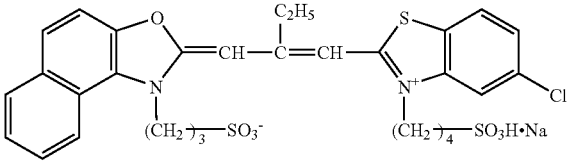
ExS-10
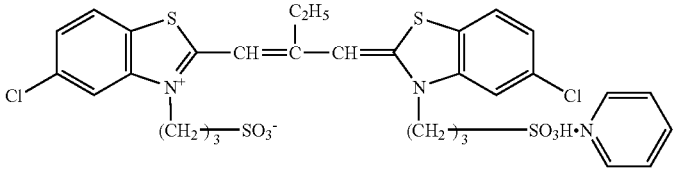
ExS-11
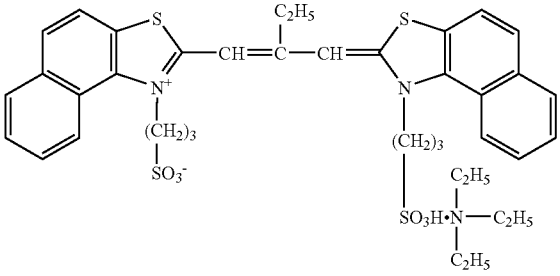

-continued
ExM-7
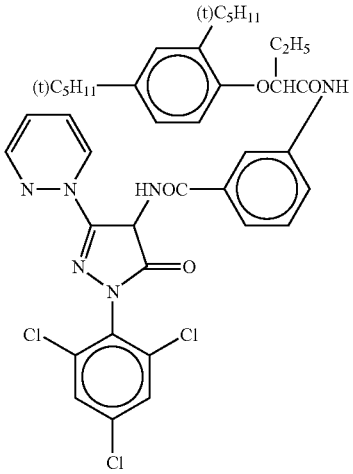
W-12
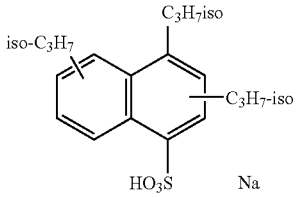
ExC-12
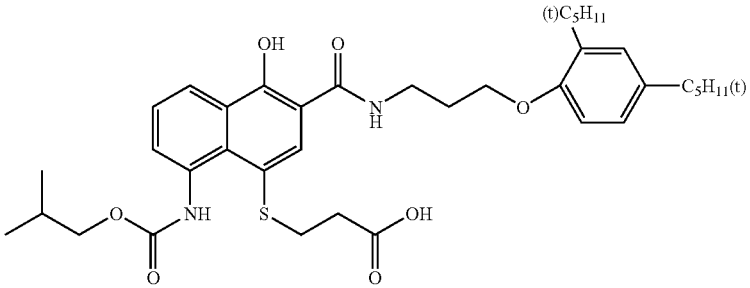
ExC-13
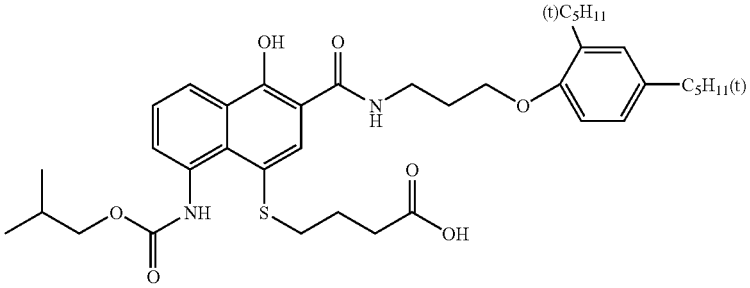
ExC-14
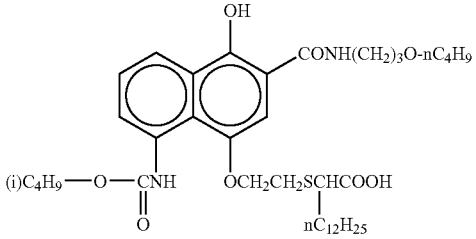
ExC-15
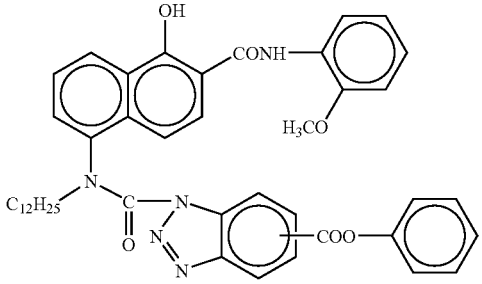

-continued

ExF-6

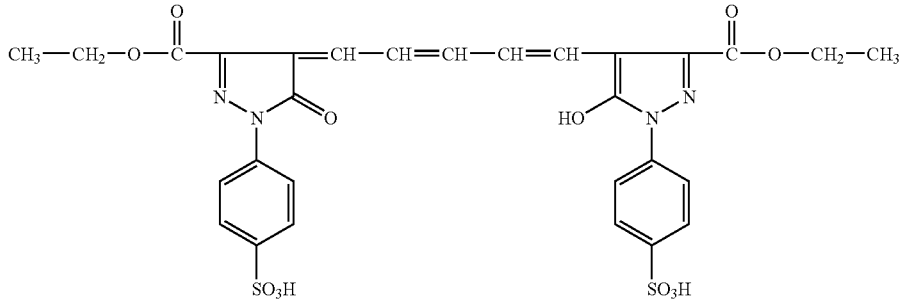

ExF8

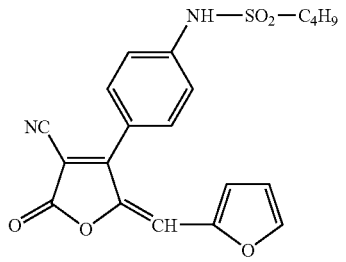

ExF-10

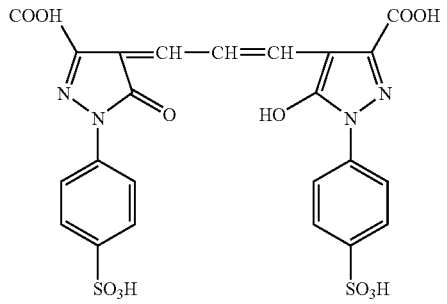

ExF11

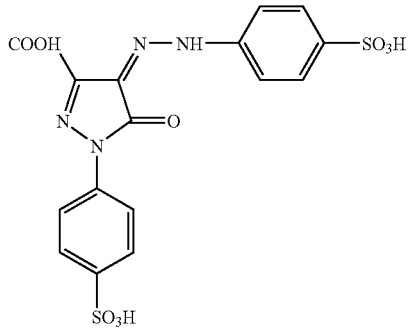

The hard film treatment of these samples 101D to 109D were carried out under conditions of a temperature of 40° C. and a relative humidity of 70% for 14 hours. Then, the samples were exposed for 1/100 second through a gelatin filter SC-39 manufactured by Fuji Photo Film Co., Ltd. (a long wavelength light transmission filter whose cut-off wavelength is 390 nm) and a continuous wedge. The evaluations of photo sensitivity, fog, grain sizes property and radiation rays resistance were carried out by respectively measuring the densities of the samples to which the following development treatment was carried out, with a red filter, a green filter and a blue filter.

The development was carried out in the same manner as described above.

The result of photo sensitivity, fog, grain sizes property and radiation rays resistance is shown in Table 13. The sensitivities were represented by the relative values of logarithm of the reciprocal numbers of exposures which were required for densities of 0.15 plus the fog densities of the respective density characteristic curves of yellow, magenta and cyan (the sensitivity of the sample 101D was referred to as 100). The grain sizes were represented by the relative values which were obtained by carrying out the same treatment as the measurement of the photo sensitivity and fog and measuring with a conventionally used RMS method (the RMS value of the sample 101D was referred to as 100). The radiation rays resistances were represented by the relative values (the radiation rays resistance of the sample 101D was-referred to as 100). In order to measure the radiation rays resistance, after the γ rays (1.173, 1.333 MeV) of radio isotope element $Co^{60}$ was irradiated on the coating samples 101D to 109D by 0.2R, the development treatment was carried out in the same manner as in the above light exposure, and the value of fog density was determined by measuring the density of this. The fog enhancement according to the irradiation of radiation rays was determined by this and from the fog density of the sample used in the light exposure, and represented by the relative value of the fog enhancement of the sample 101D. The ISO speed was represented by the prescription of International Specification.

TABLE 13*

| Sample No. | Blue filter Sensitivity** | Blue filter RMS*** | Blue filter Radiation rays resistance**** | ISO speed |
|---|---|---|---|---|
| 101D(Comp.) | 100 | 100 | 100 | 400 |
| 102D(Comp.) | 195 | 88 | 126 | 780 |
| 103D(Comp.) | 194 | 74 | 188 | 775 |
| 104D(Comp.) | 52 | 121 | 54 | 270 |

TABLE 13*-continued

| Sample No. | Blue filter Sensitivity** | Blue filter RMS*** | Blue filter Radiation rays resistance**** | ISO speed |
|---|---|---|---|---|
| 105D(Inv.) | 100 | 101 | 77 | 401 |
| 106D(Inv.) | 100 | 98 | 66 | 403 |
| 107D(Inv.) | 100 | 103 | 80 | 400 |
| 108D(Inv.) | 182 | 92 | 98 | 730 |
| 109D(Comp.) | 88 | 112 | 81 | 370 |

*The evaluation result of a blue filter was shown in Table 12. With respect to red and green filters, the same tendency as the result of the blue filter was shown.
**Sensitivities are relative values assuming the sensitivity of Sample 101D is 100.
***RMS's are relative values assuming RMS of Sample 001B is 100.
****Radiation rays resistances are relative values assuming the Radiation rays resistance of Sample 101D is 100.

From the above result, it is grasped that the silver halide color photosensitive material with high sensitivity of the ISO speed of 400 or more, without damaging grain sizes property and further excellent in radial rays resistance is obtained by using the compound capable of discharging electrons of the present invention and setting the amounts of silver at respective layers in accordance with the present invention nevertheless little amount of silver. Further, it is grasped that the combination with the exemplified compound 7 is more preferable by comparing the exemplified compound 7 by which one electron-oxidized product prepared by one electron oxidation can discharge two electrons, with the exemplified compound 37 by which one electron-oxidized product prepared by one electron oxidation discharges one electron or T-1.

EXAMPLE 2D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 505 of Example 5 of JP-A-2001-142170 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the photosensitive material in which pressure property was improved by tabular grains having a large size zone.

EXAMPLE 3D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 202 of Example 4 of JP-A-2001-159799 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the large size tabular emulsions with high sensitivity and having little processing dependency.

EXAMPLE 4D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 905 of Example 7 of JP-A-2000-347336 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the photosensitive material comprising inorganic grains in the dispersing medium phase of an emulsion.

EXAMPLE 5D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 904 of Example 9 of JP-A-11-295832 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion containing tabular grains having a high level iodine layer formed by suddenly preparing iodide ions from an iodide ion-discharging agent.

EXAMPLE 6D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 222 of Example 8 of JP-A-2000-321698 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion containing tabular grains in which an aspect ratio is 8 or more, an average iodine content is 2 mol or more, ten or more dislocation lines per one grain exist, and the variation coefficient of iodine distribution between grains is 20% or less.

EXAMPLE 7D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 109 of Example 1 of JP-A-2000-231175 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1).

EXAMPLE 8D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 302 of Example 3 of JP-A-2001-324773 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1).

EXAMPLE 9D

Samples were prepared by introducing the infrared absorbents (62), (63), (64), (72), (74) and (87) of JP-A-9-96891 into the second layer of Example 1D of the present invention, adding the compounds capable of discharging electrons of Example 1D of the present invention to the high-speed red-sensitive emulsion layer, the high-speed green-sensitive emulsion layer and the high-speed blue-sensitive emulsion layer and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained.

EXAMPLE 10D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 403 of Example 4 of JP-A-2001-228572 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion containing tabular silver iodobromide or iodochlorobromide grains having a (111) plane as a principal plane in which the variation coefficient of an equivalent circular diameter is 3% to 40%, an equivalent circular diameter is 1.0 μm or more, the thickness of grains is 0.10 μm or less, and the portions of a side and a corner are not lost.

EXAMPLE 11D

Emulsions were prepared by adding the compounds capable of discharging electrons of the present invention to the high-speed red-sensitive emulsion layer, the high-speed green-sensitive emulsion layer and the high-speed blue-sensitive emulsion layer in Example 6 of JP-A-2001-264911 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the photosensitive material in which pressure property and preservation stability were improved by tabular grains having a large size zone.

EXAMPLE 12D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 713 of Example 7 of JP-A-2001-281778 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion containing silver iodobromide or iodochlorobromide grains having a thickness of 0.1 μm or less which has an electron catching zone and has a silver iodobromide phase in which an annual ring is not observed.

EXAMPLE 13D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 205 of Example 2 of JP-A-2001-296627 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion which reduced the generation of non tabular grains, particularly rod grains caused by preparation of the tabular grains.

EXAMPLE 14D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 303 of Example 3 of JP-A-2002-169240 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion in which the stability of solubility in the lapse of time of the coating solution was improved.

EXAMPLE 15D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 205 of Example 2 of JP-A-2001-255613 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the (111) tabular grains having little pressure fog of a large size zone.

EXAMPLE 16D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 304 of Example 3 of JP-A-2002-268162 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the tabular grains which reduced fog at preservation in the lapse of time.

EXAMPLE 17D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 209 of Example 3 of JP-A-2001-235821 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the entire epitaxial emulsion in which the content of silver chloride is 1% by mole or more and 6% by mol or less, and the content of silver iodide is 0.5% by mole or more and 10% by mol or less.

EXAMPLE 18D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 202 of Example 4 of JP-A-2002-169241 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion containing tabular silver iodochlorobromide grains having a (111) plane as a principal plane which have epitaxial junctions at at least one apex portion.

EXAMPLE 19D

Emulsions were prepared by adding the compounds capable of discharging electrons of the present invention to the high-speed red-sensitive emulsion layer, the high-speed green-sensitive emulsion layer and the high-speed blue-sensitive emulsion layer in Example 3 of JP-A-2002-278008 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion containing tabular silver iodochlorobromide grains having a (111) plane as a principal plane which have epitaxial junction portions in which the content of silver chloride at at least one or more of apex portions of a hexagon is 5 to 25% by mole.

EXAMPLE 20D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 303 of Example 3 of JP-A-2002-169239 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion containing tabular silver iodochlorobromide grains having a (111) plane as a principal plane in which an equivalent circular diameter is 3.0 μm or more, and an aspect ratio is 8 or more, the tabular grains having epitaxial junction portions.

EXAMPLE 21D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 101 of Example 5 of JP-A-7-134351 and further reducing the coating amounts of silver in the high-speed red-sensitive emulsion layer, the high-speed green-sensitive emulsion-layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the photosensitive material comprising a hydrazine compound as an adsorptive group on silver halide.

EXAMPLE 22D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 602 of Example 6 of JP-A-2000-250157 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the photosensitive material comprising an emulsion containing a bispyridinium salt compound.

EXAMPLE 23D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 218 of Example 2 of JP-A-9-251193 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion produced by using the chemically modified gelatin which contains low molecular weight gelatin having a molecular weight of 70000 to 1000 in a dispersion medium solution at the nucleus formation process and in which the chemical modification rate of an amino group is 15 to 100% at the growth process in the production process of the emulsion.

EXAMPLE 24D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 103 of Example 2 of JP-A-2001-100343 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion produced in the presence of the chemically modified gelatin in which the grains growth is 40% by mass or more of a dispersion medium or low molecular weight gelatin in the production process of the emulsion.

EXAMPLE 25D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 305 of Example 3 of JP-A-2001-281780 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the emulsion containing gelatin containing a lot of a high molecular weight component.

EXAMPLE 26D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 203 of Example 3 of JP-A-3-39946 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the tabular emulsion containing mercaptobenzthiazole compounds.

EXAMPLE 27D

Emulsions were prepared by adding the compounds capable of discharging electrons of the present invention to the high-speed red-sensitive emulsion layer, the high-speed green-sensitive emulsion layer and the high-speed blue-sensitive emulsion layer in the sample 001 of Example 1 of JP-A-2001-75242 and further reducing the coating amounts of silver in the high-speed red-sensitive emulsion layer, the high-speed green-sensitive emulsion layer and the high-speed blue-sensitive emulsion layer. When the same evaluation as in Example 1D was carried out, performance with high sensitivity and excellent in grain sizes property and radial rays resistance nevertheless little amount of silver was obtained by using the total coating amounts of silver of the photosensitive material of the invention in combination with the compounds capable of discharging electrons (the exemplification compounds 7, 37 and T-1), in the photosensitive material with high sensitivity which enabled faithful color reproduction.

What is claimed is:

1. A silver halide color photosensitive material comprising at least one silver halide emulsion comprising at least one high-boiling organic solvent represented by the following structural formula (S) or (P) and at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

Formula (S):

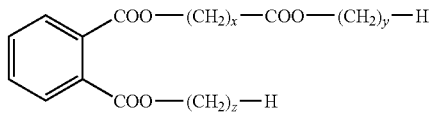

wherein each of x, y and z represents independently an integer of 1 to 6;

Formula (P):

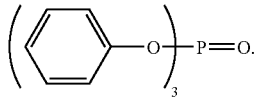

2. A silver halide color photosensitive material as claimed in claim 1 comprising a coupler represented by the following general formula (A) and at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

General formula (A):

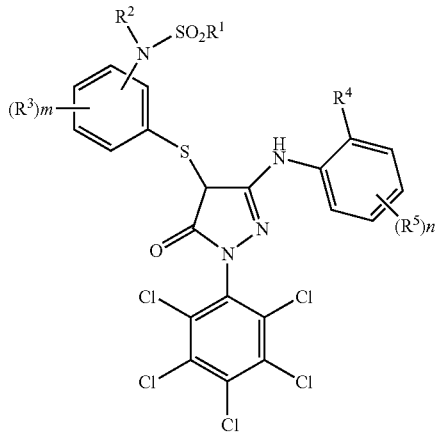

wherein $R^1$ represents an alkyl group, an aryl group, or a hetero cyclic group; $R^2$ represents a hydrogen atom or a substituent; $R^3$ represents a substituent; $R^4$ represents a halogen atom or an alkoxy group, $R^5$ represents an acylamino group, a sulfoneamido group, an imido group, a carbamoyl group, a sulfamoyl group, an alkoxycarbonyl group, an alkoxycarbonylamino group, or an alkoxy group; and each of m and n represents independently an integer of 0 to 4.

3. A silver halide color photosensitive material as claimed in claim 1 comprising a coupler represented by the following general formula (B) and at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

General formula (B):

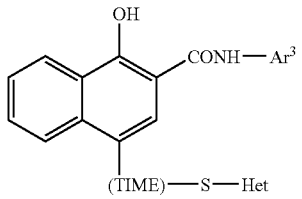

wherein $Ar^3$ represents an aryl group; Het represents an aromatic heterocyclic group having not more than 3 nitrogen atoms in a ring; and TIME is a timing group which does not comprise a nitrogen-containing aromatic hetero ring as a compositional element.

4. The silver halide color photosensitive material according to claim 2 comprising at least one surfactant represented by the following general formula (Q), General formula (Q):

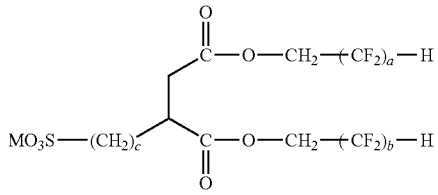

wherein M represents an alkali metal; each of a and b represents independently an integer of 4 to 8; and c represents 0 or 1.

5. The silver halide color photosensitive material according to claim 4, wherein the surfactant represented by the above general formula (Q) is the following compound (FT-0):

(FT-0)

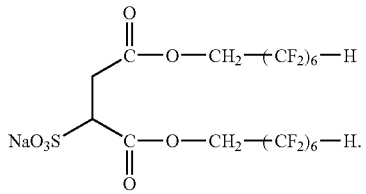

6. A silver halide color photosensitive material as claimed in claim 3 comprising on a support at least one layer of silver halide photographic emulsion layers containing a silver halide emulsion containing a methine compound represented by the general formula (I) on the surface of silver halide particles, the silver halide color photosensitive material comprising at least one compound selected from a group consisting of the following type 1 and type 2:

(Type 1)

Compound which undergoes a one-electron oxidation so as to form a one-electron oxidation product capable of, through subsequent bond cleavage reaction, releasing one or more electrons;

(Type 2)

Compound which undergoes a one-electron oxidation so as to form a one-electron oxidation product capable of, after subsequent bond formation reaction, releasing one or more electrons;

general formula (I):

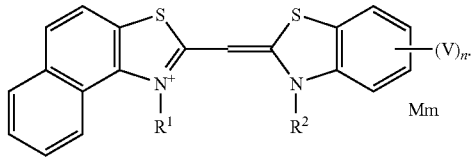

wherein V represents a monovalent substituent in which the σp value of Hammett substituent constant is −0.05 or less; n represents 1, 2, 3 and 4; represents a charge balancing counter ion; m represents a number required for balancing charge; $R^1$ and $R^2$ represent a substituted or unsubstituted alkyl group, but at least either of $R^1$ and $R^2$ is a substituted alkyl group represented by the following formula:

-(Q)u-X wherein Q represents a methylene group which may optionally have a substituent; X represents $SO_3$—, $CO_2$— or $PO_3^{2}$—; and u represents an integer of 1 or more.

7. The silver halide color photosensitive material according to claim 6, wherein the substituent defined by V of the methine compound represented by the general formula (I) is a methoxy group.

8. The silver halide color photosensitive material according to claim 1 having on a support at least one blue-sensitive silver halide emulsion layer, at least one green-sensitive silver halide emulsion layer and at least one red-sensitive silver halide emulsion layer, wherein the total coating amount of silver of the photosensitive silver halide is 6.0 g/$m^2$ or less in terms of metal silver, and the photosensitivity is the ISO speed of 400 or more.

9. The silver halide color photosensitive material according to claim 8, wherein the blue-sensitive silver halide emulsion layer, the green-sensitive silver halide emulsion layer and the red-sensitive silver halide emulsion layer have respectively 2 layers or more of emulsion layers having different sensitivities, and the coating amount in total of silver of the photosensitive silver halide in the highest-speed blue-sensitive layer, the highest-speed green-sensitive layer and the highest-speed red-sensitive layer is 4.0 g/$m^2$ or less in terms of metal silver.

10. The silver halide color photosensitive material according to claim , wherein the total coating amount of silver of the photosensitive silver halide of the silver halide color photosensitive material is 4.5 g/$m^2$ or less in terms of metal silver.

11. The silver halide color photosensitive material according to claim 2, wherein the compound selected from the group consisting of the type 1 and type 2 is a compound having at least one of an adsorptive group to silver halide or a partial structure of spectral sensitizing dye in the molecule.

12. The silver halide color photosensitive material according to claim 3, wherein the compound selected from the group consisting of the type 1 and type 2 is a compound having at least one of an adsorptive group to silver halide or a partial structure of spectral sensitizing dye in the molecule.

13. The silver halide color photosensitive material according to claim 1, wherein the compound selected from the group consisting of the type 1 and type 2 is a compound having at least one of an adsorptive group to silver halide or a partial structure of spectral sensitizing dye in the molecule.

14. The silver halide color photosensitive material according to claim 4, wherein the compound selected from the group consisting of the type 1 and type 2 is a compound having at least one of an adsorptive group to silver halide or a partial structure of spectral sensitizing dye in the molecule.

15. The silver halide color photosensitive material according to claim 6, wherein the compound selected from the group consisting of the type 1 and type 2 is a compound having at least one of an adsorptive group to silver halide or a partial structure of spectral sensitizing dye in the molecule.

16. The silver halide color photosensitive material according to claim 8, wherein the compound selected from the group consisting of the type 1 and type 2 is a compound having at least one of an adsorptive group to silver halide or a partial structure of spectral sensitizing dye in the molecule.

* * * * *